US010080262B2

(12) United States Patent
Mineoka et al.

(10) Patent No.: US 10,080,262 B2
(45) Date of Patent: Sep. 18, 2018

(54) COOKING DEVICE

(71) Applicant: Sharp Kabushiki Kaisha, Sakai-shi, Osaka (JP)

(72) Inventors: Tatsuya Mineoka, Sakai (JP); Shinya Kudo, Sakai (JP); Takushi Kishimoto, Sakai (JP); Yoshikazu Yamamoto, Sakai (JP); Kazuyuki Matsubayashi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 131 days.

(21) Appl. No.: 15/118,939

(22) PCT Filed: May 21, 2015

(86) PCT No.: PCT/JP2015/064647

§ 371 (c)(1),
(2) Date: Aug. 15, 2016

(87) PCT Pub. No.: WO2015/182485

PCT Pub. Date: Dec. 3, 2015

(65) Prior Publication Data

US 2016/0360577 A1 Dec. 8, 2016

(30) Foreign Application Priority Data

May 26, 2014 (JP) ..... 2014-108210
Jun. 18, 2014 (JP) ..... 2014-125624

(51) Int. Cl.
*H05B 6/64* (2006.01)
*F24C 1/00* (2006.01)
(Continued)

(52) U.S. Cl.
CPC ..... *H05B 6/6402* (2013.01); *F24C 1/00* (2013.01); *F24C 7/02* (2013.01); *F24C 15/003* (2013.01);
(Continued)

(58) Field of Classification Search
CPC .... H05B 6/6402; H05B 6/6408; H05B 6/642; H05B 6/6473; H05B 6/6476;
(Continued)

(56) References Cited

U.S. PATENT DOCUMENTS 4,627,409 A * 12/1986 Kagomoto ..... F24C 15/322 219/400
2007/0163567 A1* 7/2007 Kaneko ..... F24C 15/006 126/21 A
(Continued)

FOREIGN PATENT DOCUMENTS

JP S59-18322 A 1/1984
JP 03-144219 A 6/1991
(Continued)

OTHER PUBLICATIONS

Official Communication issued in International Patent Application No. PCT/JP2015/064647, dated Jul. 14, 2015.

*Primary Examiner* — Hung D Nguyen
(74) *Attorney, Agent, or Firm* — ScienBiziP, P.C.

(57) ABSTRACT

A cooking device has, in a cooking chamber thereof, a cooking tray (91) which is to be placed in the heating chamber (2) so as to have a gap against a rear portion (2*d*) of the heating chamber (2) and on which a heating object (15) to be heated is to be mounted directly or indirectly, a rear blowoff port (29) which is provided in the rear portion (2*d*) of the heating chamber (2) so as to be positioned on an upper side of the gap and near a rear portion of the cooking tray (91) and which is communicated with a duct (18) so as
(Continued)

to allow the heat medium to be blown off into the heating chamber (2), and a flow regulation structure (62) provided on a rear side of the rear blowoff port (29) and arranged to regulate a flow of the heat medium. The flow regulation structure (62) has, on a lower side thereof, a first guide surface (63) extending in a direction generally parallel to a horizontal direction.

18 Claims, 31 Drawing Sheets

(51) Int. Cl.
*F24C 7/02* (2006.01)
*F24C 15/00* (2006.01)
*F24C 15/32* (2006.01)

(52) U.S. Cl.
CPC ..... *F24C 15/325* (2013.01); *H05B 6/6479* (2013.01)

(58) Field of Classification Search
CPC .. H05B 6/6479; H05B 6/6482; H05B 6/6485; F24C 15/003; F24C 15/006; F24C 15/02; F24C 15/025; F24C 15/04; F24C 15/2007; F24C 15/322; F24C 15/325; F24C 15/327; F24C 1/00; F24C 1/14; F24C 7/02; F24C 7/06; F24C 7/087
USPC ..... 219/756, 678, 679, 680, 681, 757, 762, 219/763, 682, 753
See application file for complete search history.

(56) References Cited

U.S. PATENT DOCUMENTS

| | | | | |
|---|---|---|---|---|
| 2007/0295718 | A1* | 12/2007 | Takei ..... | H05B 6/80 219/756 |
| 2009/0183724 | A1* | 7/2009 | Hirano ..... | F24C 15/322 126/21 A |
| 2011/0147376 | A1 | 6/2011 | Ueda et al. | |

FOREIGN PATENT DOCUMENTS

| | | | | |
|---|---|---|---|---|
| JP | 8-31561 | A | * | 2/1996 |
| JP | 08-31561 | A | | 2/1996 |
| JP | 2004-316999 | A | | 11/2004 |
| JP | 2005-233601 | A | * | 9/2005 |
| JP | 2010-38368 | A | * | 2/2010 |
| JP | 2010-038368 | A | | 2/2010 |
| JP | 2010-054173 | A | | 3/2010 |

* cited by examiner

COOKING DEVICE

TECHNICAL FIELD

The present invention relates to cooking devices.

BACKGROUND ART

Among conventional cooking devices is one described in JP 2004-316999 A (PTL1). This cooking device includes a heating chamber, a circulation duct provided on a rear side of the heating chamber, and a circulation fan placed in the circulation duct. The circulation duct is communicated with inside of the heating chamber via suction ports and blowoff ports in rear portion of the heating chamber.

According to the cooking device having the above constitution, as the circulation fan is driven, a heat medium, e.g. air, in the heating chamber is sucked into the circulation duct through the suction ports, flowing toward the blowoff ports. On this way, the air flowing from the suction ports toward the blowoff ports is heated by heaters placed on a downstream side of the circulation fan and on an upstream side of the blowoff ports. As a result of this, air heated by the heaters impinges on a heating object, which is to be heated, placed in the heating chamber, so that the heating object is heated.

CITATION LIST

Patent Literature

PTL1: JP 2004-316999 A

SUMMARY OF INVENTION

Technical Problem

In the case where the cooking device is capable of heating the heating object in the heating chamber with microwaves, a large electrical discharge is likely to occur when microwaves are mis-radiated in the heating chamber while the cooking tray in the heating chamber is in contact with the rear portion of the heating chamber.

Such a large electrical discharge can be suppressed by an arrangement that a gap is generated between the cooking tray and the rear portion of the heating chamber when the cooking tray is set in the heating chamber.

However, with the gap provided, given that the blowoff ports are present near the rear portion of the cooking tray, most of air blown off from the blowoff ports flows to the lower side of the cooking tray via the gap.

As a consequence, less air impinges on the heating object placed on the cooking tray, resulting in a poor heating efficiency for the heating object as a problem.

Accordingly, an object of the invention is to provide cooking devices capable of efficiently heating a heating object placed on the cooking tray by blowing off the heat medium from the blowoff ports even with a gap provided between the cooking tray and the rear portion of the heating chamber.

Solution to Problem

A cooking device according to an aspect of the invention comprises:

a casing;

a heating chamber provided in the casing;

a microwave generator arranged to supply microwaves into the heating chamber;

a cooking tray which is to be placed in the heating chamber so as to have a gap against a rear portion of the heating chamber and on which a heating object to be heated is to be mounted directly or indirectly;

a duct which is provided on a rear side of the heating chamber and through which a heat medium flows from an upper side toward a lower side;

a rear blowoff port which is provided in the rear portion of the heating chamber so as to be positioned on an upper side of the gap and near a rear portion of the cooking tray and which is communicated with the duct so as to allow the heat medium to be blown off into the heating chamber; and a flow regulation structure provided on a rear side of the rear blowoff port and arranged to regulate a flow of the heat medium, wherein the flow regulation structure has, on a lower side thereof, a first guide surface extending in a direction generally parallel to a horizontal direction.

In the cooking device of one embodiment, the flow regulation structure has, on an upper side thereof, a second guide surface sloped with its front end lower than its rear end.

The cooking device of one embodiment further comprise a damper provided in the duct to open and close the rear blowoff port, wherein the damper is sloped with its front end lower than its rear end when the damper is in an opened state.

In the cooking device of one embodiment, the duct includes an upper portion positioned on an upper side of the heating chamber, and a downward extending portion which extends downward from one end of the upper portion, and the cooking device further comprises:

a centrifugal fan which is rotatable forward and reverse to feed the heat medium into the upper portion of the duct;

a first heater placed on one side in the upper portion of the duct;

a second heater placed on an opposite side in the upper portion of the duct;

a first upper blowoff port provided in the upper portion of the heating chamber and arranged to blow off the heat medium derived from the first heater into the heating chamber; and a second upper blowoff port provided in the upper portion of the heating chamber and arranged to blow off the heat medium derived from the second heater into the heating chamber.

It is noted that the term 'one side' refers to either one lateral side or a front side. The term 'opposite side' refers to an opposite lateral side on condition that the 'one side' refers to the one lateral side, and refers to a rear side on condition that the 'one side' refers to the front side.

In the cooking device of one embodiment, the cooking tray partitions the heating chamber into an upper space and a lower space, the rear blowoff port is a first rear blowoff port opened to the upper space, the heating chamber has a second rear blowoff port which is provided in the rear portion of the heating chamber so as to be positioned below the first rear blowoff port and which is opened to the lower space, and the duct is communicated with the upper space via the first rear blowoff port and with the lower space via the second rear blowoff port, and the cooking device further comprises:

a saturated steam generator arranged to generate saturated steam to be supplied into the duct;

a fan placed in the duct;

a heater at least part of which is placed between the fan and the first rear blowoff port;

a damper arranged to open and close a gap between the fan and the second rear blowoff port;

a first cooking control part configured to control the damper, the fan and the saturated steam generator in such fashion that with the gap between the fan and the second rear blowoff port opened, the fan feeds saturated steam in the duct to the second rear blowoff port; and a second cooking control part configured to control the damper, the fan and the heater in such fashion that with the gap between the fan and the second rear blowoff port closed, the fan feeds the heat medium in the duct to the heater and moreover the heater heats the heat medium.

A cooking device according to an aspect of the invention comprises:

a casing;

a heating chamber provided in the casing and arranged to accommodate a heating object to be heated;

a duct which is provided outside the heating chamber and which has an upper portion positioned on an upper side of the heating chamber and a downward extending portion downwardly extending from one end of the upper portion;

a centrifugal fan which is rotatable forward and reverse to feed a heat medium into the upper portion of the duct;

a first heater placed on one side in the upper portion of the duct;

a second heater placed on an opposite side in the upper portion of the duct;

a first blowoff port provided in the upper portion of the heating chamber and arranged to blow off the heat medium derived from the first heater into the heating chamber; and a second blowoff port provided in the upper portion of the heating chamber and arranged to blow off the heat medium derived from the second heater into the heating chamber.

It is noted that the term 'one side' refers to either one lateral side or a front side. The term 'opposite side' refers to an opposite lateral side on condition that the 'one side' refers to the one lateral side, and refers to a rear side on condition that the 'one side' refers to the front side.

The cooking device of one embodiment further comprises a first partition for separating the one side within the upper portion of the duct from the opposite side within the upper portion of the duct.

The cooking device of one embodiment further comprises:

a cooking tray which is to be placed in the heating chamber and on which a heating object to be heated is mounted directly or indirectly;

a third heater arranged to heat a heat medium flowing from the centrifugal fan into the downward extending portion of the duct;

a second partition arranged to partition the one side within the downward extending portion of the duct and the opposite side within the downward extending portion of the duct from each other;

a third blowoff port provided in the rear portion or a side portion of the heating chamber so as to be positioned near the cooking tray, and arranged to blow off the heat medium derived from the one side within the downward extending portion of the duct into the heating chamber; and a fourth blowoff port provided in the rear portion or a side portion of the heating chamber so as to be positioned near the cooking tray, and arranged to blow off the heat medium derived from the opposite side within the downward extending portion of the duct into the heating chamber.

It is noted that the term 'one side' refers to either one lateral side or a front side. The term 'opposite side' refers to an opposite lateral side on condition that the 'one side' refers to the one lateral side, and refers to a rear side on condition that the 'one side' refers to the front side.

A cooking device according to an aspect of the invention comprises:

a casing;

a heating chamber provided in the casing;

a cooking tray to be placed in the heating chamber to partition inside of the heating chamber into an upper space and a lower space;

an upper blowoff port provided in the heating chamber so as to be opened to the upper space;

a lower blowoff port provided in the heating chamber so as to be opened to the lower space;

a duct provided outside the heating chamber so as to be communicated with the inside of the heating chamber via the upper blowoff port and the lower blowoff port;

a saturated steam generator arranged to generate saturated steam to be supplied into the duct;

a fan placed in the duct;

a heater at least part of which is placed between the fan and the upper blowoff port;

a damper arranged to open and close a gap between the fan and the lower blowoff port;

a first cooking control part configured to control the damper, the fan and the saturated steam generator in such fashion that with the gap between the fan and the lower blowoff port opened, the fan feeds saturated steam in the duct to the lower blowoff port; and a second cooking control part configured to control the damper, the fan and the heater in such fashion that with the gap between the fan and the lower blowoff port closed, the fan feeds the heat medium in the duct to the heater and moreover the heater heats the heat medium.

A cooking device according to an aspect of the invention comprises:

a casing;

a heating chamber provided in the casing and having an opening on a front side thereof;

a door arranged to open and close the opening;

a cooking tray to be placed in the heating chamber to partition inside of the heating chamber into an upper space and a lower space;

a gap provided between the door and the cooking tray or between the heating chamber and the cooking tray to allow the upper space and the lower space to be communicated with each other;

an upper blowoff port provided in the heating chamber so as to be opened to the upper space;

a heater arranged to heat a heat medium blown off from the upper blowoff port;

a steam supply port provided in the heating chamber so as to be opened to the upper space;

a saturated steam generator arranged to generate saturated steam to be fed to the steam supply port;

a temperature sensor arranged to detect a temperature of the upper space; and a cooking control part configured to control the saturated steam generator based on the temperature detected by the temperature sensor in such fashion that the saturated steam is supplied to the upper space via the steam supply port when the upper space has come to a temperature over 100° C.

A cooking device according to an aspect of the invention comprises:

a casing;

a heating chamber which is provided in the casing and in which a corner portion connecting an upper portion to a rear portion or a side portion is sloped relative to a horizontal direction;

a circulation duct provided so as to range from an upper side to a rear side or a lateral side of the heating chamber;

a heater placed in the circulation duct; and a circulation fan arranged to feed a heat medium to the heater, wherein the circulation fan is placed in the circulation duct so as to be opposed to the corner portion.

The cooking device of one embodiment further comprises a cooking tray which is to be placed in the heating chamber to partition inside of the heating chamber into an upper space and a lower space, wherein the heating chamber has:

a suction port provided in the corner portion and communicated with inside of the circulation duct;

a first blowoff port provided in the upper portion and communicated with the inside of the circulation duct; and a second blowoff port provided in the rear portion or a side portion and communicated with the inside of the circulation duct, the suction port and the first and second blowoff ports being opened to the upper space, respectively.

The cooking device of one embodiment further comprises a damper arranged to open and close the second blowoff port, wherein the heating chamber has a third blowoff port provided in the rear portion or a side portion so as to be communicated with the inside of the circulation duct and opened to the lower space, and wherein the damper, when having opened the second blowoff port, closes a gap between the circulation fan and the third blowoff port and, when having closed the second blowoff port, opens the gap between the circulation fan and the third blowoff port.

The cooking device of one embodiment further comprises a steam tube provided in the circulation duct; and a saturated steam generator arranged to generate saturated steam to be fed to the steam tube, wherein the steam tube blows off saturated steam derived from the saturated steam generator toward a downstream side of the circulation fan in the circulation duct.

In the cooking device of one embodiment, the steam tube is provided in a portion of the circulation duct that is opposed to the corner portion, and the circulation fan is a forward-and-reverse rotatable centrifugal fan.

The cooking device of one embodiment further comprises a structure which, with the circulation fan at rest, allows saturated steam, which has been blown off from the steam tube, to flow directly into the heating chamber without passing via the heater.

In the cooking device of one embodiment, a gap is provided between a heating chamber-side end of the steam tube and the corner portion, and a steam supply port opposed to the heating chamber-side end of the steam tube is provided in the corner portion.

The cooking device of one embodiment further comprises:

a circulation fan unit including the circulation fan and a motor for driving the circulation fan, the circulation fan unit being attached to the circulation duct so as to be opposed to the corner portion;

an attachment member for attaching the circulation fan unit to the circulation duct; and a seal member arranged to seal between the circulation fan unit and the attachment member 1082, wherein the attachment member is formed in such fashion that a space is generated between the circulation duct and a portion of the attachment member that is in contact with the seal member.

In the cooking device of one embodiment, the circulation fan unit is removably attached to the circulation duct.

The cooking device of one embodiment further comprises:

a temperature sensor attached to the circulation duct;

a seal member arranged to seal between the circulation duct and the temperature sensor; and an opposed portion provided in the circulation duct and opposed to the seal member, wherein a portion of the circulation duct to be put in contact with the seal member as well as the opposed portion are formed in such fashion that a space is generated between the portion and the opposed portion.

The cooking device of one embodiment further comprises:

a steam tube provided in the circulation duct; and a saturated steam generator arranged to generate saturated steam to be fed to the steam tube, wherein the steam tube has a first steam tube placed outside the circulation duct, and a second steam tube placed within the circulation duct and communicated with the first steam tube, the circulation duct has a first attachment portion to which the first steam tube is attached, and a second attachment portion to which the second steam tube is attached, and the first and second attachment portions are formed in such fashion that a space is generated between a second steam tube-side end of the first steam tube and a first steam tube-side end of the second steam tube.

Advantageous Effects of Invention

According to the cooking device of the present invention, the flow regulation structure has, on the lower side, the first guide surface which extends in a direction generally parallel to the horizontal direction. This makes it possible to reduce the heat medium directed from the rear blowoff port toward the gap between the rear portion of the heating chamber and the cooking tray. As a result, the heat medium flowing along the upper side of the cooking tray can be increased, so that the heating object on the cooking tray can be heated with high efficiency.

For example, when the heating object is mounted on the cooking tray with a cooking grid interposed therebetween, the heat medium flowing along the upper side of the cooking tray can be increased. Thus, the bottom surface of the heating object can be grilled with high efficiency.

While the cooking tray is placed in the heating chamber, there is a gap between the cooking tray and the rear portion of the heating chamber. Therefore, even if microwaves are mis-supplied into the heating chamber with the cooking tray placed in the heating chamber, electrical discharge is less likely to occur in the heating chamber.

Also, the cooking device may include a first heater placed on one side in the upper portion of the duct and a second heater placed on an opposite side in the upper portion of the duct. The centrifugal fan feeds the heat medium into the upper portion of the duct. In this case, a quantity of the heat medium flowing to one of the first and second heaters becomes larger than a quantity of the heat medium flowing to the other of the first and second heaters. Therefore, large quantities of the heat medium heated by the one of the first and second heaters are blown off from one of the first and second blowoff ports. Thus, spot-basis heating can be fulfilled under one of the first and second blowoff ports.

Since large quantities of the heat medium heated by one of the first and second heaters are allowed to be blown off from one of the first and second blowoff ports, the heating object placed under the one of the first and second blowoff ports can be heated even if the space under the other of the first and second blowoff ports is not warmed. Therefore, the time that would otherwise be required to warm the space under the other of the first and second blowoff ports can be saved, so that the heating of the heating object placed under the one of the first and second blowoff ports is allowed to be completed in shorter time.

Since the heat medium heated by one of the first and second heaters is allowed to be blown off in large quantities from one of the first and second blowoff ports, the upper surface of the heating object placed under the one of the first and second blowoff ports can be heated uniformly.

In the case where the centrifugal fan is rotated reverse and one of the first and second heaters is turned OFF while the other of the first and second heaters is turned ON, large quantities of the heat medium heated by the other of the first and second heaters are blown off from the other of the first and second blowoff ports. Thus, spot-basis heating can be fulfilled also under the other of the first and second blowoff ports.

In the cooking device according to an aspect of the present invention, the first cooking control part controls the damper, the fan and the saturated steam generator in such fashion that with the gap between the fan and the lower blowoff port opened, the fan feeds saturated steam in the duct to the lower blowoff port. As a result of this, the saturated steam can be supplied to the lower space via the lower blowoff port. Thus, the cooking device is enabled to perform steam cooking in the lower space.

Also, in the cooking device, the second cooking control part controls the damper, the fan and the heater in such fashion that with the gap between the fan and the upper blowoff port, the fan feeds the heat medium in the duct to the heater and moreover that the heater heats the heat medium. As a result of this, a high-temperature heat medium can be supplied to the upper space via the upper blowoff port. Thus, the cooking device is enabled to perform grill cooking in the upper space.

On the other hand, while the second cooking control part controls the damper and the like, the gap between the fan and the upper blowoff port is closed, so that the heat medium can be prevented from being supplied to the lower space via the lower blowoff port. Thus, adverse effects on the steam cooking performed in the lower space can be prevented.

Consequently, the cooking device is enabled to perform different kinds of cooking in the upper space and the lower space, respectively.

In the cooking device according to an aspect of the present invention, the cooking control part controls the saturated steam generator based on the temperature, detected by the temperature sensor, of the upper space of the heating chamber in such fashion that the saturated steam is supplied to the upper space via the steam supply port when the upper space has come to a temperature over 100° C. Thus, whereas saturated steam is supplied to the upper space, saturated steam lower in temperature than the upper space flows down to the lower space via the gap between the door and the cooking tray and/or the gap between the cooking chamber and the cooking tray. As a result, the cooking device is enabled to fill saturated steam into the lower space to perform steam cooking in the lower space.

Since the saturated steam flows down from the gap to the lower space, the cooking device is enabled to perform grill cooking in the upper space.

Consequently, the cooking device is enabled to perform different kinds of cooking in the upper space and the lower space, respectively.

In the cooking device according to an aspect of the present invention, the circulation fan is placed in the circulation duct so as to be opposed to the corner portion. As a result of this, a distance between the rear portion of the heating chamber and the rear portion of the casing and/or a distance between a side portion of the heating chamber and a side portion of the casing can be shortened. Thus, increase in the depth and/or the lateral length of the casing is suppressed and the casing can be downsized.

Since the circulation fan is placed in the circulation duct so as to be opposed to the corner portion, increase in the height of the casing can be suppressed.

Since the corner portion of the heating chamber connects the upper portion of the heating chamber and the rear portion or a side portion of the heating chamber to each other while being sloped relative to the horizontal direction, the capacity, or internal volume, of the heating chamber can be reduced, so that the temperature inside the heating chamber 1002 can be raised in short time.

DESCRIPTION OF EMBODIMENTS

Hereinbelow, the cooking devices of the present invention will be described in detail by embodiments thereof illustrated in the accompanying drawings. In the following description, the term 'left side' refers to a left-hand side of a viewer facing a cooking device as the cooking device is viewed from its door side, and the term 'right side' refers to a right-hand side of a viewer facing the cooking device as the cooking device is viewed from its door side.

(First Embodiment)

Figure 1:
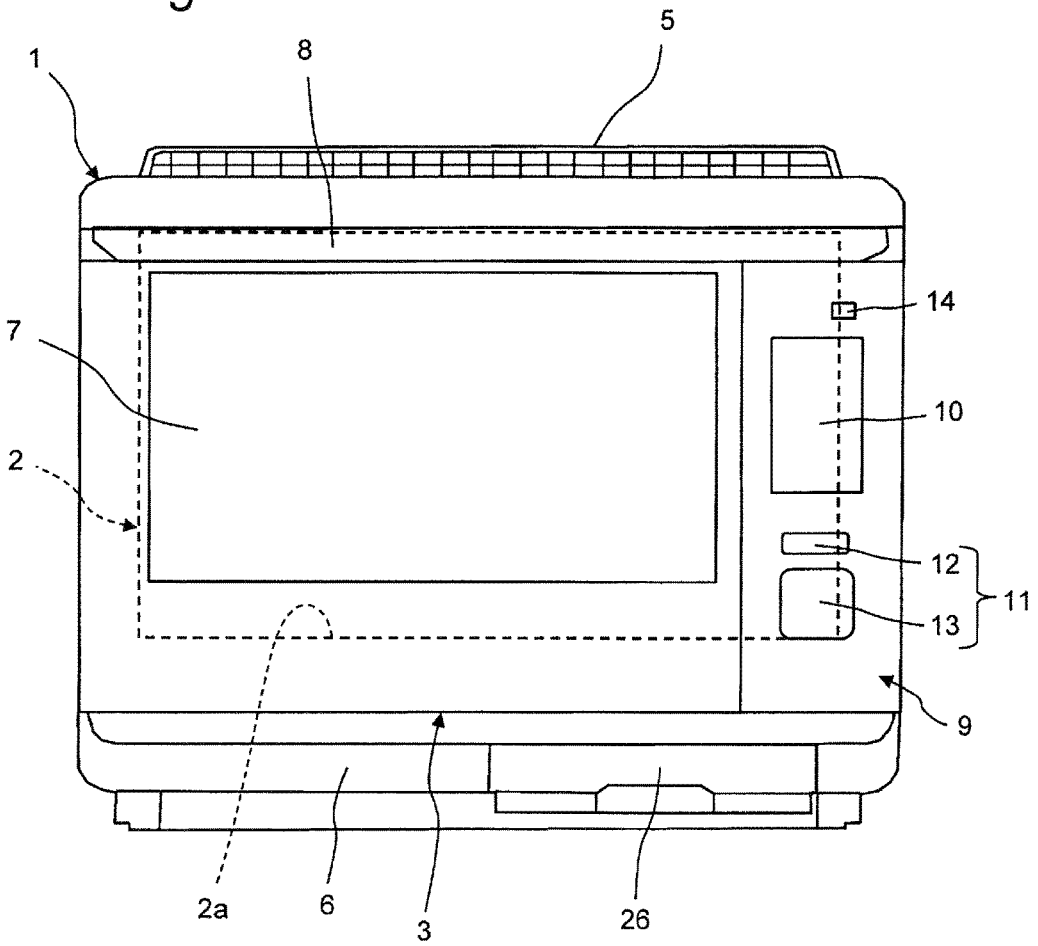
FIG. 1 is a schematic front view of a cooking device, with its door closed, according to a first embodiment of the invention.
Figure 2:
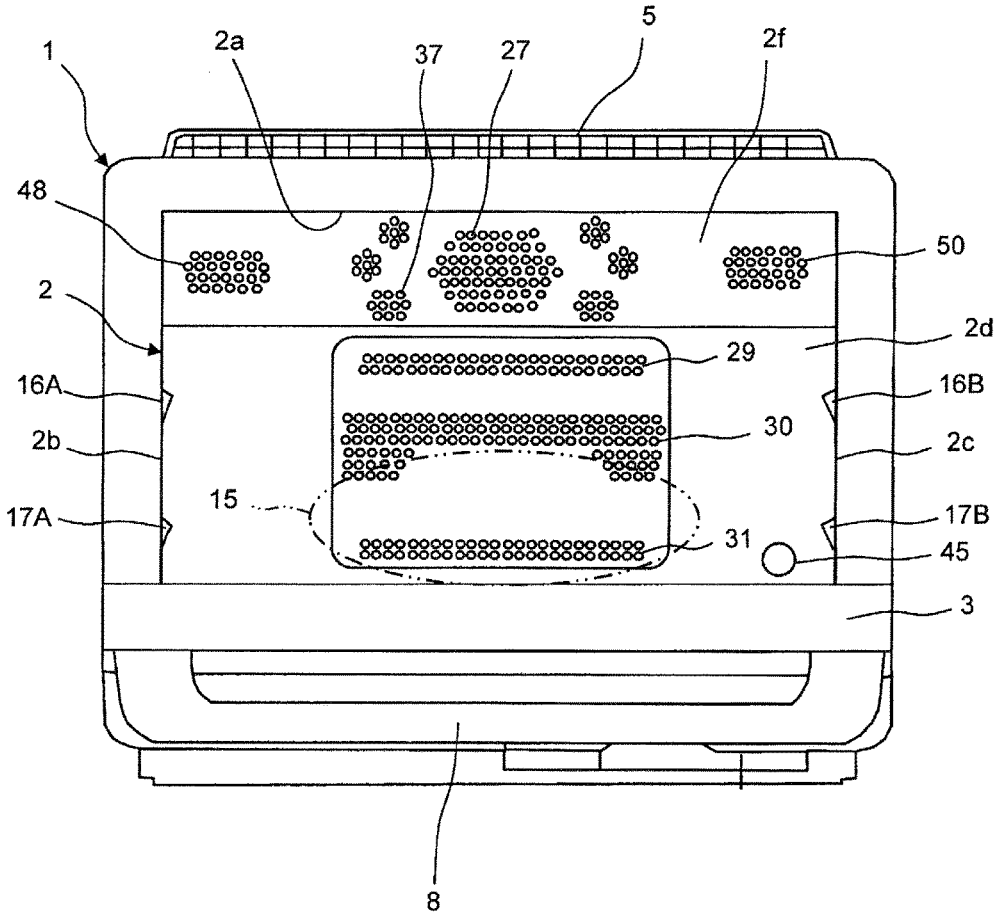
FIG. 2 is a schematic front view of the cooking device of the first embodiment, with its door opened.

FIG. 1 is a schematic front view of a cooking device, with its door closed, according to the first embodiment of the invention. FIG. 2 is a schematic front view of the cooking device with its door opened.

As shown in FIGS. 1 and 2, the cooking device includes a rectangular parallelepiped-shaped casing 1, a heating chamber 2 provided in the casing 1 and having an opening 2*a* on its front side, a door 3 arranged to open and close the opening 2*a* of the heating chamber 2, and a magnetron 4 (shown in FIG. 5) arranged to supply microwaves into the heating chamber 2. The magnetron 4 is one example of the microwave generator.

An exhaust duct 5 is provided in rear portion of a top surface of the casing 1. A dew receiving container 6 is removably attached in a lower front of the casing 1. The dew receiving container 6, located below the door 3, is enabled to receive water droplets derived from a back face (heating chamber 2-side surface) of the door 3. A later-described water supply tank 26 is also removably attached in the lower front of the casing 1.

The door 3 has a lower portion pivotably attached in the front face of the casing 1. A transparent outer glass 7 having thermal resistance is provided in a front face (a surface opposite to the heating chamber 2-side surface) of the door 3. The door 3 also has a handle 8 positioned above the outer glass 7, and an operation panel 9 provided on a right side of the outer glass 7.

The operation panel 9 has a color LCD (Liquid Crystal Display) part 10 and a button group 11. The button group 11 includes a cancel key 12 to be pressed for halfway stop of heating or other occasions, and a heating start key 13 to be pressed for a start of heating. In the operation panel 9, an infrared ray receiving part 14 for receiving an infrared ray derived from a smartphone or the like is provided.

A heating object 15, which is to be heated, is accommodated in the heating chamber 2. Metallic cooking trays 91, 92 (shown in FIG. 3) can be put into and out of the heating chamber 2. Upper tray holders 16A, 16B for supporting the cooking tray 91 are provided on inner surfaces of a left side portion 2*b* and a right side portion 2*c*, respectively, of the heating chamber 2. Lower tray holders 17A, 17B for supporting the cooking tray 92 are provided on inner surfaces of the left side portion 2*b* and the right side portion 2*c*, respectively, of the heating chamber 2 so as to be positioned below the upper tray holders 16A, 16B.

The cooking trays 91, 92, when set in the heating chamber 2, each have a gap to the door 3 as well as a gap to a rear portion 2*d* of the heating chamber 2. More specifically, contact portions (not shown) are provided at rear end portions of the upper tray holders 16A, 16B and the lower tray holders 17A, 17B, respectively. These contact portions come into contact with the cooking trays 91, 92 before those cooking trays 91, 92 come into contact with the rear portion 2*d* of the heating chamber 2 so that rearward movement of the cooking trays 91, 92 is restricted. In this case, a gap of, e.g., 3 mm as a length in the front-and-rear direction may be generated between the cooking trays 91, 92 and the rear portion 2*d* of the heating chamber 2.

Figure 3:
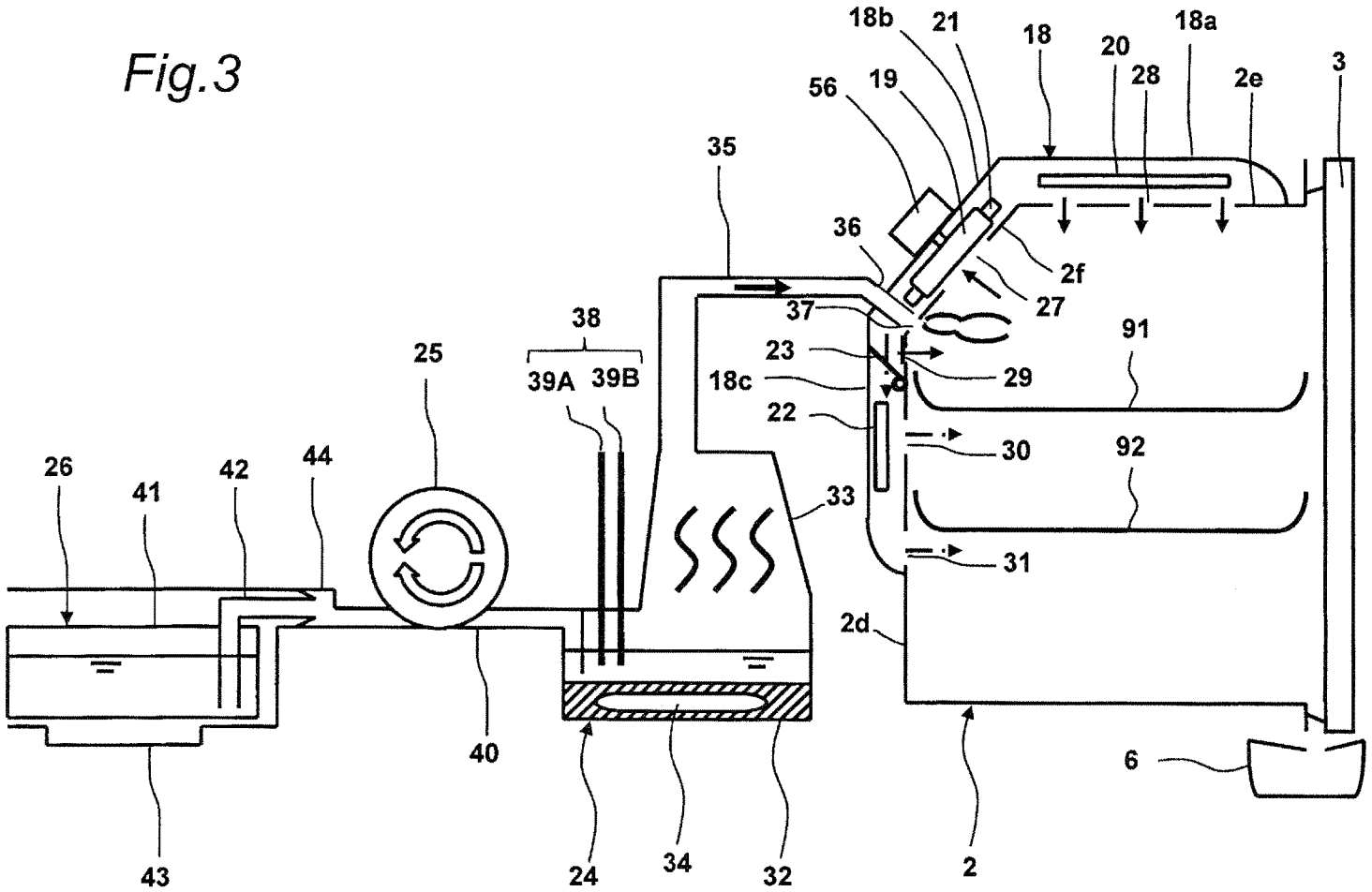
FIG. 3 is a schematic view for explaining a main-part structure of the cooking device of the first embodiment.

FIG. 3 is a schematic view for explaining a main-part structure of the cooking device. In this FIG. 3, the heating chamber 2 is shown as viewed from the left side.

The cooking device includes a circulation duct 18, a circulation fan 19, an upper heater 20, a middle heater 21, a lower heater 22, a circulation damper 23, a steam generator 24, a tube pump 25, and a water supply tank 26. These upper heater 20, middle heater 21 and lower heater 22 are provided each as a sheath heater. The circulation duct 18 is an example of the duct. The circulation damper 23 is an example of the damper.

An upper portion 2*e* of the heating chamber 2 continues to the rear portion 2*d* of the heating chamber 2 via a sloped portion 2*f* sloped relative to a horizontal direction. In the sloped portion 2*f*, a plurality of suction ports 27 are provided so as to be opposed to the circulation fan 19. A plurality of upper blowoff ports 28 are provided in the upper portion 2*e* of the heating chamber 2. First rear blowoff ports 29, second rear blowoff ports 30 and third rear blowoff ports 31 are provided, each in plurality, in the rear portion 2*d* of the heating chamber 2. The first rear blowoff ports 29 are an example of the rear blowoff port. In addition, the upper blowoff ports 28 are depicted only three in number in FIG. 3. Only one of the suction ports 27, one of the first rear blowoff ports 29, one of the second rear blowoff ports 30 and one of the third rear blowoff ports 31 are depicted in FIG. 3.

The circulation duct 18 is provided outside the heating chamber 2 so as to be communicated with inside of the heating chamber 2 via the suction ports 27, the upper blowoff ports 28 and the first to third rear blowoff ports 29 to 31. The circulation duct 18 is provided so as to range from the upper side to the rear side of the heating chamber 2 and extend in an inverted-L like shape. More specifically, the circulation duct 18 is composed of a front portion 18*a* which is opposed to the upper portion 2*e* of the heating chamber 2, a connecting portion 18*b* which extends obliquely downward from a rear end of the upper portion and which is opposed to the sloped portion 2*f* of the heating chamber 2, and a rear portion 18*c* which extends directly downward from a lower end of the connecting portion 18*b* and which is opposed to the rear portion 2*d* of the heating chamber 2. The circulation duct 18 has a left-right width, or a lateral width, set narrower than a left-right width of the heating chamber 2.

The circulation fan 19, provided as a forward-and-reverse rotatable centrifugal fan, is driven by a motor 56 for the circulation fan (referred to as "circulation fan motor 56" below). As the circulation fan motor 56 drives the circulation fan 19, air and saturated steam and the like (hereinafter, referred to as 'air and the like') within the heating chamber 2 are sucked through the suction ports 27 into the circulation duct 18, then allowed to flow radially outward of the circulation fan 19. More specifically, on the upper side of the circulation fan 19, air and the like are allowed to flow obliquely upward from the circulation fan 19 and then flow from rear toward front. On the lower side of the circulation fan 19, on the other hand, air and the like are allowed to flow obliquely downward from the circulation fan 19 and then flow from above toward below. In addition, the air and the like are an example of the heat medium.

The upper heater 20 is placed within the front portion 18*a* of the circulation duct 18 and opposed to the upper portion 2*e* of the heating chamber 2. The upper heater 20 heats air and the like flowing to the upper blowoff ports 28.

The middle heater 21 is formed into such an annular shape as to surround the circulation fan 19. The middle heater 21 heats air and the like flowing from the circulation fan 19 toward the upper heater 20 or heats air and the like flowing from the circulation fan 19 toward the lower heater 22.

The lower heater 22 is placed within the rear portion 18*c* of the circulation duct 18 and opposed to the rear portion 2*d* of the heating chamber 2. The lower heater 22 heats air and the like flowing to the second and third rear blowoff ports 30, 31.

The circulation damper 23 is pivotably provided within the circulation duct 18 and positioned between the middle heater 21 and the lower heater 22. Pivoting of the circulation damper 23 is performed by a motor 59 for the circulation damper (referred to as "circulation damper motor 59" below) (shown in FIG. 5). Pivoting of the circulation damper 23 causes the first rear blowoff ports 29 to be opened and closed.

The circulation damper 23, when having opened the first rear blowoff ports 29, closes a range between the circulation fan 19 and the second rear blowoff ports 30. As a result of this, the first rear blowoff ports 29 are allowed to blow off air and the like heated by the middle heater 21 into the heating chamber 2, whereas the second and third rear blowoff ports 30, 31 are no longer allowed to blow off air and the like heated by the middle heater 21 into the heating chamber 2.

The circulation damper 23, when having closed the first rear blowoff ports 29, opens the range between the circulation fan 19 and the second rear blowoff ports 30. As a result of this, the first to third rear blowoff ports 29 to 31 are allowed to blow off air and the like heated by the middle heater 21 into the heating chamber 2.

The first rear blowoff ports 29 are positioned above the gap between the cooking tray 91 and the rear portion 2*d* of the heating chamber 2 and moreover near the rear portion of the cooking tray 91. The inside of the heating chamber 2 is communicated with inside of the rear portion 18*c* of the circulation duct 18 via the first rear blowoff ports 29.

The steam generator 24 includes a metallic container 32 having an upper-end opening, a resin-made lid 33 for closing the opening, and a steam-generating heater 34 cast into a bottom portion of the container 32 and provided as a sheath heater. Water derived from the water supply tank 26 accumulates on the bottom portion of the container 32, and the water is heated by the steam-generating heater 34 via the bottom portion of the container 32. Saturated steam generated by this heating flows through a resin-made steam tube 35 and a metallic steam tube 36 so as to be supplied into the connecting portion 18*b* of the circulation duct 18. In this case, with the circulation fan 19 in a driven state, the saturated steam derived from the steam generator 24 is fed toward the front portion 18*a* of the circulation duct 18 and the rear portion 2*d*. With the circulation fan 19 in a non-driven state, the saturated steam derived from the steam generator 24 flows out into the heating chamber 2 via a plurality of steam supply ports 37. Only one of the steam supply ports 37 is depicted in FIG. 3.

The saturated steam within the heating chamber 2 is fed by the circulation fan 19 to the upper heater 20, the middle heater 21 and the lower heater 22, where the saturated steam is heated by the upper heater 20, the middle heater 21 and the lower heater 22, resulting in superheated steam of 100° C. or higher.

In the lid 33, a water level sensor 38 composed of a pair of electrodes 39A, 39B is attached. Based on whether there has arisen an electrical continuity between these electrodes 39A, 39B, it is decided whether or not the water level on the bottom portion of the container 32 has reached a specified level.

The tube pump 25 operates so that a water supply/drain tube 40 made from silicone rubber or the like and elastically deformable is squeezed by a roller (not shown), causing water in the water supply tank 26 to flow to the steam generator 24 or causing the water in the steam generator 24 to flow to the water supply tank 26.

The water supply tank 26 has a water supply tank body 41 and a communicating tube 42. The communicating tube 42 has one end portion positioned within the water supply tank body 41 and the other end portion positioned outside the water supply tank 26. As the water supply tank 26 is accommodated in a tank cover 43, the other end portion of the communicating tube 42 is connected to the water supply/drain tube 40 via a tank joint portion 44. That is, inside of the water supply tank body 41 is communicated with inside of the steam generator 24 via the communicating tube 42 or the like.

Figure 4:
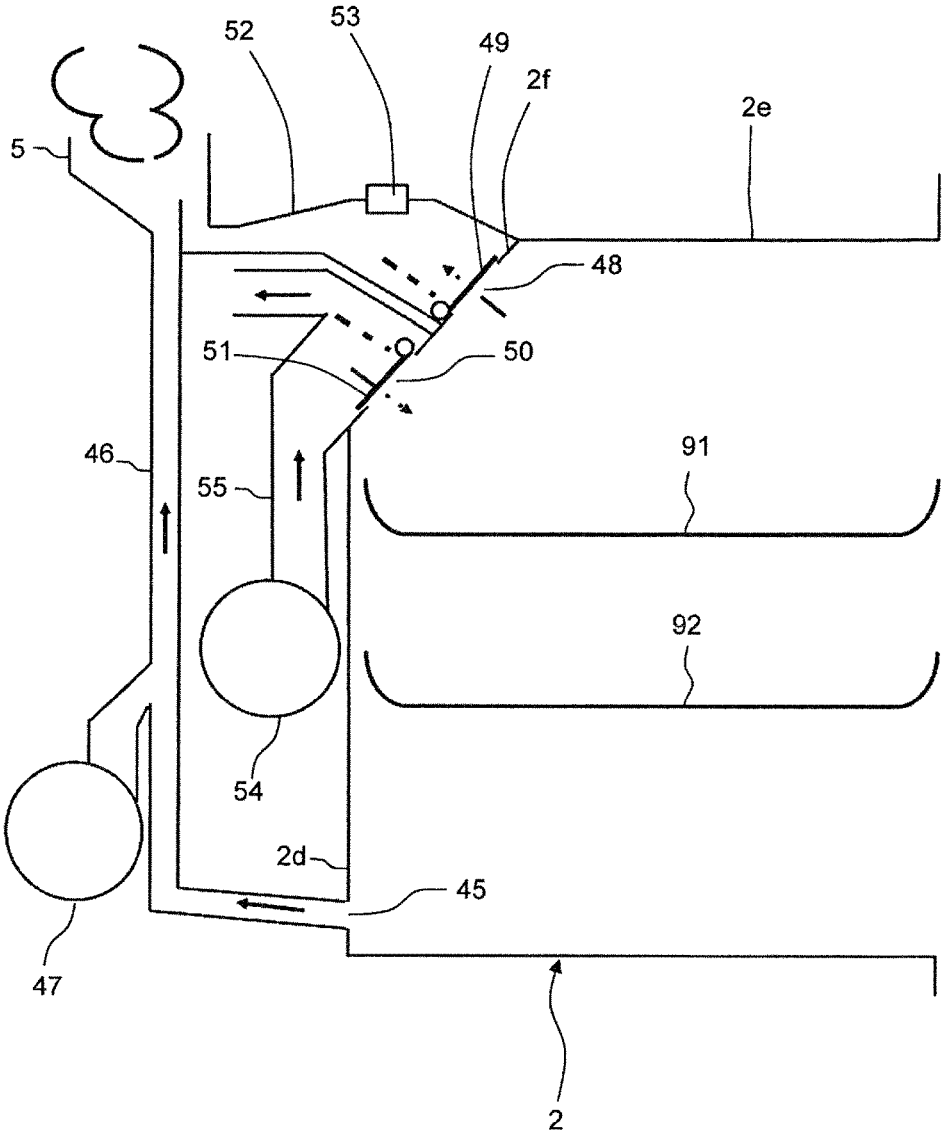
FIG. 4 is a schematic view for explaining a structure of other part of the cooking device of the first embodiment.

FIG. 4 is a schematic view for explaining a structure of other part of the cooking device. Also in FIG. 4, the heating chamber 2 is shown as viewed from the left side as in FIG. 3.

A natural exhaust port 45 is provided at a lower end portion of the rear portion 2*d* of the heating chamber 2. The natural exhaust port 45 is communicated with an exhaust duct 5 via a first exhaust path 46. When air and the like within the heating chamber 2 has come to an excessive level, excess air or the like naturally flows out through the natural exhaust port 45 to the first exhaust path 46. An exhaust fan 47 provided as a multiblade fan as an example is connected to the first exhaust path 46.

A plurality of forced exhaust ports 48 to be opened and closed by an exhaust damper 49 as well as a plurality of air supply ports 50 to be opened and closed by an air supply damper 51 are provided in the sloped portion 2*f* of the heating chamber 2. These forced exhaust ports 48 are communicated with the exhaust duct 5 via a second exhaust path 52. Meanwhile, the air supply ports 50 are communicated with a space between the casing 1 and the heating chamber 2 via an air supply path. An air supply fan 54 provided as a multiblade fan as an example is connected to an air supply path 55. Only one of the forced exhaust ports 48 and one of the air supply ports 50 are depicted exaggeratedly largely in FIG. 4.

A steam sensor 53 is attached on the second exhaust path 52. The steam sensor 53 delivers a signal indicative of a steam level flowing through the second exhaust path 52 to a control unit 100 (shown in FIG. 5).

For forced exhaust of air and the like from within the heating chamber 2 out of the casing 1, the exhaust damper 49 and the air supply damper 51 are pivoted to positions indicated by two-dot chain line by a motor 60 for the exhaust damper (referred to as "exhaust damper motor 60" below) and a motor for the air supply damper (referred to as "air supply damper motor 61" below) (shown in FIG. 5), respectively. That is, the exhaust damper 49 and the air supply damper 51 are opened. Then, the exhaust fan 47 and the air supply fan 54 are driven by a motor 57 for the exhaust fan (referred to as "exhaust fan motor 57" below) and a motor 58 for the air supply fan (referred to as "air supply fan motor 58" below) (shown in FIG. 5). As a result of this, air and the like within the heating chamber 2 are drawn out of the heating chamber 2 through the forced exhaust ports 48 and the natural exhaust port 45.

For cooling of the magnetron 4 or the like between the casing 1 and the heating chamber 2, the air supply fan 54 is driven with the air supply damper 51 closed. As a result of this, air blown off from the air supply fan 54 is supplied to the space between the casing 1 and the heating chamber 2 via the air supply path 55.

Figure 5:
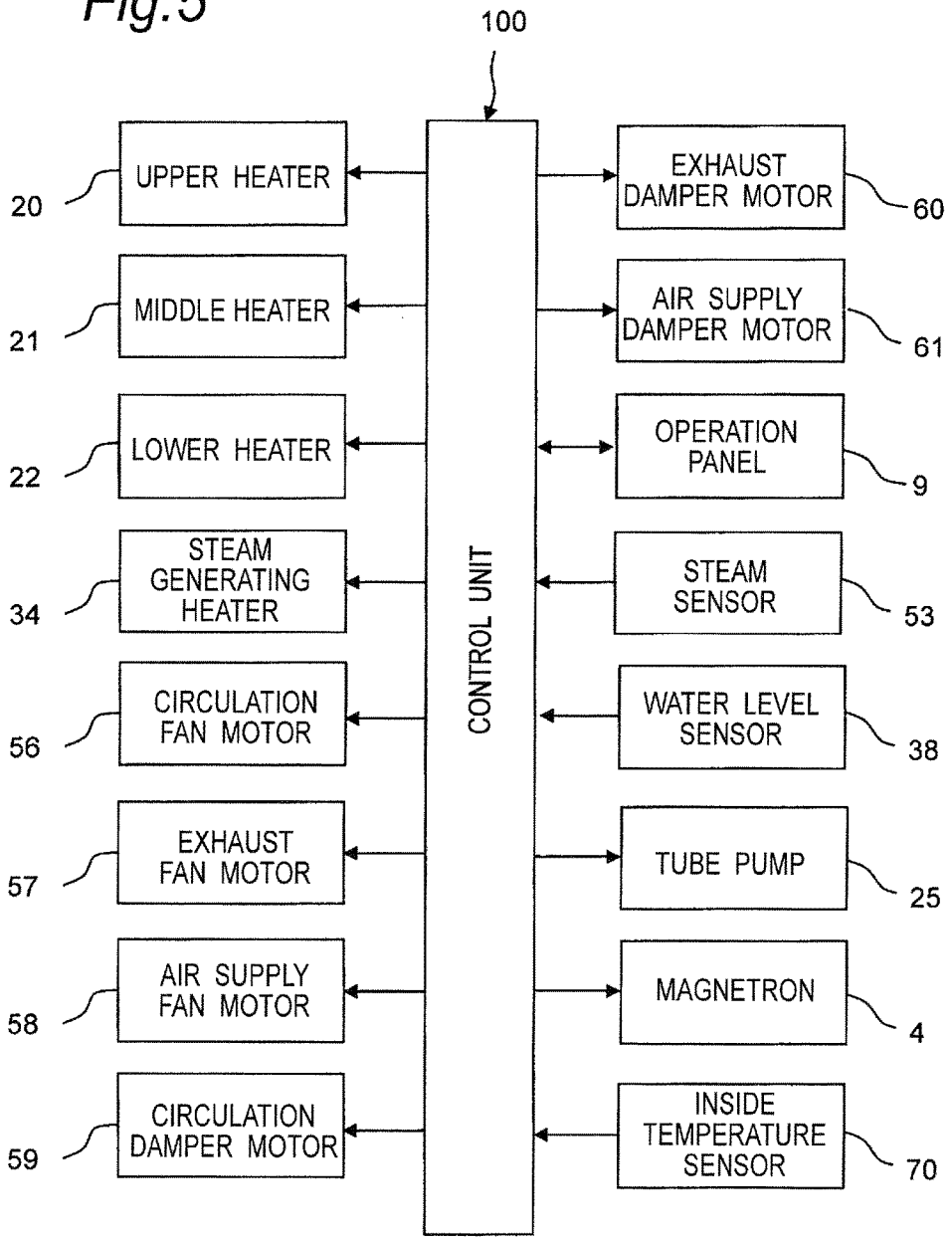
FIG. 5 is a control block diagram of the cooking device of the first embodiment.

FIG. 5 is a control block diagram of the cooking device.

The cooking device includes a control unit 100 composed of a microcomputer, input/output circuits, and the like. Connected to the control unit 100 are the upper heater 20, the middle heater 21, the lower heater 22, the steam-generating heater 34, the circulation fan motor 56, the exhaust fan motor 57, the air supply fan motor 58, the circulation damper motor 59, the exhaust damper motor 60, the air supply damper motor 61, the operation panel 9, the steam sensor 53, the water level sensor 38, the tube pump 25, the magnetron 4, an inside temperature sensor 70, and the like. Based on signals derived from the operation panel 9, the steam sensor 53, the water level sensor 38, the inside temperature sensor 70 and the like, the control unit 100 controls the upper heater 20, the middle heater 21, the lower heater 22, the steam-generating heater 34, the circulation fan motor 56, the exhaust fan motor 57, the air supply fan motor 58, the circulation damper motor 59, the exhaust damper motor 60, the air supply damper motor 61, the tube pump 25, and the like.

The inside temperature sensor 70 detects a temperature inside the heating chamber 2 and delivers a signal indicative of the temperature to the control unit 100.

Figure 6:
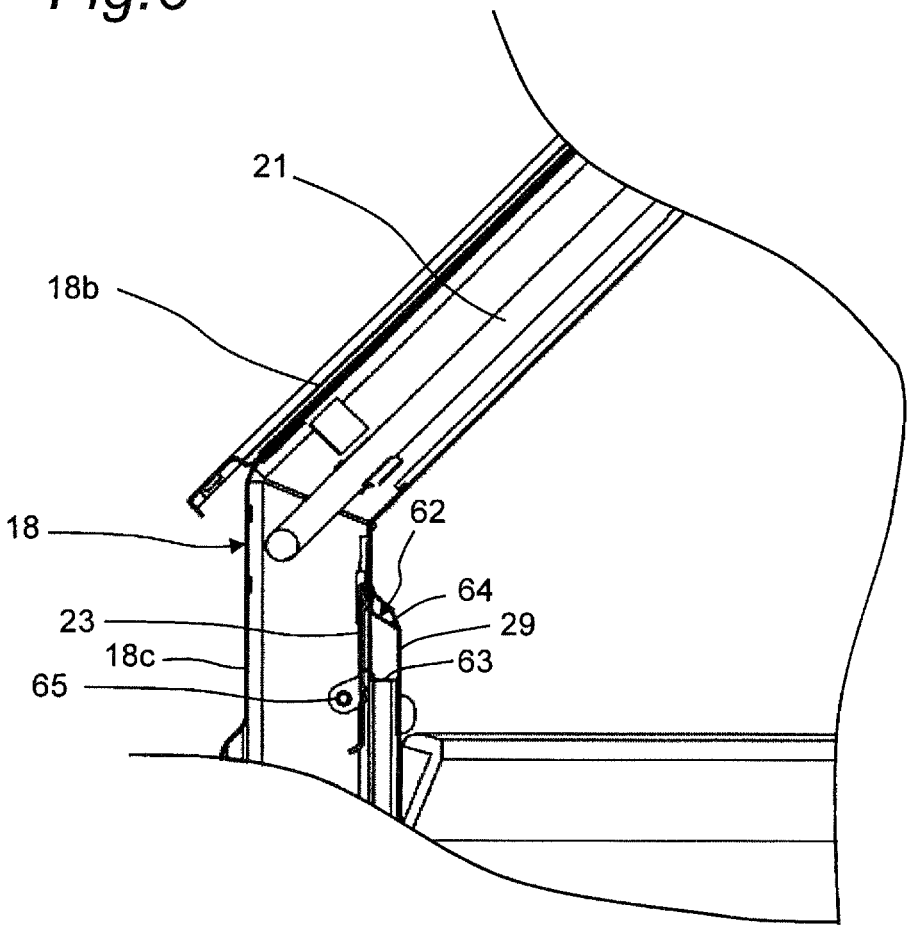
FIG. 6 is a schematic sectional view of a first rear blowoff port and its vicinity.
Figure 7:
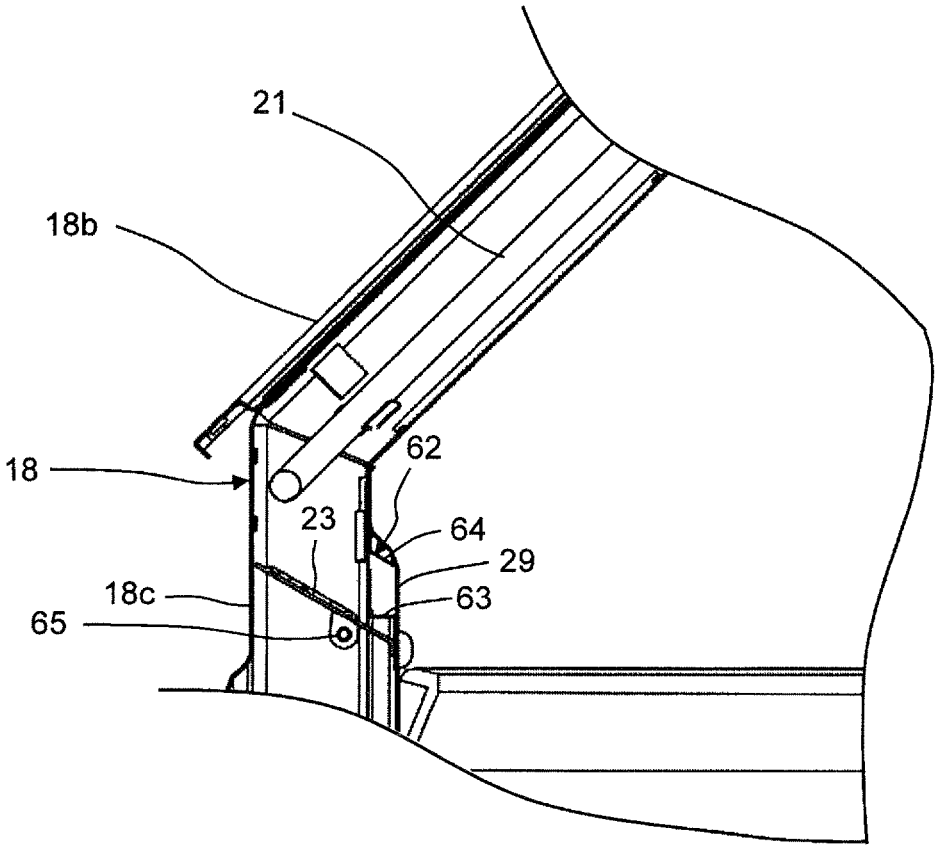
FIG. 7 is a schematic sectional view of the first rear blowoff port and its vicinity in another state.

FIG. 6 is a schematic sectional view of the first rear blowoff port 29 and its vicinity with the circulation damper 23 closed. FIG. 7 is a schematic sectional view of the first rear blowoff port 29 and its vicinity with the circulation damper 23 opened. In FIGS. 6 and 7, the circulation fan 19 and the circulation fan motor 56 are omitted in depiction.

As shown in FIGS. 6 and 7, the cooking device includes a flow regulation structure 62 for regulating flows of air and the like blown off from the first rear blowoff port 29.

The flow regulation structure 62 is provided on the rear side of the first rear blowoff port 29. More specifically, the flow regulation structure 62 has a space provided between the circulation damper 23 and the first rear blowoff port 29 and communicated with the first rear blowoff port 29. The flow regulation structure 62 has on a lower side, a first guide surface 63 extending in a direction generally parallel (including complete parallel) to the horizontal direction, as well as on an upper side, a second guide surface 64 sloped with its front end lower than its rear end. These first and second guide surfaces 63, 64 are for defining the above-described space.

The circulation damper 23 pivots about a pivotal axis provided near the first guide surface 63. With the circulation damper 23 closed as shown in FIG. 6, an upper end portion of the circulation damper 23 comes into close contact with a portion of the flow regulation structure 62 above the second guide surface 64. In this case, the circulation damper 23 has a gap against the first guide surface 63. A lower end portion of the circulation damper 23 is bent. As shown in FIG. 7, when the circulation damper 23 is opened, the lower end portion of the circulation damper 23 comes into close contact with an outer surface of the rear portion 2*d* of the heating chamber 2. Meanwhile, the upper end portion of the circulation damper 23 comes into close contact with an inner surface of the circulation duct 18. Thus, as the circulation damper 23 is opened, the circulation damper 23 is inclined with its front end lower than its rear end. In addition, the gap may be set so as to have a front-rear length of 2 mm as an example.

Figure 8:
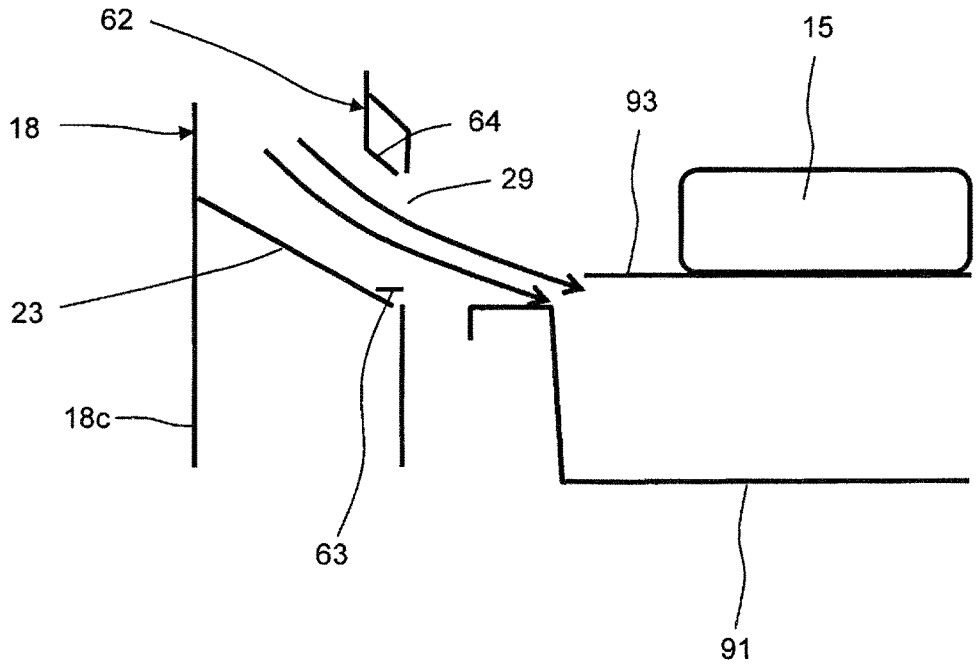
FIG. 8 is a schematic view for explaining working effects of the cooking device of the first embodiment.

With the cooking device having the above-described constitution, the circulation damper 23 is pivoted by the circulation damper motor 59 so that the first rear blowoff port 29 is opened as shown in FIG. 8. Then, the upper heater 20 and the middle heater 21 are turned ON and the circulation fan 19 is driven by the circulation fan motor 56, by which air and the like are blown off from the upper blowoff ports 28 and the first rear blowoff ports 29. In this process, since the first guide surface 63 under the flow regulation structure 62 extends in a direction generically parallel to the horizontal direction, air and the like passing through the gap between the rear portion 2*d* of the heating chamber 2 and the cooking tray 91 out of the air and the like blown off from the first rear blowoff ports 29 can be reduced. As a result, as shown by arrow in FIG. 8, air and the like flowing along the upper side of the cooking tray 91 can be increased. Thus, the heating object 15 on the cooking tray 91 can be heated with high efficiency.

Figure 9:
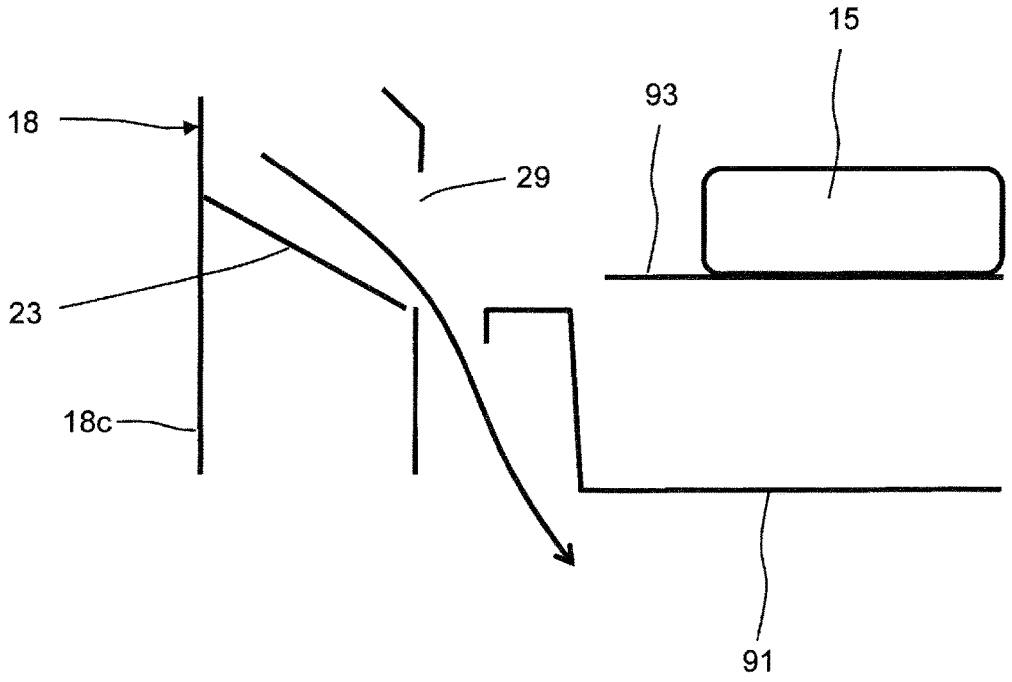
FIG. 9 is a schematic view for explaining working effects of a cooking device which is a comparative example.

In contrast to this, without the flow regulation structure 62, it would result that air and the like passing through the gap between the rear portion 2*d* of the heating chamber 2 and the cooking tray 91 occupies an increased ratio out of the air and the like blown off from the first rear blowoff ports 29 as indicated by arrow in FIG. 9. In such a case, air and the like passing along the upper side of the cooking tray 91 are reduced, making it impossible to efficiently heat the heating object 15 on the cooking tray 91.

In a case where the heating object 15 is set on the cooking tray 91 via a cooking grid 93 the body fat measurement unit 93, air and the like flowing along the upper side of the cooking tray 91 can be increased. Thus, the back face of the heating object 15 can be baked with high efficiency.

With the cooking tray 91 set within the heating chamber 2, there arises a gap between the cooking tray 91 and the rear portion 2*d* of the heating chamber 2. Therefore, even though microwaves are mis-supplied into the heating chamber 2 with the cooking tray 91 set in the heating chamber 2, electrical discharge less likely occurs in the heating chamber 2.

Since the upper-side second guide surface 64 of the flow regulation structure 62 is sloped with its front end lower than its rear end, air and the like flowing along the upper side of the cooking tray 91 can be further increased.

With the second guide surface 64 made to extend in a direction generally parallel to the horizontal direction, air and the like flowing obliquely upward from the first rear blowoff ports 29 would increase out of the air and the like blown off from the first rear blowoff ports 29.

Therefore, the upper-side second guide surface 64 of the flow regulation structure 62, by virtue of its sloping structure with the front end lower than the rear end, largely contributes to an effect for efficient grilling for the bottom surface of the heating object 15.

In the opened state, the circulation damper 23 is sloped with its front end lower than its rear end. Therefore, air and the like from above are allowed to smoothly flow to the first rear blowoff ports 29.

The flow regulation structure 62, being provided on the rear side of the first rear blowoff ports 29, is less likely to be contaminated with, for example, oil or the like derived from the heating object 15.

In the above-described first embodiment, the upper-side second guide surface 64 of the flow regulation structure 62 is sloped so as to have its front end lower than its rear end. Instead, the second guide surface 64 may extend in a direction generally parallel (including complete parallel) to the horizontal direction as an example.

In the first embodiment, the circulation damper 23 arranged to open and close the first rear blowoff ports 29 is provided in the circulation duct 18. Instead, the circulation damper 23 may be non-provided.

in the first embodiment, the circulation duct 18 provided so as to range from the upper side to the rear side of the heating chamber 2 is used. Instead, a circulation duct provided only on the rear side as an example may be used.

In the first embodiment, the flow regulation structure 62 is provided in the circulation duct 18. However, the flow regulation structure 62 may be provided in a duct other than the circulation duct 18 only if the duct guides the heat medium from above to below.

In the first embodiment, for heating of the heating object 15 with the circulation damper 23 opened, the heating object 15 may be set on the cooking tray 91 with the cooking grid 93 interposed therebetween as shown in FIG. 8, or the heating object 15 may be set directly on the cooking tray 91. That is, the cooking tray 91 may have the heating object 15 set thereon either out of contact or in contact with the heating object 15.

The cooking device described in JP 2004-333109 A includes a heating chamber, a plurality of suction ports provided in central part of the rear portion of the heating chamber, and a plurality of blowoff ports provided in the rear portion of the heating chamber so as to surround the suction ports. A circulation fan, which is a centrifugal fan, is placed on the rear side of the suction ports. Air blown off radially outward by the circulation fan is heated by an annular heater surrounding the circulation fan and then blown off from the blowoff ports.

With the above-described cooking device, however, since air flows of generally equal temperature are blown off from the individual blowoff ports, it is impossible to concentratedly heat the heating object placed at a partial space inside the heating chamber. That is, the cooking device has a problem of incapability of performing heating on a spot basis.

Accordingly, an object of the invention is to provide cooking devices capable of performing spot-basis heating.

Hereinbelow, cooking devices for solving the above problem will be described.

(Second Embodiment)

Figure 10:
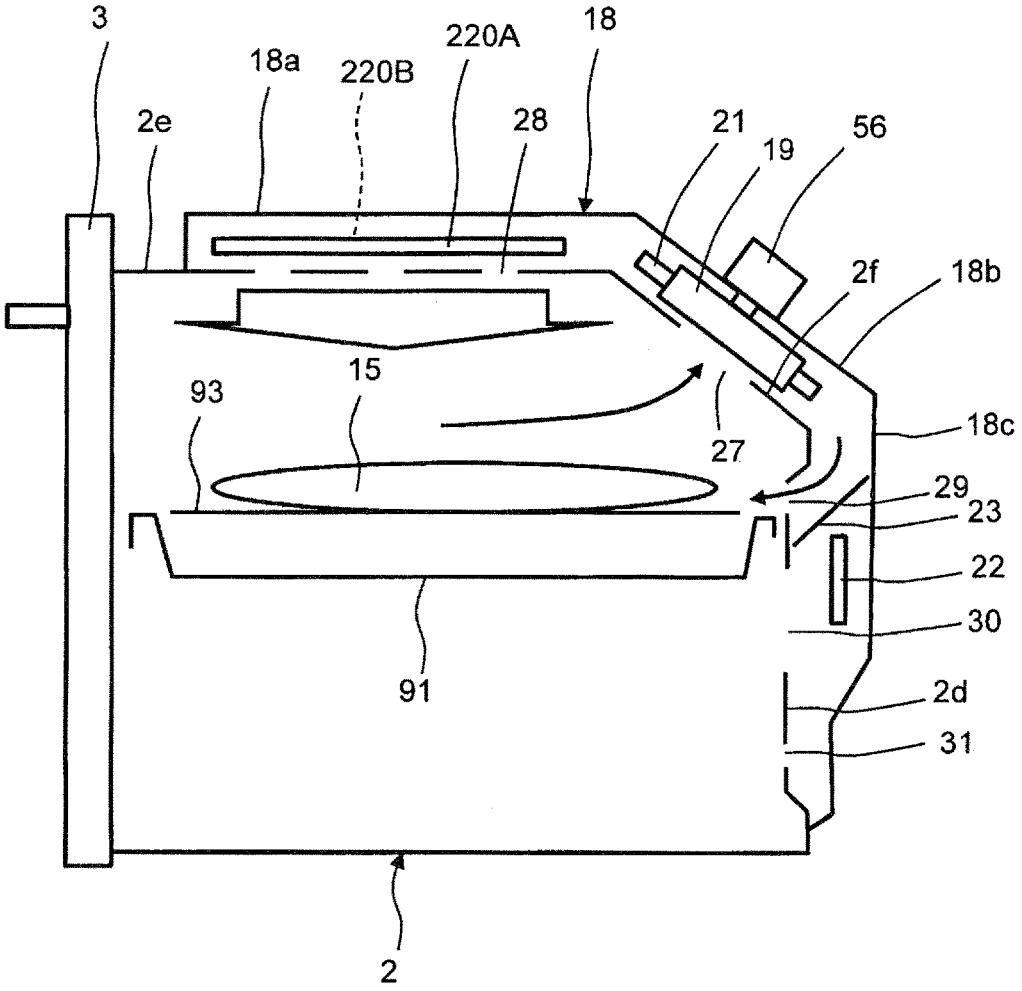
FIG. 10 is a schematic sectional view of a cooking device according to a second embodiment of the invention.

FIG. 10 is a schematic sectional view of a cooking device according to a second embodiment of the invention. In FIG. 10, the heating chamber 2 is shown as viewed from the right side. Also in FIG. 10, the same component members as those of the cooking device of the first embodiment are designated by the same reference signs as those of the cooking device of the first embodiment. In the following description also, the same component members as those of the first embodiment are designated by the same reference signs as those of the first embodiment.

The cooking device differs from that of the first embodiment in that first and second upper heaters 220A, 220B are placed in the front portion 18*a* of the circulation duct 18, and that an upper partition 271 (shown in FIG. 11) in the front portion 18*a* of the circulation duct 18. The circulation duct 18 is an example of the duct. The front portion 18*a* of the circulation duct 18 is an example of the upper portion of the duct. The connecting portions 18*b*, 18*c* of the circulation duct 18 are an example of the downward extending portion of the duct. The circulation fan 19 is an example of the centrifugal fan. The first upper heater 220A is an example of the first heater. The second upper heater 220B is an example of the second heater. The upper partition 271 is an example of the first partition.

Figure 11:
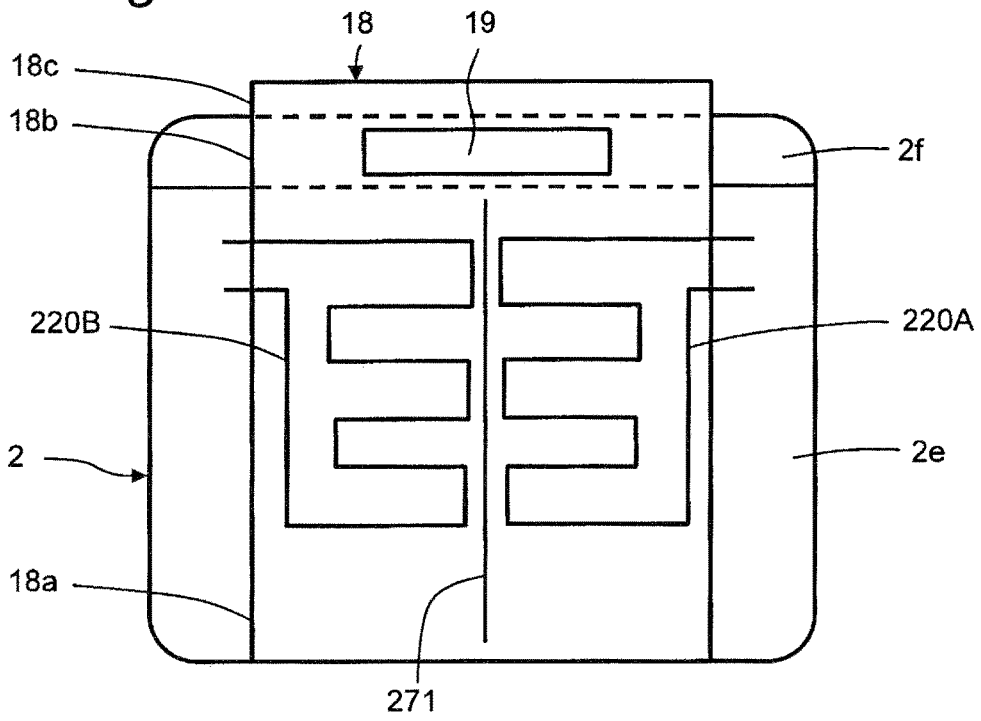
FIG. 11 is a schematic top view of a main part of the cooking device of the second embodiment.

FIG. 11 is a schematic view of a main part of the cooking device as viewed from above. In FIG. 11, part of the circulation duct 18 and the like are omitted in depiction for an easy understanding of the structure.

The first upper heater 220A is provided in the form of a sheath heater as an example and placed on a right lateral side within the front portion 18*a* of the circulation duct 18. Air, saturated steam and the like (hereinafter, referred to as 'air and the like') heated by the first upper heater 220A are blown off into the heating chamber 2 from upper blowoff ports 28 facing the space over which the first upper heater 220A is placed (hereinafter, referred to as 'right-side upper blowoff ports 28') out of the plurality of upper blowoff ports 28. In addition, the right lateral side is an example of the one side. The right-side upper blowoff ports 28 are an example of the first upper blowoff ports as well as an example of the first blowoff ports.

The second upper heater 220B is provided in the form of a sheath heater as an example and placed on a left lateral side within the front portion 18*a* of the circulation duct 18. Air and the like heated by the second upper heater 220B are blown off into the heating chamber 2 from upper blowoff ports 28 facing the space over which the second upper heater 220B is placed (hereinafter, referred to as 'left-side upper blowoff ports 28') out of the plurality of upper blowoff ports 28. In addition, the left lateral side is an example of the opposite side. The left-side upper blowoff ports 28 are an example of the second upper blowoff ports as well as an example of the second blowoff ports.

The upper partition 271 is a partition between the right lateral side within the front portion 18*a* of the circulation duct 18 and the left lateral side within the front portion 18*a* of the circulation duct 18. That is, the upper partition 271 is provided between the first upper heater 220A and the second upper heater 220B.

Figure 12:
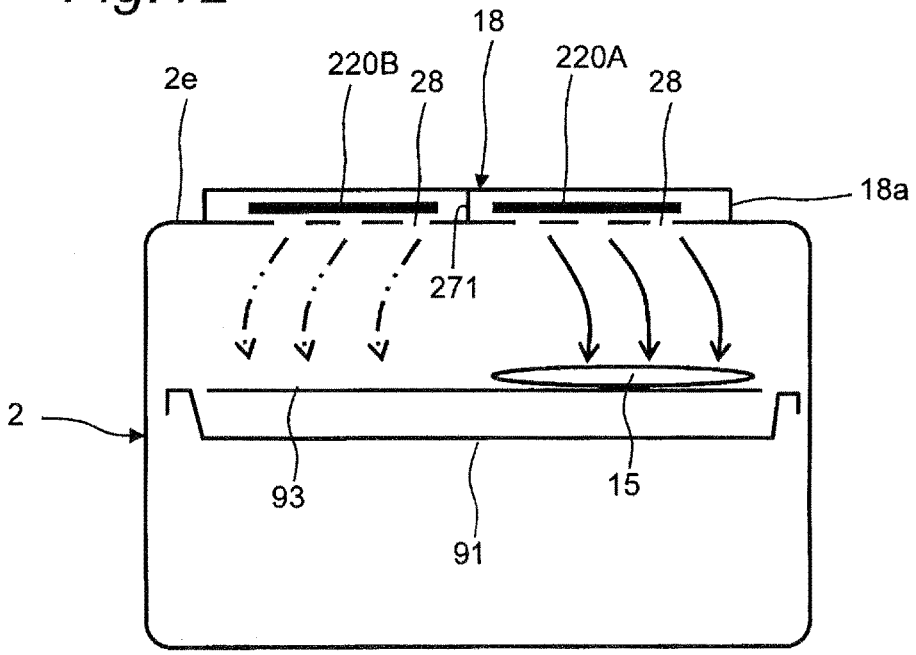
FIG. 12 is a schematic view for explaining working effects of the cooking device of the second embodiment.

According to the cooking device having the above-described constitution, as shown in FIG. 10, the circulation fan 19 sucks air and the like in the heating chamber 2 through the suction ports 27 and feeds the air and the like into the front portion 18*a* of the circulation duct 18. In this process, with the circulation fan 19 turned rightward as viewed from the circulation fan motor 56 side, as shown in FIG. 12, the quantity of air and the like flowing to the first upper heater 220A becomes larger than the quantity of air and the like flowing to the second upper heater 220B. Therefore, turning ON the first upper heater 220A and moreover turning OFF the second upper heater 220B causes a large amount of air and the like heated by the first upper heater 220A to be blown off from the right-side upper blowoff ports 28 as indicated by solid-line arrows in FIG. 12. As a result, spot-basis heating can be fulfilled on the lower side of the right-side upper blowoff ports 28.

Since large quantities of air and the like heated by the first upper heater 220A are blown off from the right-side upper blowoff ports 28, the heating object on one lower side of the upper blowoff ports 28 can be heated even if the space on the other lower side of the upper blowoff ports 28 is not warmed. Therefore, since the time that would otherwise be needed to warm the space on the lower side of the left-side upper blowoff ports 28 can be saved, the heating of the heating object 15 on the lower side of the right-side upper blowoff ports 28 can be completed in short time.

Since large quantities of air and the like heated by the first upper heater 220A are blown off from the right-side upper blowoff ports 28, the upper surface of the heating object 15 on the lower side of the right-side upper blowoff ports 28 can be heated uniformly.

While the circulation fan 19 is turned leftward as viewed from the circulation fan motor 56 side, the first upper heater 220A is turned OFF and moreover the second upper heater 220B is turned ON. Then, as indicated by two-dot-chain-line arrows in FIG. 12, large quantities of air and the like heated by the second upper heater 220B are blown off from the left-side upper blowoff ports 28. Therefore, spot-basis heating can be fulfilled also on the lower side of the left-side upper blowoff ports 28.

Since the left lateral side within the front portion 18*a* of the circulation duct 18 and the right lateral side within the front portion 18*a* of the circulation duct 18 are partitioned by the first upper partition 271, the quantity of air and the like flowing to one of the first and second upper heaters 220A, 220B can securely be made larger in comparison to air and the like flowing to the other of the first and second upper heaters 220A, 220B.

In the second embodiment, the circulation duct 18 is composed of the front portion 18*a* in which the first and second upper heaters 220A, 220B are internally placed, the connecting portion 18*b* that extends obliquely downward from the rear end of the front portion 18*a*, and the rear portion 18*c* that extends directly downward from the lower end of the connecting portion 18*b*. Instead, the circulation duct 18 may be composed of a front portion in which the first and second upper heaters 220A, 220B are internally placed, and a rear portion which extends directly downward from a rear end of the front portion.

In the second embodiment, the circulation duct 18 is provided so as to range from the upper side to the rear side of the heating chamber 2. Instead, the circulation duct 18 may be provided so as to range from the upper side to the right lateral side or the left lateral side of the heating chamber 2.

In the second embodiment, the first upper partition 271 is provided in the front portion 18*a* of the circulation duct 18. Instead, the first upper partition 271 may be non-provided.

In the second embodiment, the circulation fan 19 may be provided, for example, as a multiblade fan or a turbofan. In such a case, the multiblade fan or the turbofan may have a plurality of blades provided along its peripheral edge portion, each of the blades being generally parallel (including complete parallel) to the radial direction. With each blade generally parallel to the radial direction, it is achievable to reduce the difference between the quantity of air and the like fed to the first upper heater 220A under clockwise rotation of the multiblade fan or turbofan and the quantity of air and the like fed to the second upper heater 220B under counterclockwise rotation of the multiblade fan or turbofan.

Figure 13:
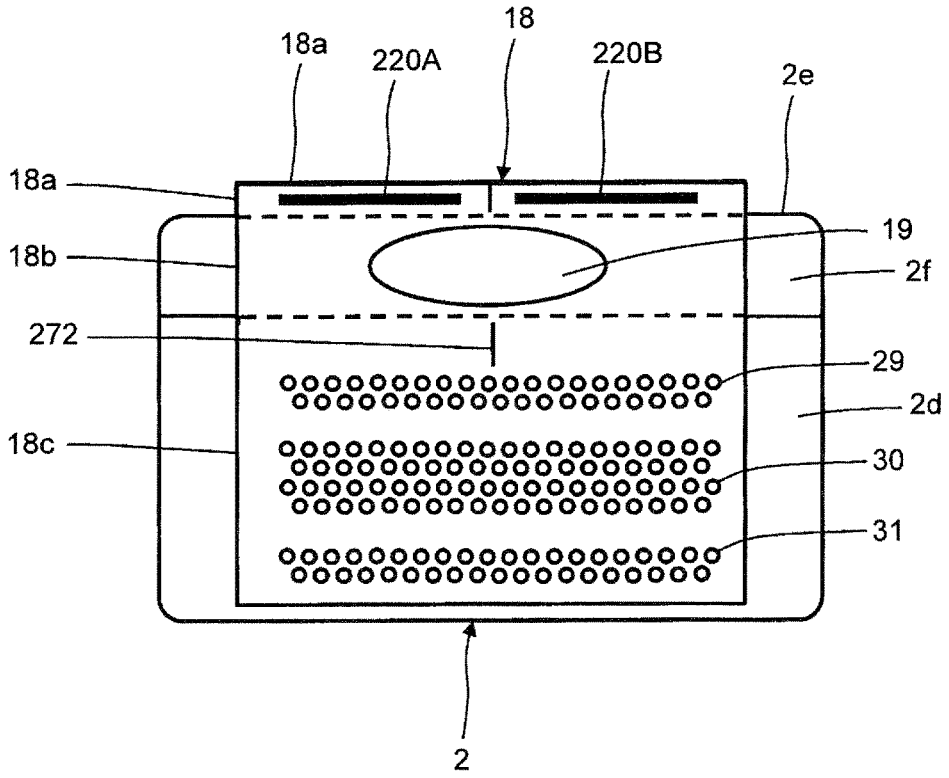
FIG. 13 is a schematic rear view of a main part of a modification of the cooking device according to the second embodiment.

In the second embodiment, such a partition as the upper partition 271 is not provided in the connecting portion 18*b* and the rear portion 18*c* of the circulation duct 18. Instead, as shown in FIG. 13, a rear partition 272 may be provided. The rear partition 272 is a partition between a left lateral side within the rear portion 18*c* of the circulation duct 18 and a right lateral side within the rear portion 18*c* of the circulation duct 18. In such a case as shown in FIG. 13, the rear partition 272 is an example of the second partition. The middle heater 21 is an example of the third heater (shown in FIG. 10).

With the rear partition 272 provided, first rear blowoff ports 29 facing the space of the right lateral side within the rear portion 18*c* of the circulation duct 18 (hereinafter, referred to as right-side first rear blowoff ports 29) out of the plurality of first rear blowoff ports 29 blow air and the like derived from the right lateral side within the rear portion 18*c* of the circulation duct 18 into the heating chamber 2. The right-side first rear blowoff ports 29 are an example of the third blowoff ports.

With the rear partition 272 provided, first rear blowoff ports 29 facing the space of the left lateral side within the rear portion 18*c* of the circulation duct 18 (hereinafter, referred to as left-side first rear blowoff ports 29) out of the plurality of first rear blowoff ports 29 blow air and the like derived from the left lateral side within the rear portion 18*c* of the circulation duct 18 into the heating chamber 2. The left-side first rear blowoff ports 29 are an example of the fourth blowoff ports.

As described above, by virtue of the rear partition 272 serving as a partition between the left lateral side within the rear portion 18*c* of the circulation duct 18 and the right lateral side within the rear portion 18*c* of the circulation duct 18, the quantity of air and the like flowing through one of the left lateral side and the right lateral side can securely be made larger than the quantity of air and the like flowing through the other of the left lateral side and the right lateral side. In this case, with the circulation fan 19 rotated clockwise as viewed from the circulation fan motor 56 side, the quantity of air and the like flowing through the left lateral side can be made larger in comparison to the quantity of air and the like flowing through the right lateral side. Therefore, in that case, turning ON the middle heater 21 causes large quantities of air and the like heated by the middle heater 21 to be blown off from the left-side first rear blowoff ports 29. As a result, the heating object 15 on the front side of the left-side first rear blowoff ports 29 can be heated effectively.

With the heating object 15 set on the cooking tray 91 via the cooking grid 93, since the left-side first rear blowoff ports 29 are positioned near the rear portion of the cooking tray 91, air and the like derived from the left-side first rear blowoff ports 29 are allowed to flow along between the heating object 15 and the cooking tray 91. Therefore, the lower surface of the heating object 15 on the front side of the left-side first rear blowoff ports 29 can be heated uniformly.

With the circulation fan 19 rotated counterclockwise as viewed from the circulation fan motor 56 side, the quantity of air and the like flowing through the right lateral side can securely be made larger in comparison to the quantity of air and the like flowing through the left lateral side. Therefore, in that case, turning ON the middle heater 21 causes large quantities of air and the like heated by the middle heater 21 to be blown off from the right-side first rear blowoff ports 29. As a result, the heating object 15 on the front side of the right-side first rear blowoff ports 29 can be heated effectively, and moreover the lower surface of the heating object 15 can be heated uniformly.

In FIG. 13, part of the circulation duct 18 and the like are omitted in depiction for an easy understanding of the structure, as in FIG. 11.

By contrast, the cooking device disclosed in JP 2004-333109 A includes a heating chamber, a plurality of suction ports provided in a central part of a rear portion of the heating chamber, and a plurality of blowoff ports provided in the rear portion of the heating chamber so as to surround the suction ports. A circulation fan provided as a centrifugal fan is placed on the rear side of the suction ports. Air blown off radially outward by the circulation fan is heated by the annular heater surrounding the circulation fan, and then blown off from the individual blowoff ports.

In this cooking device, the heating chamber is partitioned into an upper space and a lower space by putting a cooking tray into the heating chamber, so that heating objects can be heated in the upper space and the lower space, respectively. That is, a so-called two-stage cooking is enabled.

However, with the cooking device, for execution of the two-stage cooking, air heated by the heater is fed to the upper space and the lower space. For this reason, there is an issue that different kinds of cooking cannot be performed in the upper space and the lower space, respectively.

For example, the cooking device cannot perform steam cooking with use of the lower space while performing grill cooking with use of the upper space.

Consequently, an object of the invention is to provide cooking devices capable of performing different kinds of cooking in the upper space and the lower space, respectively.

Hereinbelow, cooking devices for solving the above issues will be described.

(Third Embodiment)

Figure 14:
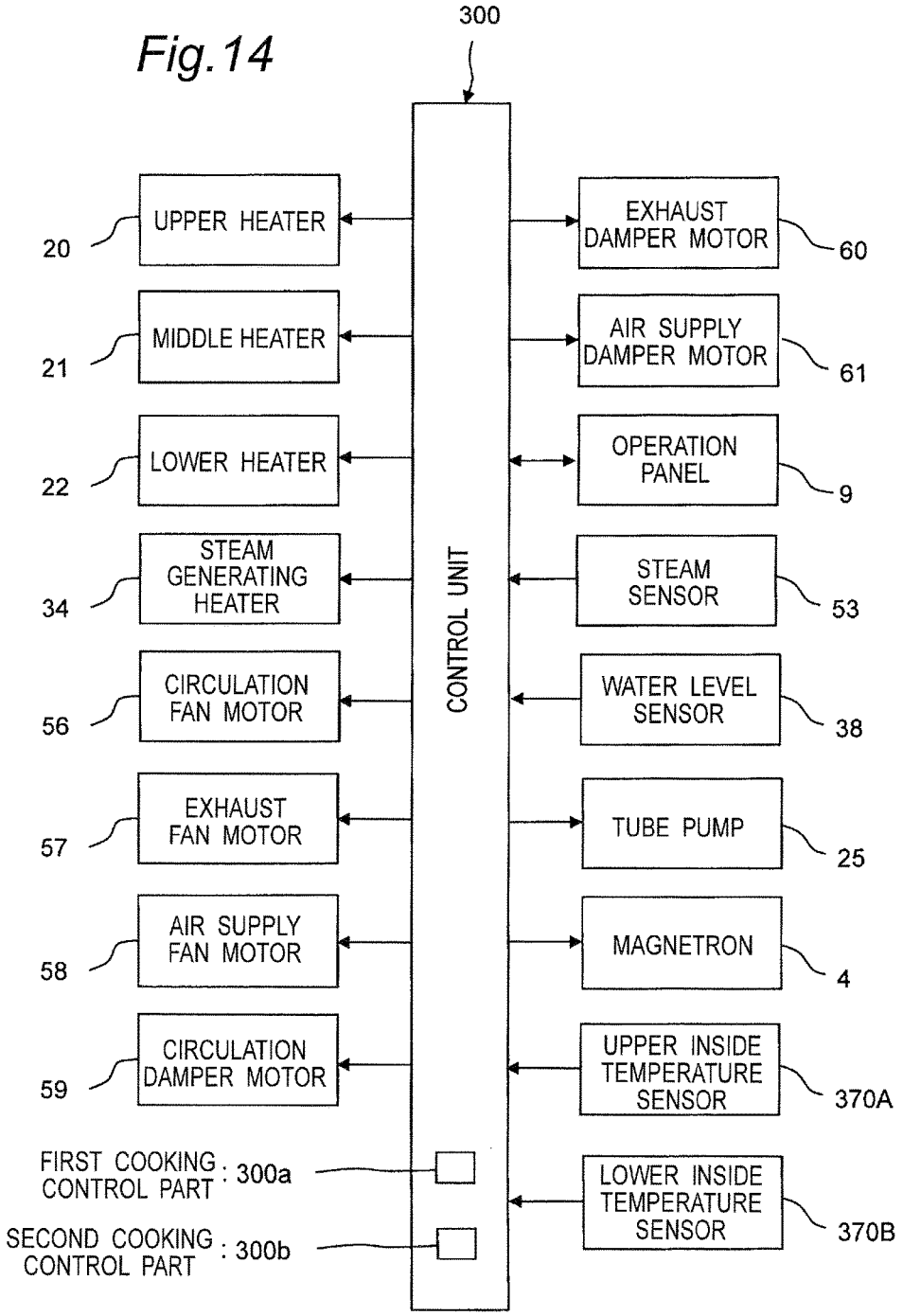
FIG. 14 is a control block diagram of a cooking device according to a third embodiment of the invention.

FIG. 14 is a control block diagram of a cooking device according to a third embodiment of the invention. In FIG. 14, the same component members as those of the cooking device of the first embodiment are designated by the same reference signs as those of the cooking device of the first embodiment. Also in the following description, the same component members as those of the cooking device of the first embodiment are designated by the same reference signs as those of the cooking device of the first embodiment.

The cooking device includes a control unit 300 so as to be capable of performing so-called dual cooking, that is, cooking at upper and lower zones independently of each other. The control unit 300, like the control unit 100 of the first embodiment, is composed of a microcomputer, input/output circuits, and the like. Connected to the control unit 300 are an upper heater 20, a middle heater 21, a lower heater 22, a steam-generating heater 34, a circulation fan motor 56, an exhaust fan motor 57, an air supply fan motor 58, a circulation damper motor 59, an exhaust damper motor 60, an air supply damper motor 61, an operation panel 9, a steam sensor 53, a water level sensor 38, a tube pump 25, a magnetron 4, an upper inside temperature sensor 370A, a lower inside temperature sensor 370B, and the like. Based on signals derived from the operation panel 9, the steam sensor 53, the water level sensor 38, the upper inside temperature sensor 370A, the lower inside temperature sensor 370B, and the like, the control unit 300 controls the upper heater 20, the middle heater 21, the lower heater 22, the steam-generating heater 34, the circulation fan motor 56, the exhaust fan motor 57, the air supply fan motor 58, the circulation damper motor 59, the exhaust damper motor 60, the air supply damper motor 61, the tube pump 25, and the like. The middle heater 21 is an example of the heater. The circulation fan 19 is an example of the fan. The second and third rear blowoff ports 30, 31 are an example of the second rear blowoff ports as well as an example of the lower blowoff ports.

The upper inside temperature sensor 370A detects a temperature of an upper space 373A (shown in FIGS. 16 and 17) in the heating chamber 2 and transmits a signal indicative of the temperature to the control unit 300.

The lower inside temperature sensor 370B detects a temperature of a lower space 373B (shown in FIGS. 16 and 17) in the heating chamber 2 and transmits a signal indicative of the temperature to the control unit 300.

The control unit 300 has first and second cooking control parts 300*a*, 300*b* for the dual cooking. These first and second cooking control parts 300*a*, 300*b* are implemented each by software.

The first cooking control part 300*a* controls the circulation damper 23, the circulation fan 19 and the saturated steam generator 24 in such fashion that with gaps between the circulation fan 19 and the second and third rear blowoff ports 30, 31 opened, the circulation fan 19 feeds saturated steam in the circulation duct 18 to the second and third rear blowoff ports 30, 31. As a result, the cooking device is enabled to perform steam cooking in the lower space 373B of the heating chamber 2.

The second cooking control part 300*b* controls the circulation damper 23, the circulation fan 19, the upper heater 20 and the middle heater 21 in such fashion that with gaps between the circulation fan 19 and the second and third rear blowoff ports 30, 31 closed, the circulation fan 19 feeds air and the like in the circulation duct 18 to the upper heater 20. As a result, the cooking device is enabled to perform grill cooking in the upper space 373A of the heating chamber 2.

Figure 15:
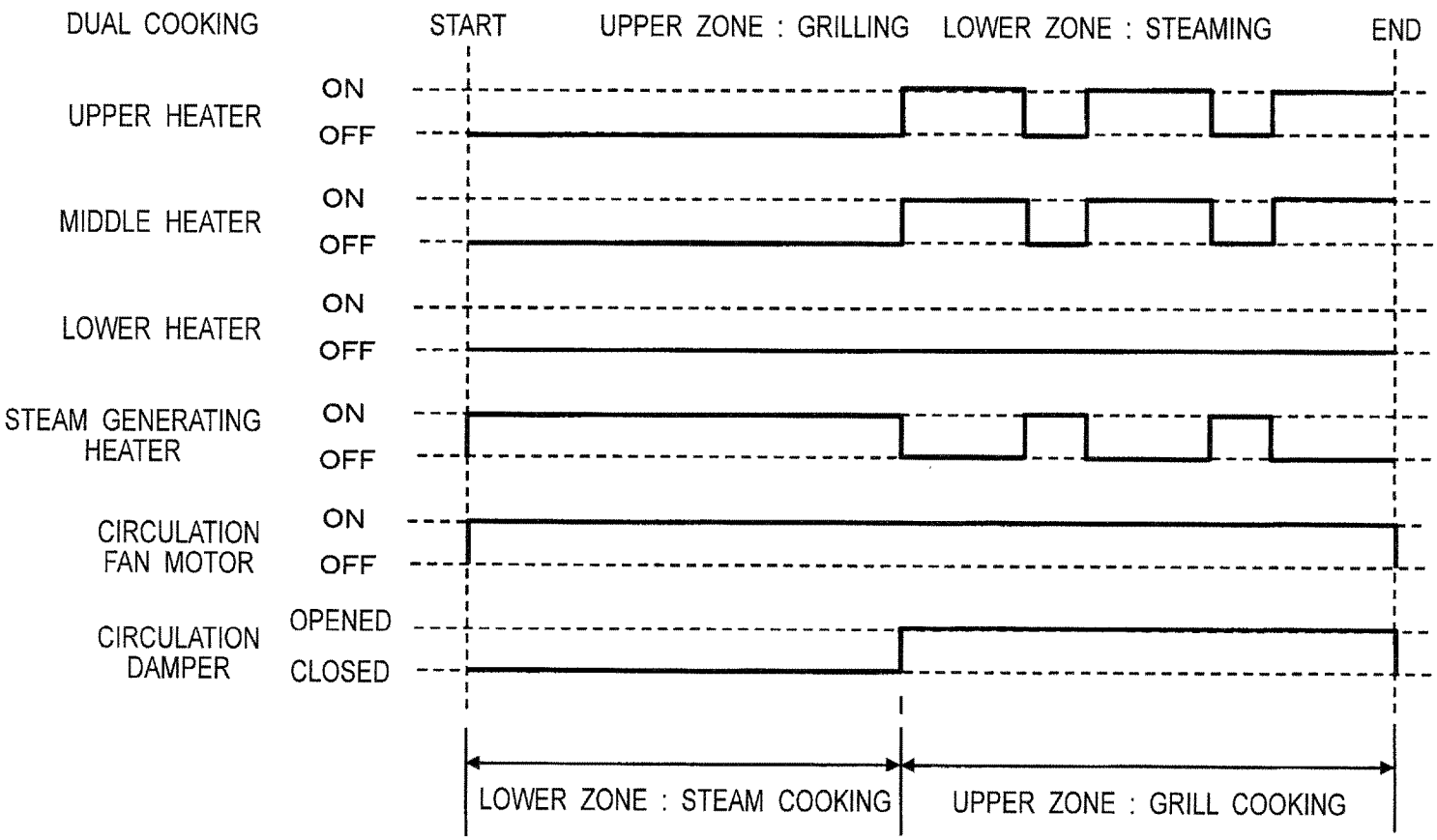
FIG. 15 is a time chart for explaining operations of the cooking device of the third embodiment.

FIG. 15 is a time chart for explaining operations in processing of steam cooking and grill cooking by the cooking device.

The cooking device performs steam cooking in the lower space 373B of the heating chamber 2, and thereafter performs grill cooking in the upper space 373A of the heating chamber 2. That is, dual cooking made up of steam cooking and grill cooking is carried out in the cooking device.

During the steam cooking, while the upper heater 20, the middle heater 21 and the lower heater 22 are kept off continuously, the steam-generating heater 34 and the circulation fan motor 56 are turned ON continuously. The circulation damper closes the first rear blowoff ports 29 during the steam cooking. As a result, the gaps between the circulation fan 19 and the second and third rear blowoff ports 30, 31 are kept in an opened state.

On the other hand, during the grill cooking, the lower heater 22 is kept off continuously while the upper heater 20, the middle heater 21 and the steam-generating heater 34 are intermittently turned ON and moreover while the circulation fan motor 56 is intermittently turned ON. The circulation damper 23 opens the first rear blowoff ports 29 during the grill cooking. As a result, the gaps between the circulation fan 19 and the second and third rear blowoff ports 30, 31 are kept in a closed state.

During the grill cooking, steam supplied from the steam-generating heater 34 into the circulation duct 18 is heated by the upper heater 20 and the middle heater 21, resulting in superheated steam that circulates in the upper space 373A.

During the grill cooking, the upper heater 20 and the middle heater 21 are turned ON and OFF based on temperatures detected by the upper inside temperature sensor 370A so that the temperature of the lower space 373B is kept from going over 100° C.

Figure 16:
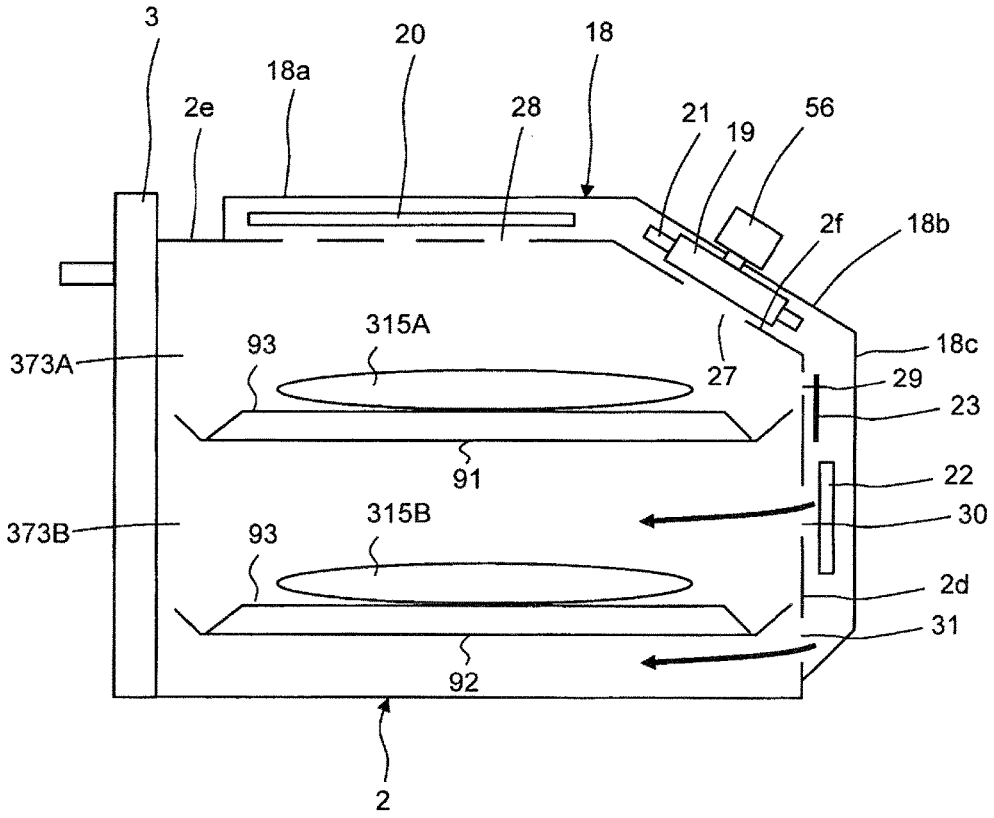
FIG. 16 is a schematic sectional view of the cooking device of the third embodiment during steam cooking.
Figure 17:
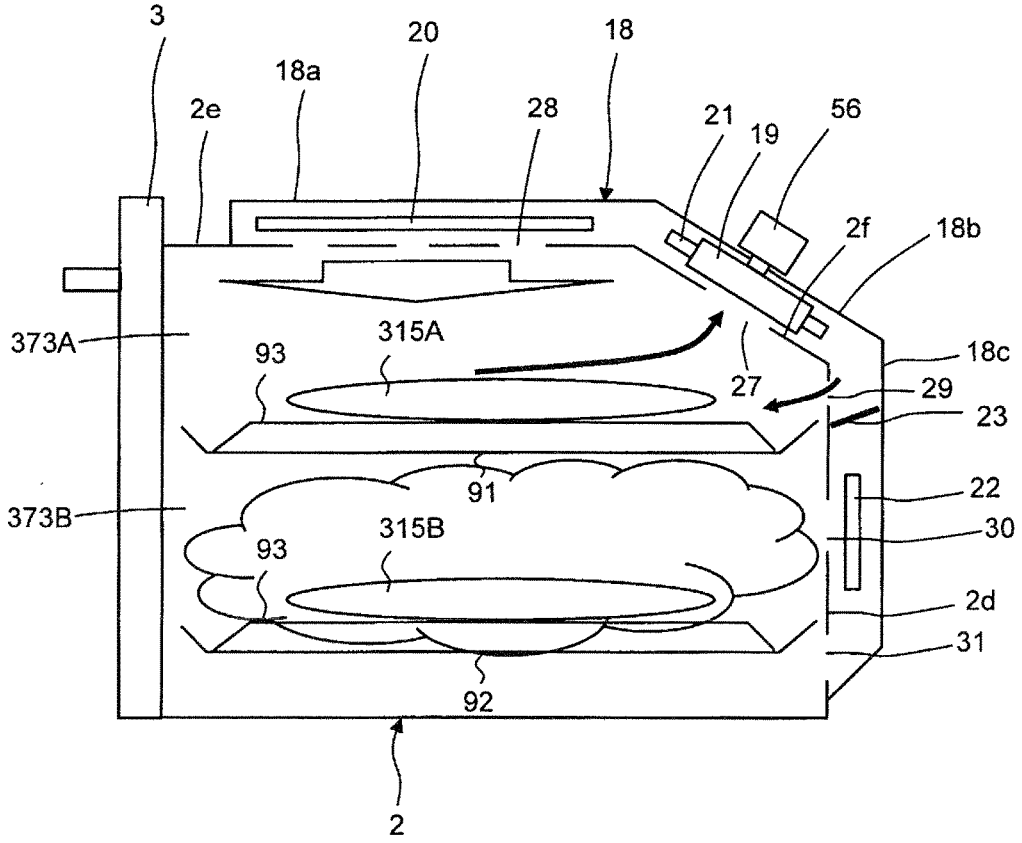
FIG. 17 is a schematic sectional view of the cooking device of the third embodiment during grill cooking.

When the cooking device having the above-described constitution performs dual cooking, the cooking tray 91 on which a heating object 315A to be steamed is mounted with the cooking grid 93 interposed therebetween is first accommodated in the heating chamber 2 as shown in FIGS. 16 and 17. In this case, the cooking tray 91 partitions the heating chamber 2 into the upper space 373A and the lower space 373B. The cooking tray 92 on which a heating object 315B to be grilled is mounted with a cooking grid 94 interposed therebetween is accommodated so as to be positioned under the cooking tray 91.

Next, a specified operation is performed on the color LCD part 10 and the start key 13 is pressed, then the dual cooking being started. Subsequently, control processes by the first and second cooking control parts 300*a*, 300*b* are performed in succession.

More specifically, the first cooking control part 300*a* controls the circulation damper 23, the circulation fan 19, the saturated steam generator 24 and the like in such fashion that with the gaps between the circulation fan 19 and the second and third rear blowoff ports 30, 31 opened, saturated steam supplied from the saturated steam generator 24 into the circulation duct 18 is fed by the circulation fan 19 directly to the second and third rear blowoff ports 30, 31. As a result, such air streams as shown by arrows in FIG. 16 are generated, allowing saturated steam to be supplied to the lower space 373B under the cooking tray 91 via the second and third rear blowoff ports 30, 31. Thus, the cooking device is enabled to perform steam cooking in the lower space 373B to steam the heating object 315B.

The second cooking control part 300*b* controls the circulation damper 23, the circulation fan 19, the upper heater 20, the middle heater 21 and the like in such fashion that with the gaps between the circulation fan 19 and the second and third rear blowoff ports 30, 31 closed as shown in FIG. 17, the circulation fan 19 feeds air and the like in the circulation duct 18 to the upper heater 20, and moreover that air and the like sucked from within the heating chamber 2 into the circulation duct 18 are heated by the upper heater 20 and the middle heater 21. As a result, such air streams as shown by arrows in FIG. 17 are generated, allowing high temperature air and the like to be supplied to the upper space 373A via the upper blowoff ports 28 and the first rear blowoff ports 29. Thus, the cooking device is enabled to perform grill cooking in the upper space 373A to grill the heating object 315A.

When the second cooking control part 300*b* controls the circulation damper 23 and the like, gaps between the circulation fan 19 and the second and third rear blowoff ports 30, 31 are closed. Therefore, high-temperature air and the like can be prevented from being supplied to the lower space 373B through the second and third rear blowoff ports 30, 31. Thus, adverse effects on steam cooking performed in the lower space 373B can be prevented. This means that the steamed heating object 315B can be prevented from being grilled.

Consequently, the cooking device is enabled to perform different kinds of cooking in the upper space 373A and the lower space 373B, respectively.

During the grill cooking, the upper heater 20 and the middle heater 21 are turned ON and OFF based on temperatures detected by the lower inside temperature sensor 370B so that the temperature of the lower space 373B is prevented from going over 100° C. Therefore, drying of the heating object 315B can be suppressed.

Since the suction ports 27 are opened in the upper space 373A, saturated steam in the lower space 373B is less likely to be sucked into the suction ports 27. As a result, saturated steam of the lower space 373B can be prevented from decreasing, so that drying of the heating object 315B can be further suppressed.

Since the circulation damper 23 closes the first rear blowoff ports 29 for steam cooking performed in the lower space 373B, saturated steam can be prevented from being supplied to the upper space 373A through the first rear blowoff ports 29. Therefore, supply efficiency of saturated steam to the lower space 373B can be enhanced, so that a desired quantity of saturated steam can be filled to the lower space 373B in shorter time. As a consequence, the time required for steam cooking can be reduced.

Since the circulation damper 23 closes the gaps between the circulation fan 19 and the second and third rear blowoff ports 30, 31 for grill cooking performed in the upper space 373A, high-temperature air and the like can be prevented from being supplied to the lower space 373B through the second and third rear blowoff ports 30, 31. Therefore, supply efficiency of high-temperature air and the like to the upper space 373A can be enhanced, so that the upper space 373A can be increased to a desired temperature in shorter time. As a consequence, the time required for grill cooking can be reduced.

In the third embodiment, the circulation damper 23 is used for opening and closing the gaps between the circulation fan 19 and the second and third rear blowoff ports 30, 31 and moreover for opening and closing the first rear blowoff ports 29 as well. Instead, a damper only for opening and closing the gaps between the circulation fan 19 and the second and third rear blowoff ports 30, 31 may be used.

In the third embodiment, the circulation duct 18 is composed of the front portion 18*a* in which the upper heater 20 is internally placed, the connecting portion 18*b* that extends obliquely downward from the rear end of the front portion 18*a*, and the rear portion 18*c* that extends directly downward from the lower end of the connecting portion 18*b*. Instead, the circulation duct 18 may be composed of a front portion in which the upper heater 20 is internally placed, and a rear portion which extends directly downward from a rear end of the front portion.

In the third embodiment, the circulation duct 18 is provided so as to range from the upper side to the rear side of the heating chamber 2. Instead, the circulation duct 18 may be provided so as to range from the upper side to the right lateral side or the left lateral side of the heating chamber 2.

In the third embodiment, the circulation fan 19 may be provided, for example, as a multiblade fan or a turbofan. In such a case, the multiblade fan or the turbofan may have a plurality of blades provided along its peripheral edge portion, each of the blades being generally parallel (including complete parallel) to the radial direction.

In the third embodiment, the first and second cooking control parts 300*a*, 300*b* are implemented by software. Instead, at least one of the first and second cooking control parts 300*a*, 300*b* may be implemented by hardware.

(Fourth Embodiment)

Figure 18:
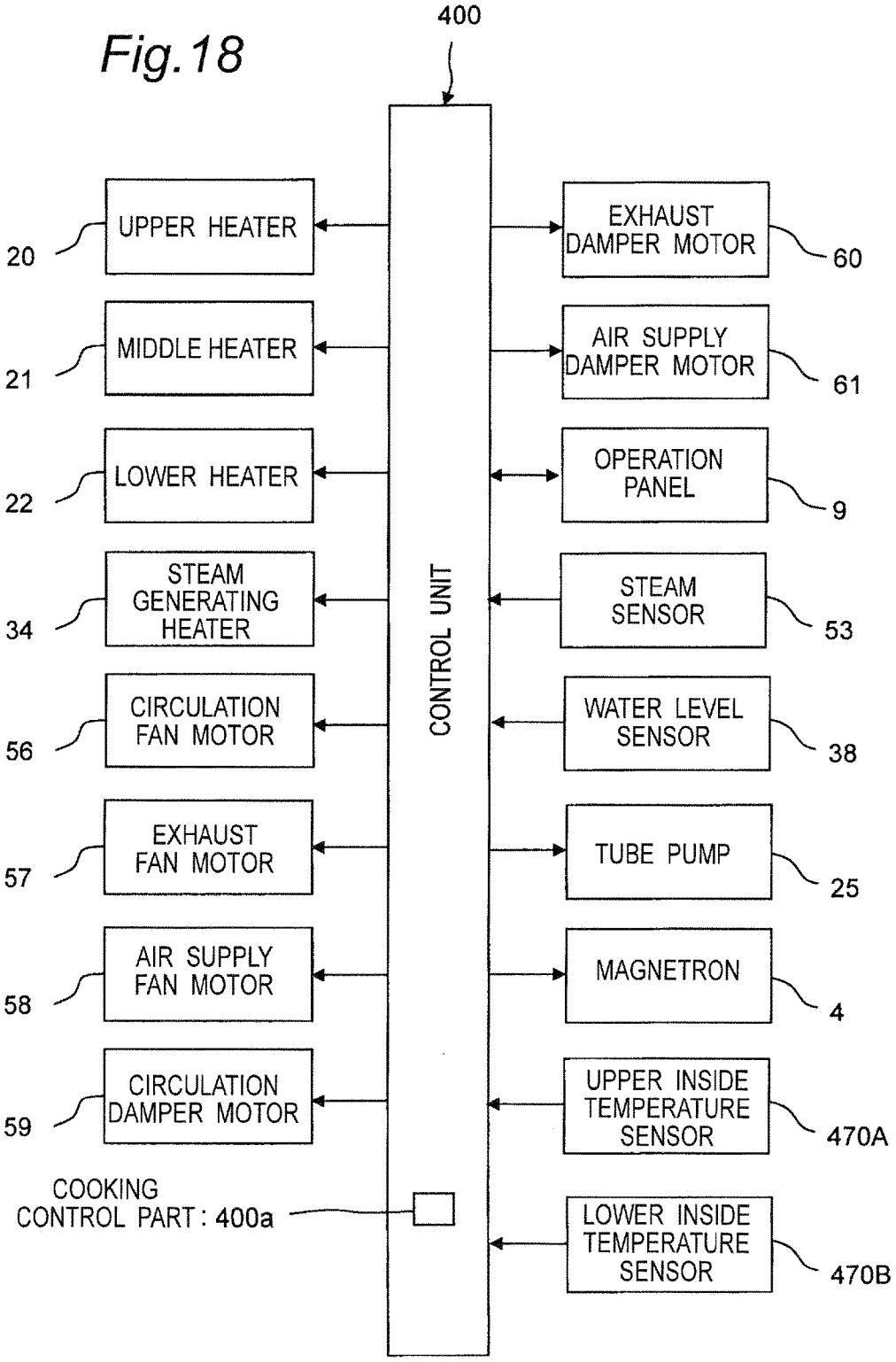
FIG. 18 is a control block diagram of a cooking device according to a fourth embodiment of the invention.

FIG. 18 is a control block diagram of a cooking device according to a fourth embodiment of the invention. In FIG. 18, the same component members as those of the cooking device of the first embodiment are designated by the same reference signs as those of the cooking device of the first embodiment. Also in the following description, the same component members as those of the cooking device of the first embodiment are designated by the same reference signs as those of the cooking device of the first embodiment.

The cooking device includes a control unit 400 so as to be capable of performing the so-called dual cooking. The control unit 400, like the control unit 100 of the first embodiment, is composed of a microcomputer, input/output circuits, and the like. Connected to the control unit 400 are an upper heater 20, a middle heater 21, a lower heater 22, a steam-generating heater 34, a circulation fan motor 56, an exhaust fan motor 57, an air supply fan motor 58, a circulation damper motor 59, an exhaust damper motor 60, an air supply damper motor 61, an operation panel 9, a steam sensor 53, a water level sensor 38, a tube pump 25, a magnetron 4, an upper inside temperature sensor 470A, a lower inside temperature sensor 470B, and the like. Based on signals derived from the operation panel 9, the steam sensor 53, the water level sensor 38, the upper inside temperature sensor 470A, the lower inside temperature sensor 470B, and the like, the control unit 400 controls the upper heater 20, the middle heater 21, the lower heater 22, the steam-generating heater 34, the circulation fan motor 56, the exhaust fan motor 57, the air supply fan motor 58, the circulation damper motor 59, the exhaust damper motor 60, the air supply damper motor 61, the tube pump 25, and the like. The upper heater 20 and the middle heater 21 are each an example of the heater. The upper inside temperature sensor 470A is an example of the temperature sensor.

The upper inside temperature sensor 470A detects a temperature of an upper space 473A (shown in FIG. 20) in the heating chamber 2 and transmits a signal indicative of the temperature to the control unit 400. The upper space 473A is communicated with a lower space 473B (shown in FIG. 20) via a gap between the cooking tray 91 and the door 3.

The lower inside temperature sensor 470B detects a temperature of the lower space 473B in the heating chamber 2 and transmits a signal indicative of the temperature to the control unit 400.

The control unit 400 has a cooking control part 400*a* for the dual cooking. The cooking control part 400*a* is implemented by software. Based on a temperature detected by the upper inside temperature sensor 470A, the control unit 400 controls the saturated steam generator 24 in such fashion that saturated steam is supplied to the upper space 473A via the steam supply ports 37 when the upper space 473A in the heating chamber 2 has come to a temperature over 100° C. As a result, the cooking device is enabled to perform grill cooking in the upper space 473A of the heating chamber 2 while performing steam cooking in the lower space 473B of the heating chamber 2.

Figure 19:
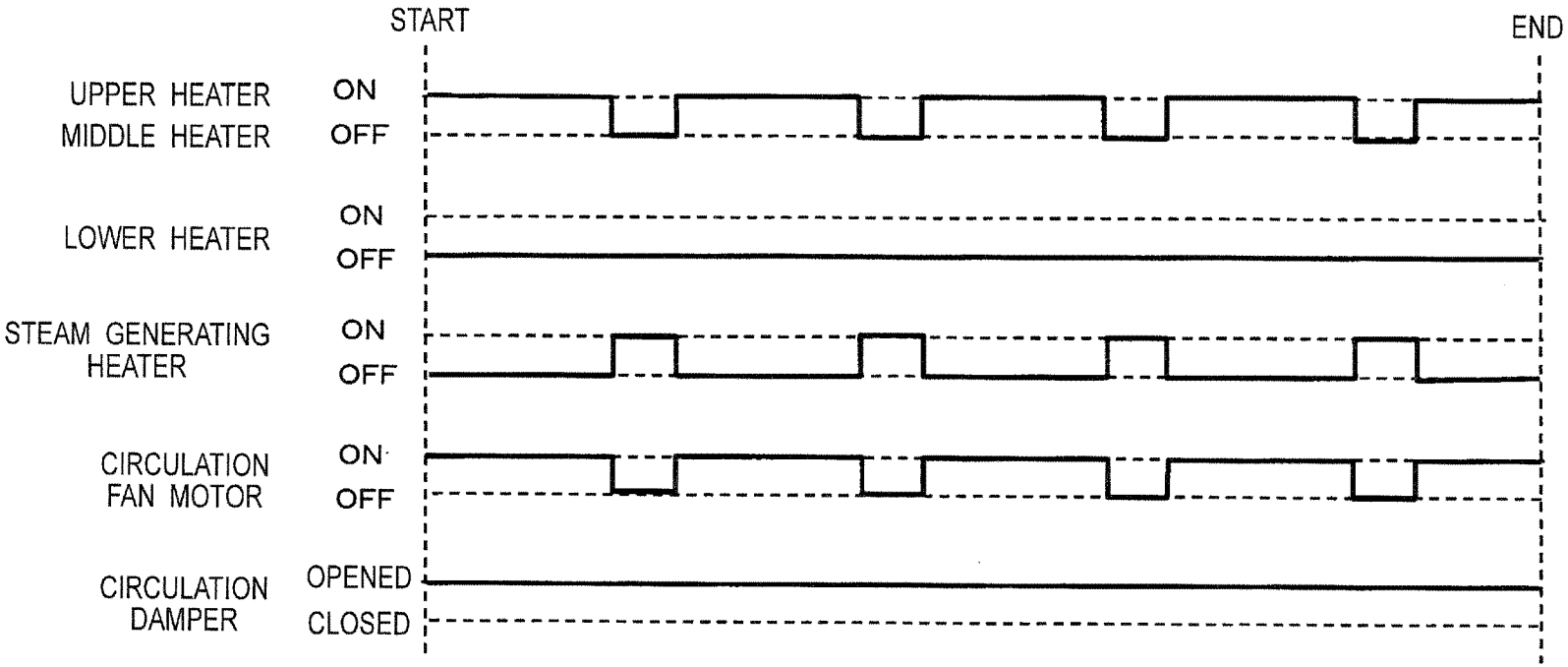
FIG. 19 is a time chart for explaining operations of the cooking device of the fourth embodiment.

FIG. 19 is a time chart for explaining operations in processing of steam cooking and grill cooking by the cooking device.

The cooking device performs steam cooking in the lower space 373B of the heating chamber 2 while performing grill cooking in the upper space 373A of the heating chamber 2. That is, steam cooking and grill cooking go on simultaneously.

With steam cooking and grill cooking going on simultaneously, the upper heater 20, the middle heater 21, the steam-generating heater 34 and the circulation fan motor 56 are intermittently turned ON, whereas the lower heater 22 is kept off continuously. In this case, the circulation damper 23 closes the gaps between the circulation fan 19 and the second and third rear blowoff ports 30, 31.

More specifically, when the steam-generating heater 34 is turned ON, the upper heater 20, the middle heater 21 and the circulation fan motor 56 are turned OFF. Then, when the steam-generating heater 34 is turned OFF, the upper heater 20, the middle heater 21 and the circulation fan motor 56 are turned ON. That is, turning-ON/OFF of the steam-generating heater 34 is set inverse to the turning-ON/OFF of the upper heater 20, the middle heater 21 and the circulation fan motor 56. In addition, the steam-generating heater 34 may be set so as to repeat an e.g. 40-sec. OFF and an e.g. 20-sec. ON alternately. In such a case, the upper heater 20, the middle heater 21 and the circulation fan motor 56 are set so as to each repeat an e.g. 40-sec. ON and an e.g. 20-sec. OFF, alternately.

Figure 20:
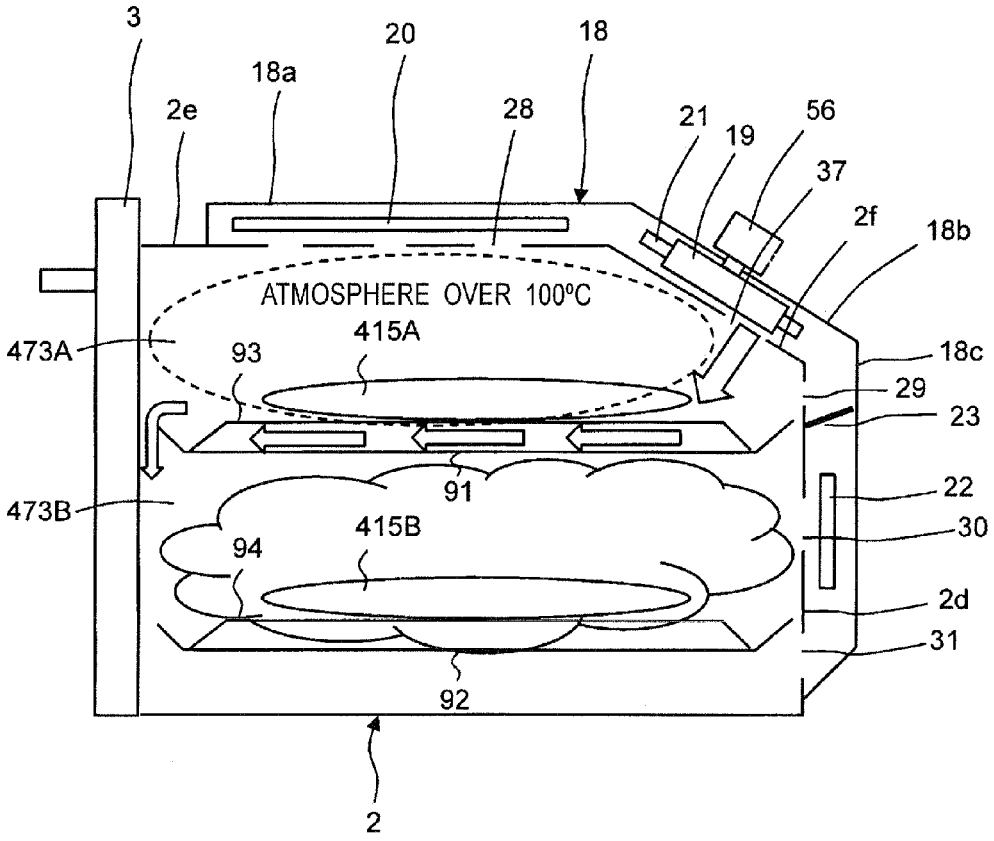
FIG. 20 is a schematic sectional view of the cooking device of the fourth embodiment during cooking.

According to the cooking device having the above-described constitution, for execution of dual cooking, the cooking tray 91 on which a heating object 415A to be steamed is mounted with the cooking grid 93 interposed therebetween is first accommodated in the heating chamber 2 as shown in FIG. 20. In this case, the cooking tray 91 partitions the heating chamber 2 into the upper space 473A and the lower space 473B. Also, the cooking tray 92 on which a heating object 415B to be grilled is mounted with the cooking grid 94 interposed therebetween is accommodated in the heating chamber 2 so as to be positioned under the cooking tray 91.

Next, a specified operation is performed on the color LCD part 10 and the start key 13 is pressed, then the dual cooking being started. That is, control process by the cooking control part 400*a* is started.

More specifically, based on a temperature detected by the upper inside temperature sensor 470A, the cooking control part 400*a* controls the saturated steam generator 24 in such fashion that saturated steam is supplied to the upper space 473A via the steam supply ports when the upper space 473A has come to a temperature over 100° C. Thus, whereas saturated steam is supplied to the upper space 473A, saturated steam lower in temperature than the upper space 473A flows along the upper surface of the cooking tray 91 so as to flow down to the lower space 473B via the gap between the cooking tray 91 and the door 3. As a result, the cooking device is enabled to fill saturated steam into the lower space 473B to perform steam cooking in the lower space 473B.

Since the saturated steam flows down to the lower space 473B via the gap between the cooking tray 91 and the door 3, the cooking device is enabled to perform grill cooking in the upper space 473A.

Consequently, the cooking device is enabled to perform different kinds of cooking in the upper space 473A and the lower space 473B, respectively.

Figure 21:
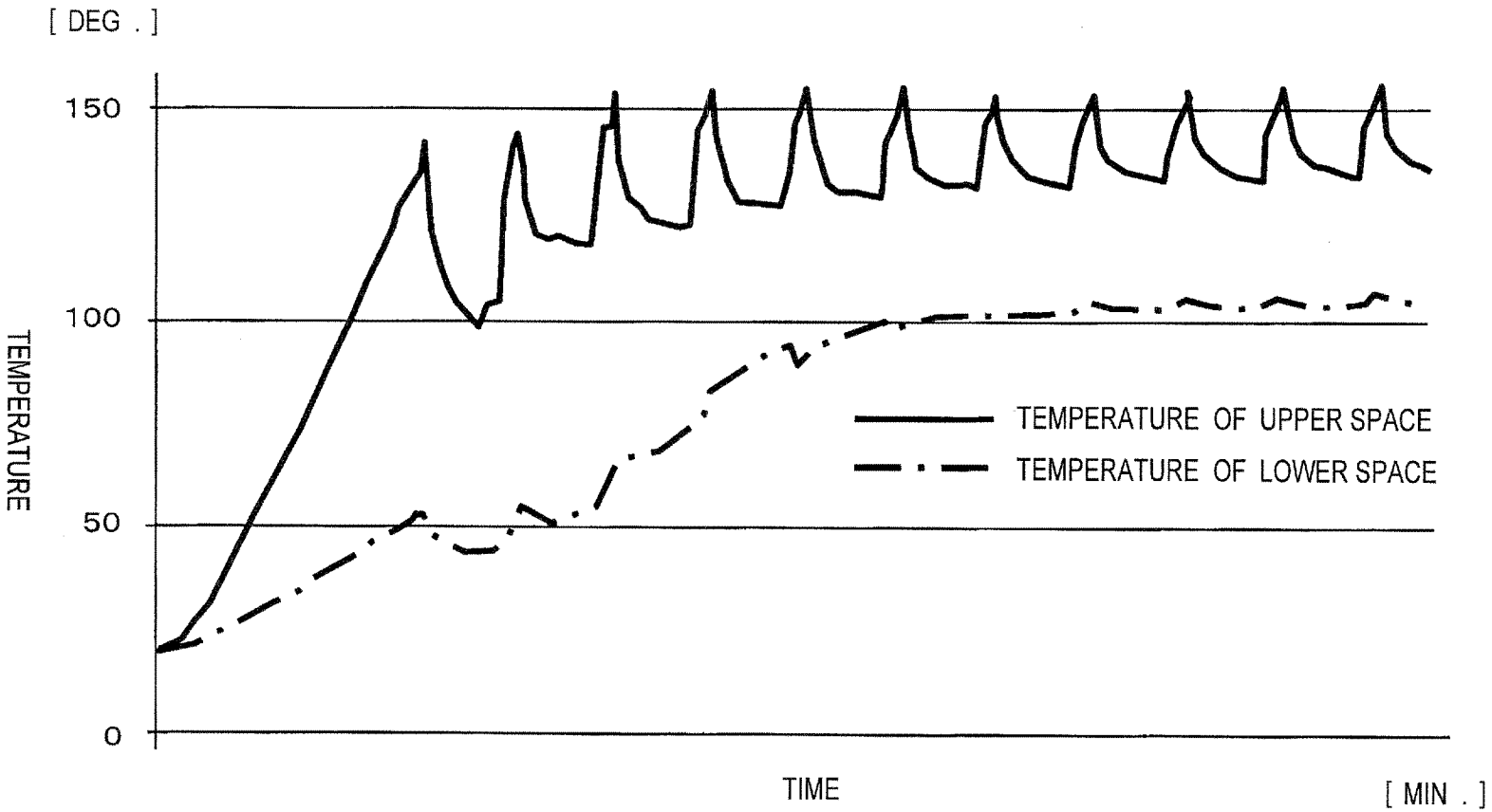
FIG. 21 is a chart of time variations in temperatures of an upper space and a lower space in the cooking device of the fourth embodiment.

By virtue of the cooking control part 400*a*'s controlling the saturated steam generator 24 and the like, as shown in FIG. 21, the temperature of the lower space 473B can be raised while raising the temperature of the upper space 473A.

In the fourth embodiment, based on a temperature detected by the lower inside temperature sensor 470B, the upper heater 20 and the middle heater 21 may be turned ON and OFF so that the temperature of the lower space 373B is prevented from going over 100° C.

In the fourth embodiment, saturated steam flows down via the gap between the cooking tray 91 and the door 3 to the lower space 473B. Instead, saturated steam may be allowed to flow down to the lower space 473B via a gap provided between the heating chamber 2 and the cooking tray 91.

In the fourth embodiment, the circulation damper 23 is used for opening and closing the gaps between the circulation fan 19 and the second and third rear blowoff ports 30, 31 and moreover for opening and closing the first rear blowoff ports 29 as well. Instead, a damper only for opening and closing the gaps between the circulation fan 19 and the second and third rear blowoff ports 30, 31 may be used.

In the fourth embodiment, the circulation duct 18 is composed of the front portion 18*a* in which the upper heater 20 is internally placed, the connecting portion 18*b* that extends obliquely downward from the rear end of the front portion 18*a*, and the rear portion 18*c* that extends directly downward from the lower end of the connecting portion 18*b*. Instead, the circulation duct 18 may be composed of a front portion in which the upper heater 20 is internally placed, and a rear portion which extends directly downward from a rear end of the front portion.

In the fourth embodiment, the circulation duct 18 is provided so as to range from the upper side to the rear side of the heating chamber 2. Instead, the circulation duct 18 may be provided so as to range from the upper side to the right lateral side or the left lateral side of the heating chamber 2.

In the fourth embodiment, the circulation fan 19 may be provided, for example, as a multiblade fan or a turbofan. In such a case, the multiblade fan or the turbofan may have a plurality of blades provided along its peripheral edge portion, each of the blades being generally parallel (including complete parallel) to the radial direction.

In the fourth embodiment, the cooking control part 400*a* is implemented by software. Instead, the cooking control part 400*a* may be implemented by hardware.

That is, the present invention and its embodiments can be summarized as described below.

A cooking device of the invention comprises:

a casing 1;

a heating chamber 2 provided in the casing 1;

a microwave generator 4 arranged to supply microwaves into the heating chamber 2;

a cooking tray 91 which is to be placed in the heating chamber 2 so as to have a gap against a rear portion 2*d* of the heating chamber 2 and on which a heating object 15 to be heated is to be mounted directly or indirectly;

a duct 18 which is provided on a rear side of the heating chamber 2 and through which a heat medium flows from an upper side toward a lower side;

a rear blowoff port 29 which is provided in the rear portion 2*d* of the heating chamber 2 so as to be positioned on an upper side of the gap and near a rear portion of the cooking tray 91 and which is communicated with the duct 18 so as to allow the heat medium to be blown off into the heating chamber 2; and a flow regulation structure 62 provided on a rear side of the rear blowoff port 29 and arranged to regulate a flow of the heat medium, wherein the flow regulation structure 62 has, on a lower side thereof, a first guide surface 63 extending in a direction generally parallel to a horizontal direction.

With this constitution, since the first guide surface 63 on the lower side of the flow regulation structure 62 extends in a direction generally parallel to the horizontal direction, the heat medium passing through the gap between the rear portion 2*d* of the heating chamber 2 and the cooking tray 91, which is a portion of the heat medium blown off from the rear blowoff port 29, can be reduced. Therefore, the heat medium flowing along the upper side of the cooking tray 91 can be increased, so that the heating object 15 on the cooking tray 91 can be heated with high efficiency.

For example, when the heating object 15 is mounted on the cooking tray 91 with the cooking grid 93 interposed therebetween, the heat medium flowing along the upper side of the cooking tray 91 can be increased. Thus, the bottom surface of the heating object 15 can be grilled with high efficiency.

While the cooking tray 91 is placed in the heating chamber 2, there is a gap between the cooking tray 91 and the rear portion 2*d* of the heating chamber 2. Therefore, even if microwaves are mis-supplied into the heating chamber 2 with the cooking tray 91 placed in the heating chamber 2, electrical discharge is less likely to occur in the heating chamber 2.

In the cooking device of one embodiment, the flow regulation structure 62 has, on an upper side thereof, a second guide surface 64 sloped with its front end lower than its rear end.

According to this embodiment, since the second guide surface 64 on the upper side of the flow regulation structure 62 is sloped with its front end lower than its rear end, the heat medium flowing along the upper side of the cooking tray 91 can be further increased.

The cooking device of one embodiment further comprise a damper 23 provided in the duct 18 to open and close the rear blowoff port 29, wherein the damper 23 is sloped with its front end lower than its rear end when the damper 23 is in an opened state.

According to this embodiment, since the damper 23 is sloped with its front end lower than its rear end in its opened state, the heat medium derived from above is allowed to smoothly flow to the rear blowoff port 29.

In the cooking device of one embodiment, the duct 18 includes an upper portion 18*a* positioned on an upper side of the heating chamber 2, and a downward extending portion 18*b*, 18*c* which extends downward from one end of the upper portion 18*a*, and the cooking device further comprises:

a centrifugal fan 19 which is rotatable forward and reverse to feed the heat medium into the upper portion 18*a* of the duct 18;

a first heater 220A placed on one side in the upper portion 18*a* of the duct 18;

a second heater 220B placed on an opposite side in the upper portion 18*a* of the duct 18;

a first upper blowoff port 28 provided in the upper portion 2*e* of the heating chamber 2 and arranged to blow off the heat medium derived from the first heater 220A into the heating chamber 2; and a second upper blowoff port 28 provided in the upper portion 2*e* of the heating chamber 2 and arranged to blow off the heat medium derived from the second heater 220B into the heating chamber 2.

It is noted that the term 'one side' refers to either one lateral side or a front side. The term 'opposite side' refers to an opposite lateral side on condition that the 'one side' refers to the one lateral side, and refers to a rear side on condition that the 'one side' refers to the front side.

According to this embodiment, when the centrifugal fan 19 is rotated forward, the heat medium is fed from the centrifugal fan 19 into the upper portion 18*a* of the duct 18. In this case, a quantity of the heat medium flowing to one of the first and second heaters 220A, 220B becomes larger than a quantity of the heat medium flowing to the other of the first and second heaters 220A, 220B. Therefore, one of the first and second heaters 220A, 220B is turned ON while the other of the first and second heaters 220A, 220B is turned OFF, by which large quantities of the heat medium heated by the one of the first and second heaters 220A, 220B are blown off from one of the first and second upper blowoff ports 28, 28. Thus, spot-basis heating can be fulfilled under one of the first and second upper blowoff ports 28, 28.

Since large quantities of the heat medium heated by one of the first and second heaters 220A, 220B are blown off from one of the first and second upper blowoff ports 28, 28, the heating object 15 placed under the one of the first and second upper blowoff ports 28, 28 can be heated even if the space under the other of the first and second upper blowoff ports 28, 28 is not warmed. Therefore, the time that would otherwise be required to warm the space under the other of the first and second upper blowoff ports 28, 28 can be saved, so that the heating of the heating object 15 placed under the one of the first and second upper blowoff ports 28, 28 can be completed in shorter time.

Since large quantities of the heat medium heated by one of the first and second heaters 220A, 220B are blown off from one of the first and second upper blowoff ports 28, 28, the upper surface of the heating object 15 placed under the one of the first and second upper blowoff ports 28, 28 can be heated uniformly.

In the case where the centrifugal fan 19 is rotated reverse, one of the first and second heaters 220A, 220B is turned OFF while the other of the first and second heaters 220A, 220B is turned ON, by which large quantities of the heat medium heated by the other of the first and second heaters 220A, 220B are blown off from the other of the first and second upper blowoff ports 28, 28. Thus, spot-basis heating can be fulfilled also under the other of the first and second upper blowoff ports 28, 28.

In the cooking device of one embodiment, the cooking tray 91 partitions the heating chamber 2 into an upper space 373A and a lower space 373B, the rear blowoff port 29 is a first rear blowoff port 29 opened to the upper space 373A, the heating chamber 2 has a second rear blowoff port 30, 31 which is provided in the rear portion 2*d* of the heating chamber 2 so as to be positioned below the first rear blowoff port 29 and which is opened to the lower space 373B, and the duct 18 is communicated with the upper space 373A via the first rear blowoff port 29 and with the lower space 373B via the second rear blowoff port 30, 31, and the cooking device further comprises:

a saturated steam generator 24 arranged to generate saturated steam to be supplied into the duct 18;

a fan 19 placed in the duct 18;

a heater 21 at least part of which is placed between the fan 19 and the first rear blowoff port 29;

a damper 23 arranged to open and close a gap between the fan 19 and the second rear blowoff port 30, 31;

a first cooking control part 300*a* configured to control the damper 23, the fan 19 and the saturated steam generator 24 in such fashion that with the gap between the fan 19 and the second rear blowoff port 30, 31 opened, the fan 19 feeds saturated steam in the duct 18 to the second rear blowoff port 30, 31; and a second cooking control part 300*b* configured to control the damper 23, the fan 19 and the heater 21 in such fashion that with the gap between the fan 19 and the second rear blowoff port 30, 31 closed, the fan 19 feeds the heat medium in the duct 18 to the heater 21 and moreover the heater 21 heats the heat medium.

According to this embodiment, the first cooking control part 300*a* controls the damper 23, the fan 19 and the saturated steam generator 24 in such fashion that with the gap between the fan 19 and the second rear blowoff port 30, 31 opened, the fan 19 feeds saturated steam in the duct 18 to the second rear blowoff port 30, 31. As a result of this, the saturated steam can be supplied to the lower space 373B via the second rear blowoff port 30, 31. Thus, the cooking device is enabled to perform steam cooking in the lower space 373B.

The second cooking control part 300*b* controls the damper 23, the fan 19 and the heater 21 in such fashion that with the gap between the fan 19 and the second rear blowoff port 30, 31 closed, the fan 19 feeds the heat medium in the duct 18 to the heater 21 and moreover that the heater 21 heats the heat medium. As a result of this, a high-temperature heat medium can be supplied to the upper space 373A via the first rear blowoff port 29. Thus, the cooking device is enabled to perform grill cooking in the upper space 373A.

While the second cooking control part 300*b* controls the damper 23 and the like, the gap between the fan 19 and the second rear blowoff port 30, 31 is closed, so that the heat medium heated by the heater 21 can be prevented from being supplied to the lower space 373B via the second rear blowoff port 30, 31. Thus, adverse effects on the steam cooking performed in the lower space 373B can be prevented.

Consequently, the cooking device is enabled to perform different kinds of cooking in the upper space 373A and the lower space 373B, respectively.

A cooking device according to an aspect of the invention comprises:

a casing 1;

a heating chamber 2 provided in the casing 1 and arranged to accommodate a heating object 15 to be heated;

a duct 18 which is provided outside the heating chamber 2 and which has an upper portion 18*a* positioned on an upper side of the heating chamber 2 and a downward extending portion 18*b*, 18*c* downwardly extending from one end of the upper portion 18*a;* a centrifugal fan 19 which is rotatable forward and reverse to feed a heat medium into the upper portion 18*a* of the duct 18;

a first heater 220A placed on one side in the upper portion 18*a* of the duct 18;

a second heater 220B placed on an opposite side in the upper portion 18*a* of the duct 18;

a first blowoff port 28 provided in the upper portion 2*e* of the heating chamber 2 and arranged to blow off the heat medium derived from the first heater 220A into the heating chamber 2; and a second blowoff port 28 provided in the upper portion 2*e* of the heating chamber 2 and arranged to blow off the heat medium derived from the second heater 220B into the heating chamber 2.

It is noted that the term 'one side' refers to either one lateral side or a front side. The term 'opposite side' refers to an opposite lateral side on condition that the 'one side' refers to the one lateral side, and refers to a rear side on condition that the 'one side' refers to the front side.

With this constitution, when the centrifugal fan 19 is rotated forward, the heat medium is fed from the centrifugal fan 19 into the upper portion 18*a* of the duct 18. In this case, a quantity of the heat medium flowing to one of the first and second heaters 220A, 220B becomes larger than a quantity of the heat medium flowing to the other of the first and second heaters 220A, 220B. Therefore, one of the first and second heaters 220A, 220B is turned ON while the other of the first and second heaters 220A, 220B is turned OFF, by which large quantities of the heat medium heated by the one of the first and second heaters 220A, 220B are blown off from one of the first and second blowoff ports 28, 28. Thus, spot-basis heating can be fulfilled under one of the first and second blowoff ports 28, 28.

Since large quantities of the heat medium heated by one of the first and second heaters 220A, 220B are blown off from one of the first and second blowoff ports 28, 28, the heating object 15 placed under the one of the first and second blowoff ports 28, 28 can be heated even if the space under the other of the first and second blowoff ports 28, 28 is not warmed. Therefore, the time that would otherwise be required to warm the space under the other of the first and second blowoff ports 28, 28 can be saved, so that the heating of the heating object 15 placed under the one of the first and second blowoff ports 28, 28 is allowed to be completed in shorter time.

Since the heat medium heated by one of the first and second heaters 220A, 220B is blown off in large quantities from one of the first and second blowoff ports 28, 28, the upper surface of the heating object 15 placed under the one of the first and second blowoff ports 28, 28 can be heated uniformly.

In the case where the centrifugal fan 19 is rotated reverse and one of the first and second heaters 220A, 220B is turned OFF while the other of the first and second heaters 220A, 220B is turned ON, large quantities of the heat medium heated by the other of the first and second heaters 220A, 220B are blown off from the other of the first and second blowoff ports 28, 28. Thus, spot-basis heating can be fulfilled also under the other of the first and second blowoff ports 28, 28.

The cooking device of one embodiment further comprises a first partition 271 for separating the one side within the upper portion 18*a* of the duct 18 from the opposite side within the upper portion 18*a* of the duct 18.

According to this embodiment, since the one side within the upper portion 18*a* of the duct 18 and the opposite side within the upper portion 18*a* of the duct 18 are partitioned from each other by the first partition 271, the quantity of air and the like flowing to one of the first and second heaters 220A, 220B can securely be made larger than the quantity of air and the like flowing to the other of the first and second heaters 220A, 220B.

The cooking device of one embodiment further comprises:

a cooking tray 91 which is to be placed in the heating chamber 2 and on which a heating object 15 to be heated is mounted directly or indirectly;

a third heater 21 arranged to heat a heat medium flowing from the centrifugal fan 19 into the downward extending portion 18*b*, 18*c* of the duct 18;

a second partition 272 arranged to partition the one side within the downward extending portion 18*b*, 18*c* of the duct 18 and the opposite side within the downward extending portion 18*b*, 18*c* of the duct 18 from each other;

a third blowoff port 29 provided in the rear portion 2*d* or a side portion 2*b*, 2*c* of the heating chamber 2 so as to be positioned near the cooking tray 91, and arranged to blow off the heat medium derived from the one side within the downward extending portion 18*b*, 18*c* of the duct 18 into the heating chamber 2; and a fourth blowoff port 29 provided in the rear portion 2*d* or a side portion 2*b*, 2*c* of the heating chamber 2 so as to be positioned near the cooking tray 91 and arranged to blow off the heat medium derived from the opposite side within the downward extending portion 18*b*, 18*c* of the duct 18 into the heating chamber 2.

It is noted that the term 'one side' refers to either one lateral side or a front side. The term 'opposite side' refers to an opposite lateral side on condition that the 'one side' refers to the one lateral side, and refers to a rear side on condition that the 'one side' refers to the front side.

According to this embodiment, the second partition 272 partitions one side within the downward extending portion 18*b*, 18*c* of the duct 18 and the opposite side within the downward extending portion 18*b*, 18*c* of the duct 18 from each other. As a result of this, a quantity of the heat medium flowing through one of the one side and the opposite side can securely be made larger than a quantity of the heat medium flowing through the other of the one side and the opposite side. Therefore, in the case where the centrifugal fan 19 is rotated forward, the third heater 21 is turned ON, by which large quantities of the heat medium heated by the third heater 21 are blown off from one of the third and fourth blowoff ports 29, 29. Thus, the heating object 15 placed on the front side of one of the third and fourth blowoff ports 29, 29 can be heated effectively.

In the case where the heating object 15 is mounted on the cooking tray 91 with the cooking grid 93 interposed therebetween as an example, since one of the third and fourth blowoff ports 29, 29 is positioned near the cooking tray 91, the heat medium derived from the one of the third and fourth blowoff ports 29, 29 is allowed to flow between the heating object 15 and the cooking tray 91. Therefore, the lower surface of the heating object 15 placed on the front side of the one of the third and fourth blowoff ports 29, 29 can be heated uniformly.

In the case where the centrifugal fan 19 is rotated reverse, the third heater 21 is turned ON, by which large quantities of the heat medium heated by the third heater 21 are blown off from the other of the third and fourth blowoff ports 29, 29. Thus, the heating object 15 placed on the front side of the other of the third and fourth blowoff ports 29, 29 can be heated effectively and moreover the lower surface of the heating object 15 can be heated uniformly.

A cooking device according to an aspect of the invention comprises:

a casing 1;

a heating chamber 2 provided in the casing 1;

a cooking tray 91 to be placed in the heating chamber 2 to partition inside of the heating chamber 2 into an upper space 373A and a lower space 373B;

an upper blowoff port 29 provided in the heating chamber 2 so as to be opened to the upper space 373A;

a lower blowoff port 30, 31 provided in the heating chamber 2 so as to be opened to the lower space 373B;

a duct 18 provided outside the heating chamber 2 so as to be communicated with the inside of the heating chamber 2 via the upper blowoff port 29 and the lower blowoff port 30, 31;

a saturated steam generator 24 arranged to generate saturated steam to be supplied into the duct 18;

a fan 19 placed in the duct 18;

a heater 21 at least part of which is placed between the fan 19 and the upper blowoff port 29;

a damper 23 arranged to open and close a gap between the fan 19 and the lower blowoff port 30, 31;

a first cooking control part 300*a* configured to control the damper 23, the fan 19 and the saturated steam generator 24 in such fashion that with the gap between the fan 19 and the lower blowoff port 30, 31 opened, the fan 19 feeds saturated steam in the duct 18 to the lower blowoff port 30, 31; and a second cooking control part 300*b* configured to control the damper 23, the fan 19 and the heater 21 in such fashion that with the gap between the fan 19 and the lower blowoff port 30, 31 closed, the fan 19 feeds the heat medium in the duct 18 to the heater 21 and moreover the heater 21 heats the heat medium.

With this constitution, the first cooking control part 300*a* controls the damper 23, the fan 19 and the saturated steam generator 24 in such fashion that with the gap between the fan 19 and the lower blowoff port 30, 31 opened, the fan 19 feeds saturated steam in the duct 18 to the lower blowoff port 30, 31. As a result of this, the saturated steam can be supplied to the lower space 373B via the lower blowoff port 30, 31. Thus, the cooking device is enabled to perform steam cooking in the lower space 373B.

The second cooking control part 300*b* controls the damper 23, the fan 19 and the heater 21 in such fashion that with the gap between the fan 19 and the lower blowoff port 30, 31 closed, the fan 19 feeds the heat medium in the duct 18 to the heater 21 and moreover the heater 21 heats the heat medium. As a result of this, the high-temperature heat medium can be supplied to the upper space 373A via the upper blowoff port 29. Thus, the cooking device is enabled to perform grill cooking in the upper space 373A.

When the second cooking control part 300*b* controls the damper 23 and the like, the gap between the fan 19 and the lower blowoff port 30, 31 is closed. Therefore, the heat medium heated by the heater 21 can be prevented from being supplied to the lower space 373B through the lower blowoff port 30, 31. Thus, adverse effects on steam cooking performed in the lower space 373B can be prevented.

Consequently, the cooking device is enabled to perform different kinds of cooking in the upper space 373A and the lower space 373B, respectively.

A cooking device according to an aspect of the invention comprises:

a casing 1;

a heating chamber 2 provided in the casing 1 and having an opening 2*a* on a front side thereof;

a door 3 arranged to open and close the opening 2*a;* a cooking tray 91 to be placed in the heating chamber 2 to partition inside of the heating chamber 2 into an upper space 473A and a lower space 473B;

a gap provided between the door 3 and the cooking tray 91 or between the heating chamber 2 and the cooking tray 91 to allow the upper space 473A and the lower space 473B to be communicated with each other;

an upper blowoff port 28 provided in the heating chamber 2 so as to be opened to the upper space 473A;

a heater 20, 21 arranged to heat a heat medium blown off from the upper blowoff port 28;

a steam supply port 37 provided in the heating chamber 2 so as to be opened to the upper space 473A;

a saturated steam generator 24 arranged to generate saturated steam to be fed to the steam supply port 37;

a temperature sensor 470A arranged to detect a temperature of the upper space 473A; and a cooking control part 400*a* configured to control the saturated steam generator 24 based on the temperature detected by the temperature sensor 470A in such fashion that the saturated steam is supplied to the upper space 473A via the steam supply port 37 when the upper space 473A has come to a temperature over 100° C.

With this constitution, the cooking control part 400*a* controls the saturated steam generator 24 based on the temperature detected by the temperature sensor 470A in such fashion that the saturated steam is supplied to the upper space 473A via the steam supply port 37 when the upper space 473A has come to a temperature over 100° C. Thus, whereas saturated steam is supplied to the upper space 473A, saturated steam lower in temperature than the upper space 473A flows down to the lower space 473B via the gap. As a result, the cooking device is enabled to fill saturated steam into the lower space 473B to perform steam cooking in the lower space 473B.

Since the saturated steam flows down from the gap to the lower space 473B, the cooking device is enabled to perform grill cooking in the upper space 473A.

Consequently, the cooking device is enabled to perform different kinds of cooking in the upper space 473A and the lower space 473B, respectively. Meanwhile, there has conventionally been provided a cooking device described in JP 2014-31948 A. This cooking device includes a casing, and a heating chamber provided in the case and having a suction port and a blowoff port in a rear portion thereof. A circulation duct is provided on a rear side of the heating chamber. A heater is placed in the circulation duct. Further, a circulation unit is attached to the circulation duct.

The circulation unit has a circulation fan, and a circulation fan motor for driving the circulation fan. By drive of this circulation fan, air and saturated steam within the heating chamber are fed through the suction port into the circulation duct and heated by the heater. Thereafter, the air and saturated steam heated by the heater are returned through the blowoff port into the heating chamber to heat the heating object in the heating chamber.

In the conventional cooking device, the circulation duct is provided on the rear side of the heating chamber, and the circulation unit is attached to the circulation duct. As a result of this, the circulation unit is present between a rear portion of the heating chamber and a rear portion of the casing.

Therefore, with the conventional cooking device, the distance between the rear portion of the heating chamber and the rear portion of the casing cannot be shortened, resulting in a longer front-to-rear length or depth of the casing. This entails a problem that the casing cannot be downsized.

This being the case, hereinbelow, cooking devices which allow the casing to be downsized will be described in detail by way of embodiments illustrated in the accompanying drawings. In the following description, the term 'left side' refers to a left-hand side of a viewer facing the cooking device as the cooking device is viewed from its door side, and the term 'right side' refers to a right-hand side of a viewer facing the cooking device as the cooking device is viewed from its door side.

(Fifth Embodiment)

Figure 22:
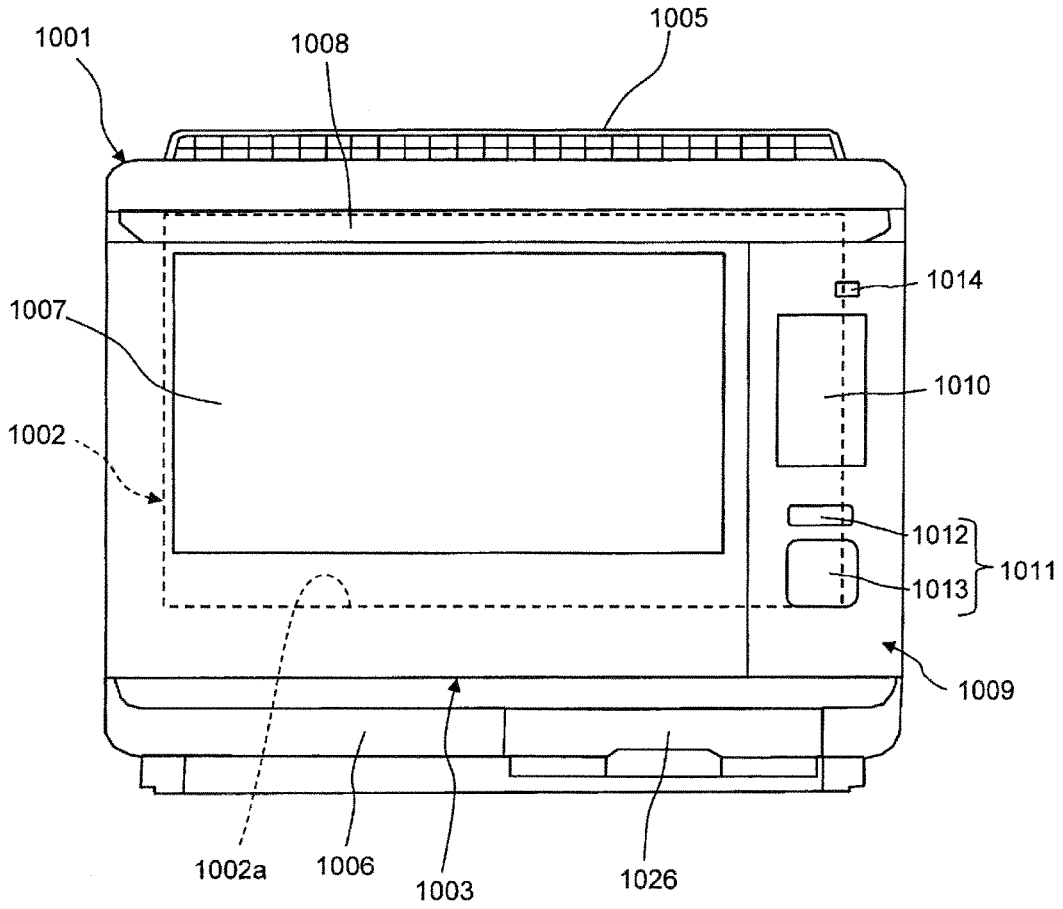
FIG. 22 is a schematic front view of a cooking device according to a fifth embodiment of the invention, with its door closed.
Figure 23:
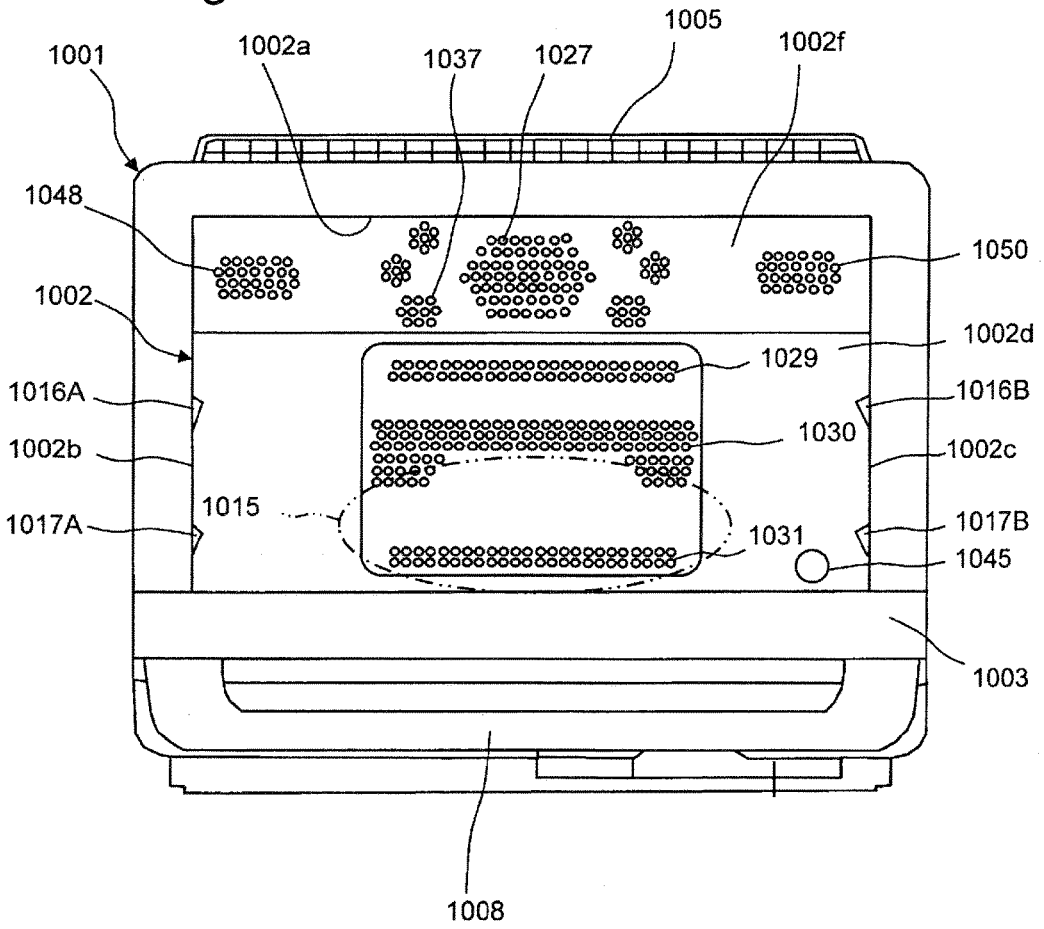
FIG. 23 is a schematic front view of the cooking device of the fifth embodiment, with its door opened.

FIG. 22 is a schematic front view of a cooking device according to a fifth embodiment of the invention with its door closed. FIG. 23 is a schematic front view of the cooking device with its door opened.

As shown in FIGS. 22 and 23, the cooking device includes a rectangular parallelepiped-shaped casing 1001, a heating chamber 1002 provided in the casing 1001 and having an opening 1002*a* on its front side, a door 1003 arranged to open and close the opening 1002*a* of the heating chamber 1002, and a magnetron 1004 (shown in FIG. 26) arranged to supply microwaves into the heating chamber 1002.

An exhaust duct 1005 is provided in rear portion of a top surface of the casing 1001. A dew receiving container 1006 is removably attached in a lower front of the casing 1001. The dew receiving container 1006, located below the door 1003, is enabled to receive water droplets derived from a back face (heating chamber 1002-side surface) of the door 1003. A later-described water supply tank 1026 is also removably attached in the lower front of the casing 1001.

The door 1003 has a lower portion pivotably attached in the front face of the casing 1001. A transparent outer glass 1007 having thermal resistance is provided in a front face (a surface opposite to the heating chamber 1002-side surface) of the door 1003. The door 1003 also has a handle 1008 positioned above the outer glass 1007, and an operation panel 1009 provided on a right side of the outer glass 1007.

The operation panel 1009 has a color LCD (Liquid Crystal Display) part 1010 and a button group 1011. The button group 1011 includes a cancel key 1012 to be pressed for halfway stop of heating or other occasions, and a heating start key 1013 to be pressed for a start of heating. In the operation panel 1009, an infrared ray receiving part 1014 for receiving an infrared ray derived from a smartphone or the like is provided.

A heating object 1015, which is to be heated, is accommodated in the heating chamber 1002. Metallic cooking trays 1091, 1092 (shown in FIG. 24) can be put into and out of the heating chamber 1002. Upper tray holders 1016A, 1016B for supporting the cooking tray 1091 are provided on inner surfaces of a left side portion 1002*b* and a right side portion 1002*c*, respectively, of the heating chamber 1002. Lower tray holders 1017A, 1017B for supporting the cooking tray 1092 are provided on inner surfaces of the left side portion 1002*b* and the right side portion 1002*c*, respectively, of the heating chamber 1002 so as to be positioned below the upper tray holders 1016A, 1016B.

The cooking trays 1091, 1092, when set in the heating chamber 1002, each have a gap to the door 1003 as well as a gap to a rear portion 1002*d* of the heating chamber 1002. More specifically, contact portions (not shown) are provided at rear end portions of the upper tray holders 1016A, 1016B and the lower tray holders 1017A, 1017B, respectively. These contact portions come into contact with the cooking trays 1091, 1092 before those cooking trays 1091, 1092 come into contact with the rear portion 1002*d* of the heating chamber 1002 so that rearward movement of the cooking trays 1091, 1092 is restricted. In this case, a gap of, e.g., 3 mm as a length in the front-and-rear direction may be generated between the cooking trays 1091, 1092 and the rear portion 1002*d* of the heating chamber 1002.

Figure 24:
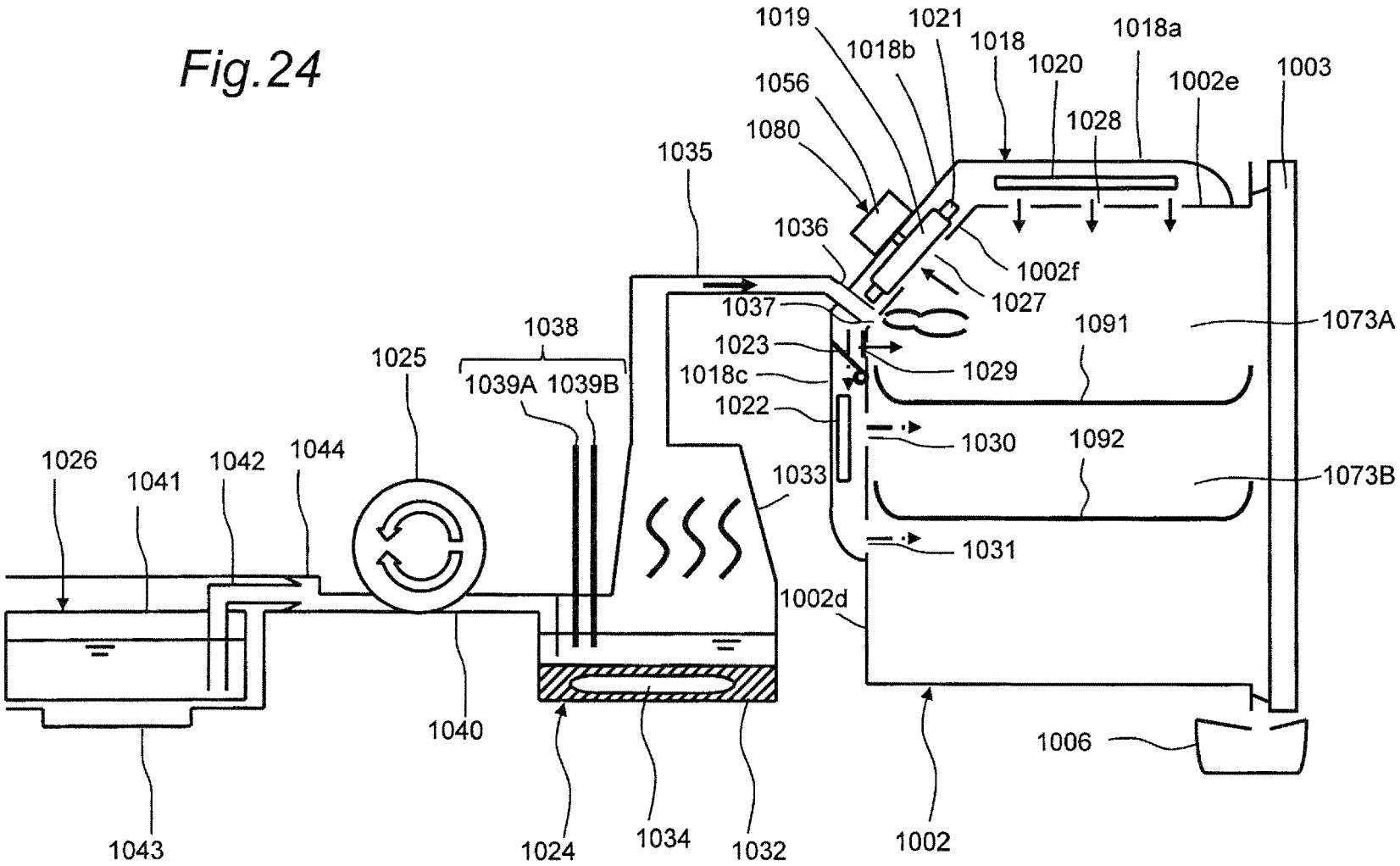
FIG. 24 is a schematic view for explaining a main-part structure of the cooking device of the fifth embodiment.

FIG. 24 is a schematic view for explaining a main-part structure of the cooking device. In this FIG. 24, the heating chamber 1002 is shown as viewed from the left side.

The cooking device includes a circulation duct 1018, an upper heater 1020, a middle heater 1021, a lower heater 1022, a circulation damper 1023, a saturated steam generator 1024, a tube pump 1025, and a water supply tank 1026. These upper heater 1020, middle heater 1021 and lower heater 1022 are provided each as a sheath heater. The upper heater 1020, the middle heater 1021 and the lower heater 1022 are an example of the heater. The circulation damper 1023 is an example of the damper.

An upper portion 1002*e* of the heating chamber 1002 continues to the rear portion 1002*d* of the heating chamber 1002 via a sloped portion 1002*f* sloped relative to a horizontal direction. In the sloped portion 1002*f*, a plurality of suction ports 1027 are provided so as to be opposed to the circulation fan 1019. A plurality of upper blowoff ports 1028 are provided in the upper portion 1002*e* of the heating chamber 1002. First rear blowoff ports 1029, second rear blowoff ports 1030 and third rear blowoff ports 1031 are provided, each in plurality, in the rear portion 1002*d* of the heating chamber 1002. The upper blowoff ports 1028 are an example of the first blowoff port. The first rear blowoff ports 1029 are an example of the second blowoff port. The second and third rear blowoff ports 1030, 1031 are an example of the third blowoff port. The upper blowoff ports 1028 are depicted only three in number in FIG. 24. Only one of the suction ports 1027, one of the first rear blowoff ports 1029, one of the second rear blowoff ports 1030 and one of the third rear blowoff ports 1031 are depicted in FIG. 24. The sloped portion 1002*f* is an example of the corner portion.

When the cooking tray 1091 is set in the heating chamber 1002, the inside of the heating chamber 1002 is partitioned into an upper space 1073A and a lower space 1073B. The suction ports 1027, the upper blowoff ports 1028 and the first rear blowoff ports 1029 are opened each to the upper space 1073A.

When the cooking tray 1092 is further set in the heating chamber 1002, the lower space 1073B is divided into two spaces. In this case, the second rear blowoff ports 1030 are opened to one of the two spaces on the upper side of the cooking tray 1092. Meanwhile, the third rear blowoff ports 1031 are opened to the other of the two spaces on the lower side of the cooking tray 1092.

The circulation duct 1018, which is metallic, is provided outside the heating chamber 1002 so as to be communicated with inside of the heating chamber 1002 via the suction ports 1027, the upper blowoff ports 1028 and the first to third rear blowoff ports 1029 to 1031. The circulation duct 1018 is provided so as to range from upper side to rear side of the heating chamber 1002 and extend in an inverted-L like shape. More specifically, the circulation duct 1018 is composed of a front portion 1018*a* which is opposed to the upper portion 1002*e* of the heating chamber 1002, a connecting portion 1018*b* which extends obliquely downward from a rear end of the upper portion 1002*e* and which is opposed to the sloped portion 1002*f* of the heating chamber 1002, and a rear portion 1018*c* which extends directly downward from a lower end of the connecting portion 1018*b* and which is opposed to the rear portion 1002*d* of the heating chamber 1002. The circulation duct 1018 has a left-right width set narrower than a left-right width of the heating chamber 1002.

A circulation fan unit 1080 includes the circulation fan 1019, and a circulation fan motor 1056 provided as, e.g., a DC motor to drive the circulation fan 1019. The circulation fan unit 1080 is removably attached to the circulation duct 1018 so as to be opposed to the sloped portion 1002*f* of the heating chamber 2. The circulation fan motor 1056 is an example of the motor.

The circulation fan 1019 is placed in the circulation duct 1018 so as to be opposed to the sloped portion 1002*f*. More specifically, the circulation fan 1019, provided as a forward-and-reverse rotatable centrifugal fan, is placed in the connecting portion 1018*b* of the circulation duct 1018. As the circulation fan 1019 is rotated, air and saturated steam and the like (hereinafter, referred to as 'air and the like') within the heating chamber 1002 are sucked through the suction ports 1027 into the circulation duct 1018, then allowed to flow radially outward of the circulation fan 1019. More specifically, on the upper side of the circulation fan 1019, air and the like are allowed to flow obliquely upward from the circulation fan 1019 and then flow from rear toward front. On the lower side of the circulation fan 1019, on the other hand, air and the like are allowed to flow obliquely downward from the circulation fan 1019 and then flow from above toward below. That is, the circulation fan 1019 feeds air and the like to the upper heater 1020, the middle heater 1021 and the lower heater 1022. In addition, the air and the like are an example of the heat medium.

The upper heater 1020 is placed within the front portion 1018*a* of the circulation duct 1018 and opposed to the upper portion 1002*e* of the heating chamber 1002. The upper heater 1020 heats air and the like flowing to the upper blowoff ports 1028.

The middle heater 1021 is formed into such an annular shape as to surround the circulation fan 1019. The middle heater 1021 heats air and the like flowing from the circulation fan 1019 toward the upper heater 1020 or heats air and the like flowing from the circulation fan 1019 toward the lower heater 1022.

The lower heater 1022 is placed within the rear portion 1018*c* of the circulation duct 1018 and opposed to the rear portion 1002*d* of the heating chamber 1002. The lower heater 1022 heats air and the like flowing to the second and third rear blowoff ports 1030, 1031.

The circulation damper 1023 opens and closes the first rear blowoff ports 1029. More specifically, the circulation damper 1023 is pivotably provided within the circulation duct 1018 and positioned between the middle heater 1021 and the lower heater 1022. Pivoting of the circulation damper 1023 is performed by a circulation damper motor 1059 (shown in FIG. 26). Pivoting of the circulation damper 1023 causes the first rear blowoff ports 1029 to be opened and closed.

The circulation damper 1023, when having opened the first rear blowoff ports 1029, closes a range between the circulation fan 1019 and the second rear blowoff ports 1030. As a result of this, the first rear blowoff ports 1029 are allowed to blow off air and the like heated by the middle heater 1021 into the heating chamber 1002, whereas the second and third rear blowoff ports 1030, 1031 are no longer allowed to blow off air and the like heated by the middle heater 1021 into the heating chamber 1002.

The circulation damper 1023, when having closed the first rear blowoff ports 1029, opens the range between the circulation fan 1019 and the second rear blowoff ports 1030. As a result of this, the first to third rear blowoff ports 1029 to 1031 are allowed to blow off air and the like heated by the middle heater 1021 into the heating chamber 1002.

The first rear blowoff ports 1029 are positioned above the gap between the cooking tray 1091 and the rear portion 1002*d* of the heating chamber 1002 and moreover near the rear portion of the cooking tray 1091. The inside of the heating chamber 1002 is communicated with inside of the rear portion 1018*c* of the circulation duct 1018 via the first rear blowoff ports 1029.

The saturated steam generator 1024 includes a metallic container 32 having an upper-end opening, a resin-made lid 1033 for closing the opening, and a steam-generating heater 1034 cast into a bottom portion of the container 1032 and provided as a sheath heater. Water derived from the water supply tank 1026 accumulates on the bottom portion of the container 1032, and the water is heated by the steam-generating heater 1034 via the bottom portion of the container 1032. Saturated steam generated by this heating flows through a resin-made steam tube 1035 and a metallic steam tube 1036 so as to be supplied into the connecting portion 1018*b* of the circulation duct 1018. In this case, with the circulation fan 1019 in a driven state, the saturated steam derived from the saturated steam generator 1024 is fed toward the front portion 1018*a* of the circulation duct 1018 and the rear portion 1002*d*. With the circulation fan 1019 in a non-driven state, the saturated steam derived from the saturated steam generator 1024 flows out into the heating chamber 1002 via a plurality of steam supply ports 1037. Only one of the steam supply ports 1037 is depicted in FIG. 24.

The steam tube 1036 is attached to the connecting portion 1018*b* of the circulation duct 1018. The steam tube 1036 blows off saturated steam derived from the saturated steam generator 1024 to the downstream side of the circulation fan 1019 within the circulation duct 1018. While the circulation fan 1019 is at rest, saturated steam blown off from the steam tube 1036 is allowed to flow directly into the heating chamber 1002 without passing via the upper heater 1020, the middle heater 1021 and the lower heater 1022. That is, a gap is provided between a heating chamber 1002-side end of the steam tube 1036 and the sloped portion 1002*f*, and the steam supply ports 1037 opposed to the heating chamber 1002-side end of the steam tube 1036 are provided in the sloped portion 1002*f*.

The saturated steam blown off from the steam tube 1036 or the saturated steam within the heating chamber 1002 is fed by the circulation fan 1019 to the upper heater 1020, the middle heater 1021 and the lower heater 1022, where the saturated steam is heated by the upper heater 1020, the middle heater 1021 and the lower heater 1022 so that the saturated steam can be formed into superheated steam of 100° C. or higher.

In the lid 1033, a water level sensor 1038 composed of a pair of electrodes 1039A, 1039B is attached. Based on whether there has arisen an electrical continuity between these electrodes 1039A, 1039B, it is decided whether or not the water level on the bottom portion of the container 1032 has reached a specified level.

The tube pump 1025 operates so that a water supply/drain tube 1040 made from silicone rubber or the like and elastically deformable is squeezed by a roller (not shown), causing water in the water supply tank 1026 to flow to the saturated steam generator 1024 or causing the water in the saturated steam generator 1024 to flow to the water supply tank 1026.

The water supply tank 1026 has a water supply tank body 1041 and a communicating tube 1042. The communicating tube 1042 has one end portion positioned within the water supply tank body 1041 and the other end portion positioned outside the water supply tank 1026. As the water supply tank 1026 is accommodated in a tank cover 1043, the other end portion of the communicating tube 1042 is connected to the water supply/drain tube 1040 via a tank joint portion 1044. That is, inside of the water supply tank body 1041 is communicated with inside of the saturated steam generator 1024 via the communicating tube 1042 or the like.

Figure 25:
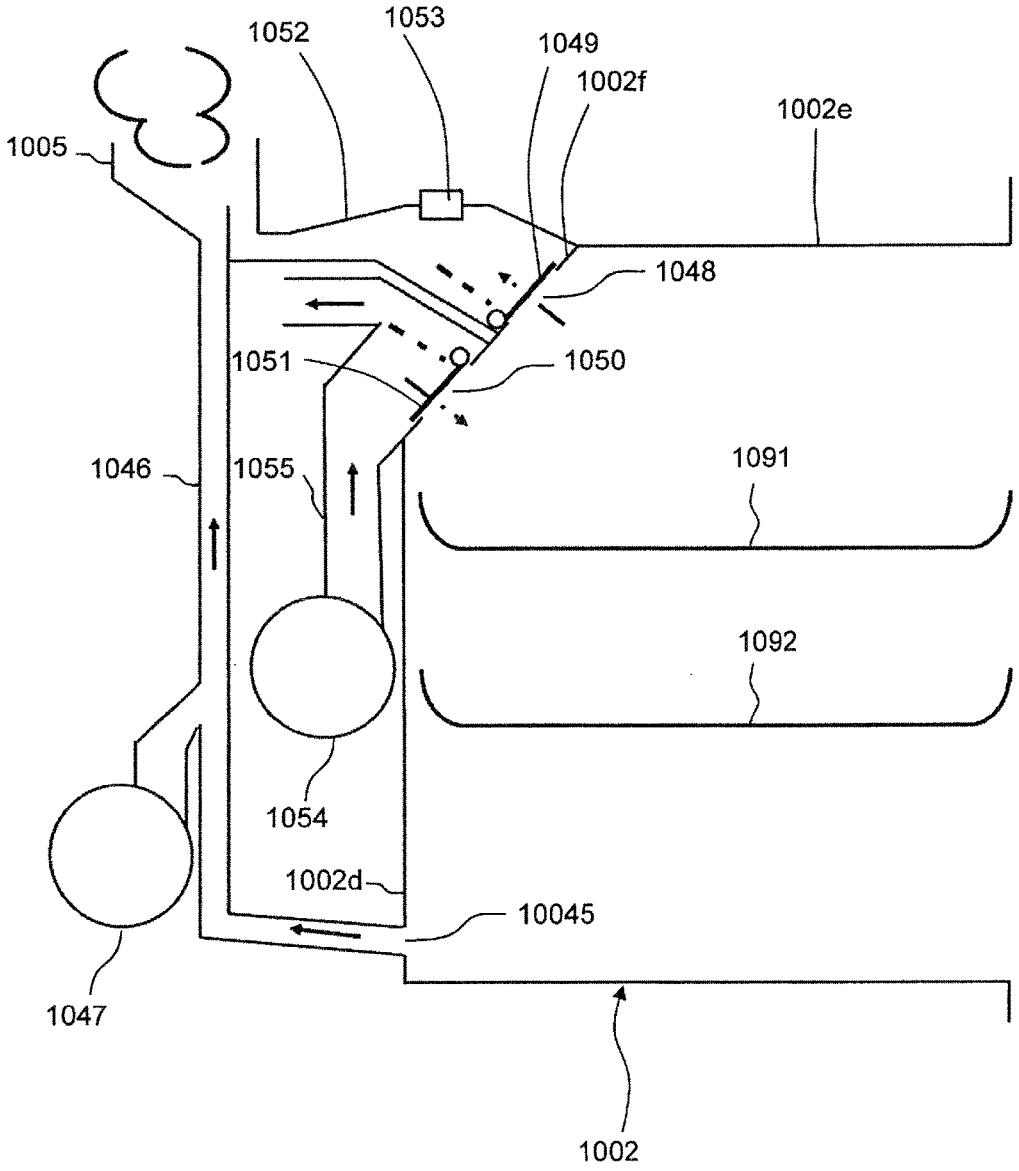
FIG. 25 is a schematic view for explaining a structure of other part of the cooking device of the fifth embodiment.

FIG. 25 is a schematic view for explaining a structure of other part of the cooking device. Also in FIG. 25, the heating chamber 1002 is shown as viewed from the left side as in FIG. 24.

A natural exhaust port 1045 is provided at a lower end portion of the rear portion 1002*d* of the heating chamber 1002. The natural exhaust port 1045 is communicated with an exhaust duct 1005 via a first exhaust path 1046. When air and the like within the heating chamber 1002 has come to an excessive level, excess air or the like naturally flows out through the natural exhaust port 1045 to the first exhaust path 1046. An exhaust fan 1047 provided as a multiblade fan as an example is connected to the first exhaust path 1046.

A plurality of forced exhaust ports 1048 to be opened and closed by an exhaust damper 1049 as well as a plurality of air supply ports 1050 to be opened and closed by an air supply damper 1051 are provided in the sloped portion 1002*f* of the heating chamber 1002. These forced exhaust ports 1048 are communicated with the exhaust duct 1005 via a second exhaust path 1052. Meanwhile, the air supply ports 1050 are communicated with a space between the casing 1001 and the heating chamber 1002 via an air supply path. An air supply fan 1054 provided as a multiblade fan as an example is connected to an air supply path 1055. Only one of the forced exhaust ports 1048 and one of the air supply ports 1050 are depicted exaggeratedly largely in FIG. 25.

A steam sensor 1053 is attached on the second exhaust path 1052. The steam sensor 1053 delivers a signal indicative of a steam level flowing through the second exhaust path 1052 to a control unit 1100 (shown in FIG. 26).

For forced exhaust of air and the like from within the heating chamber 1002 out of the casing 1001, the exhaust damper 1049 and the air supply damper 1051 are pivoted to positions indicated by two-dot chain line by an exhaust damper motor 1060 and an air supply damper motor 1061 (shown in FIG. 26), respectively. That is, the exhaust damper 1049 and the air supply damper 1051 are opened. Then, the exhaust fan 1047 and the air supply fan 1054 are driven by an exhaust fan motor 1057 and an air supply fan motor 1058 (shown in FIG. 26). As a result of this, air and the like within the heating chamber 1002 are drawn out of the heating chamber 1002 through the forced exhaust ports 1048 and the natural exhaust port 1045.

For cooling of the magnetron 1004 or the like between the casing 1001 and the heating chamber 1002, the air supply fan 1054 is driven with the air supply damper 1051 closed. As a result of this, air blown off from the air supply fan 1054 is supplied to the space between the casing 1001 and the heating chamber 1002 via the air supply path 1055.

Figure 26:
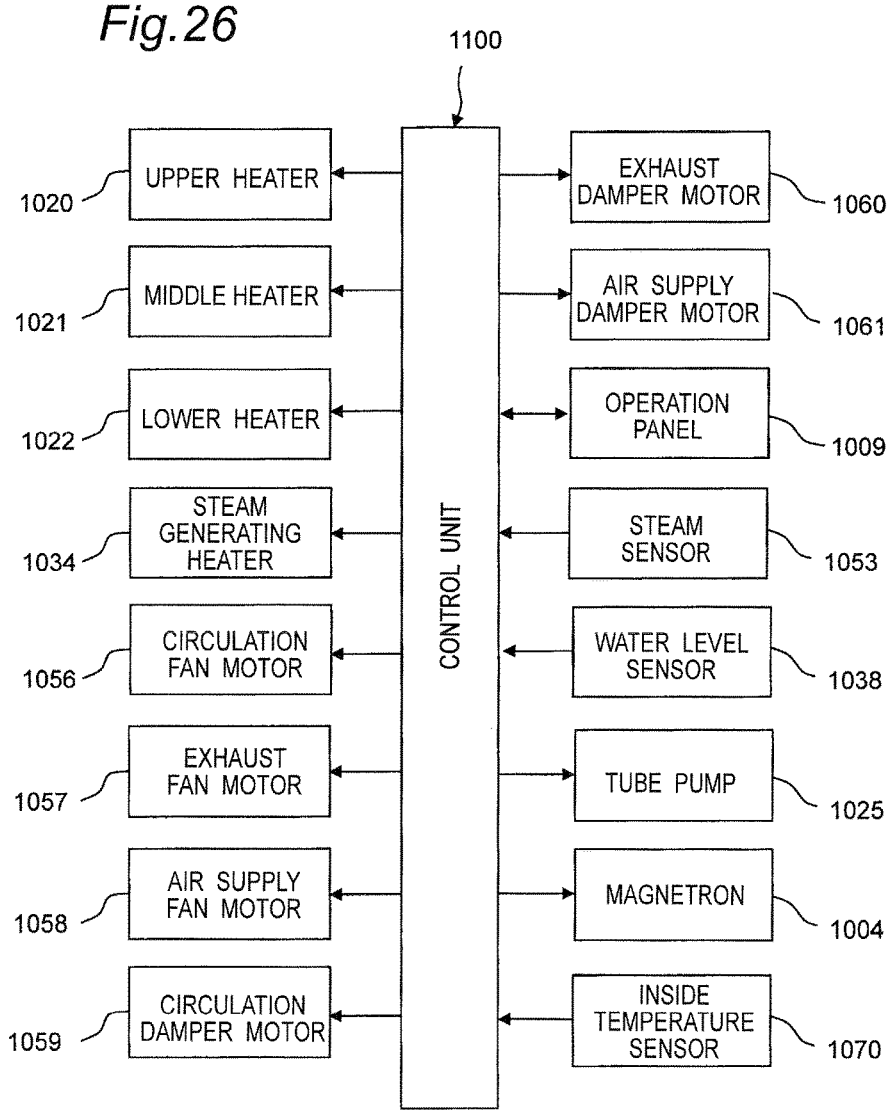
FIG. 26 is a control block diagram of the cooking device according to the fifth embodiment.

FIG. 26 is a control block diagram of the cooking device.

The cooking device includes a control unit 1100 composed of a microcomputer, input/output circuits, and the like. Connected to the control unit 1100 are the upper heater 1020, the middle heater 1021, the lower heater 1022, the steam-generating heater 1034, the circulation fan motor 1056, the exhaust fan motor 1057, the air supply fan motor 1058, the circulation damper motor 1059, the exhaust damper motor 1060, the air supply damper motor 1061, the operation panel 1009, the steam sensor 1053, the water level sensor 1038, the tube pump 1025, the magnetron 1004, an inside temperature sensor 1070, and the like. Based on signals derived from the operation panel 1009, the steam sensor 1053, the water level sensor 1038, the inside temperature sensor 1070 and the like, the control unit 1100 controls the upper heater 1020, the middle heater 1021, the lower heater 1022, the steam-generating heater 1034, the circulation fan motor 1056, the exhaust fan motor 1057, the air supply fan motor 1058, the circulation damper motor 1059, the exhaust damper motor 1060, the air supply damper motor 1061, the tube pump 1025, and the like. The inside temperature sensor 1070 is an example of the temperature sensor.

The inside temperature sensor 1070 is a sensor for detecting a temperature inside the heating chamber 1002. The inside temperature sensor 1070 is placed near the circulation fan 1019 of the circulation fan 1019 to detect a temperature inside the connecting portion 1018*b* of the circulation duct 1018. A temperature inside the connecting portion 1018*b* of the circulation duct 1018 becomes generally equal to a temperature inside the heating chamber 1002 due to the drive of the circulation fan 1019.

Figure 27:
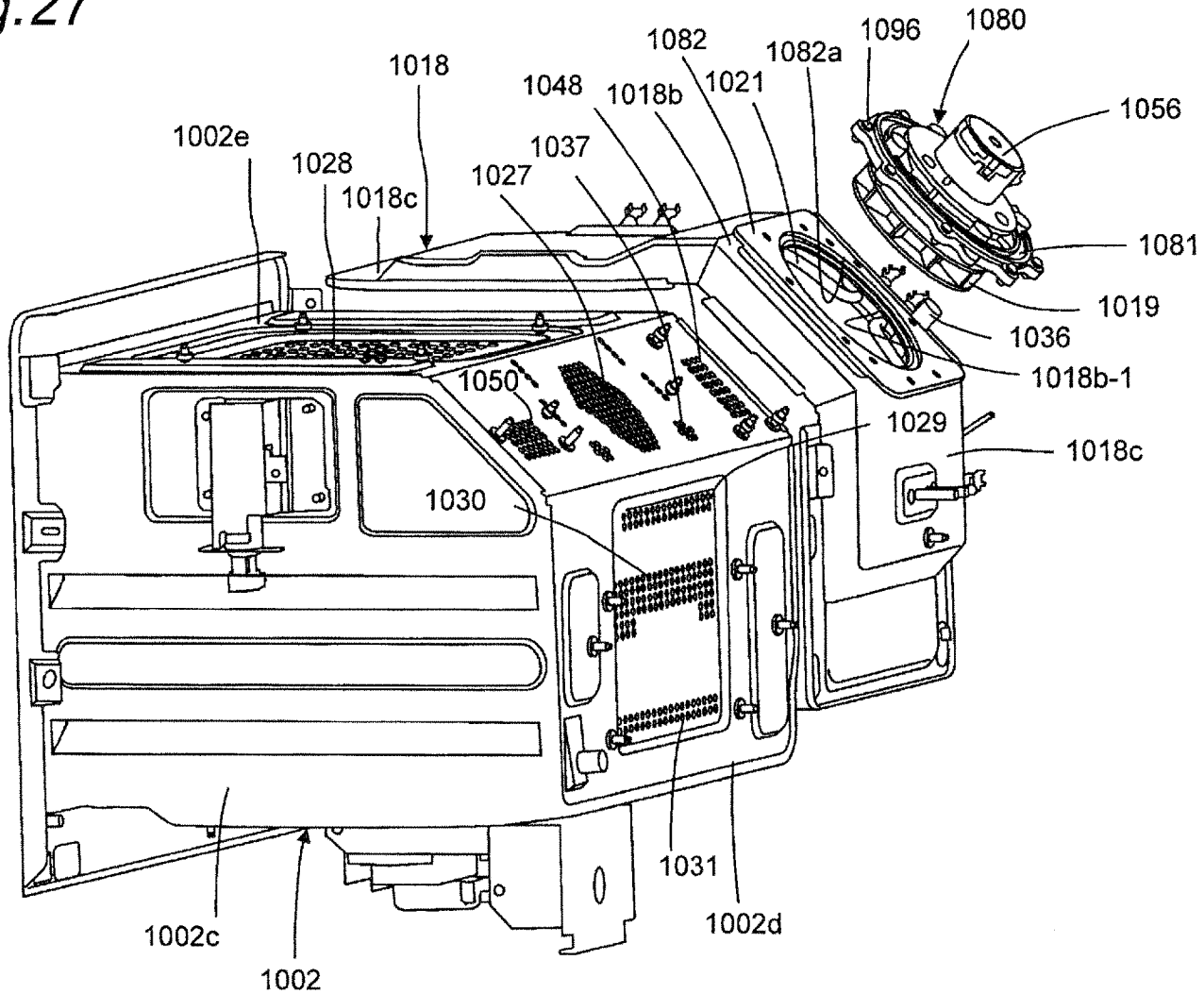
FIG. 27 is an exploded perspective view of a main part of the cooking device of the fifth embodiment.
Figure 28:
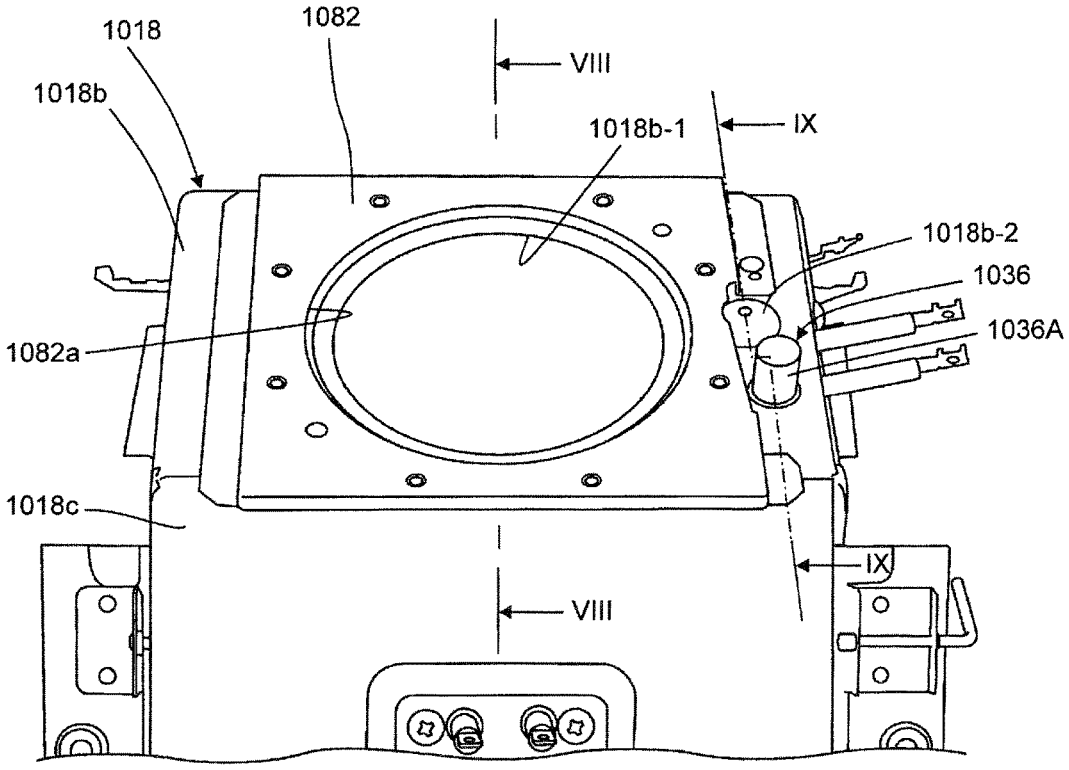
FIG. 28 is a schematic rear view of part of the circulation duct in the cooking device of the fifth embodiment.

FIG. 27 is an exploded perspective view of the heating chamber 1002, the circulation duct 1018 and the circulation fan unit 1080 as viewed from an oblique right-sided upward in the rearward. FIG. 28 is a schematic view of the connecting portion 1018*b* and the rear portion 1018*c* of the circulation duct 1018 as viewed from the rearward.

As shown in FIGS. 27 and 28, the circulation fan unit 1080 is attached to the connecting portion 1018*b* of the circulation duct 1018 via a metallic attachment member 1082. More specifically, an opening 1018*b*-1 which allows the circulation fan 1019 to pass through is provided in the connecting portion 1018*b* of the circulation duct 1018. The attachment member 1082 has an opening 1082*a* which is to overlap with the opening 1018*b*-1. By crimping of an inner-peripheral edge portion of the opening 1018*b*-1, the attachment member 1082 is fixed to the connecting portion 1018*b* of the circulation duct 1018. Then, the circulation fan unit 1080 is fixed to the attachment member 1082 with screws 1096. Loosening the screws 1096 allows the circulation fan unit 1080 to be separated from the attachment member 1082.

Figure 29:
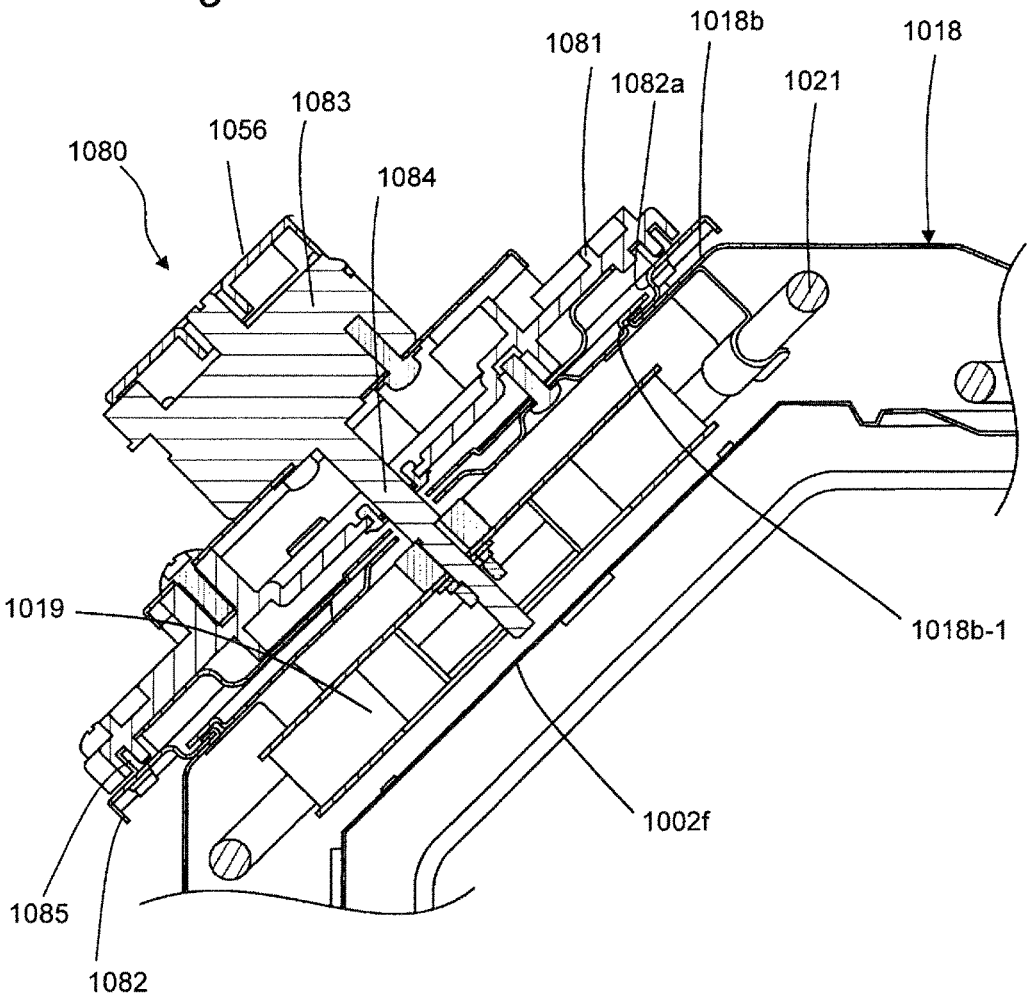
FIG. 29 is a schematic sectional view taken along the line VIII-VIII of FIG. 28.

FIG. 29 is a schematic sectional view taken along the line VIII-VIII of FIG. 28. FIG. 29 also shows a schematic cross section of the circulation fan unit 1080.

The circulation fan unit 1080 has a base member 1081 on which the circulation fan motor 1056 is to be mounted. The circulation fan motor 1056 includes a motor body 1083 and a rotating shaft 1084 projecting from a base member 1081-side end face of the motor body 1083, the rotating shaft 1084 extending through the base member 1081. A tip end portion of the rotating shaft 1084 extends into the connecting portion 1018*b* of the circulation duct 1018 so as to be connected to the circulation fan motor 1056.

A seal member 1085 is placed between the circulation fan unit 1080 and the attachment member 1082. More specifically, the seal member 1085 is so placed as to surround the openings 1018*b*-1, 1082*a* and seal a gap between the base member 1081 and the attachment member 1082. In this case, the attachment member 1082 is formed in such fashion that a space is generated between the circulation duct 1018 and a contact portion of the attachment member 1082 with the seal member 1085.

Figure 30:
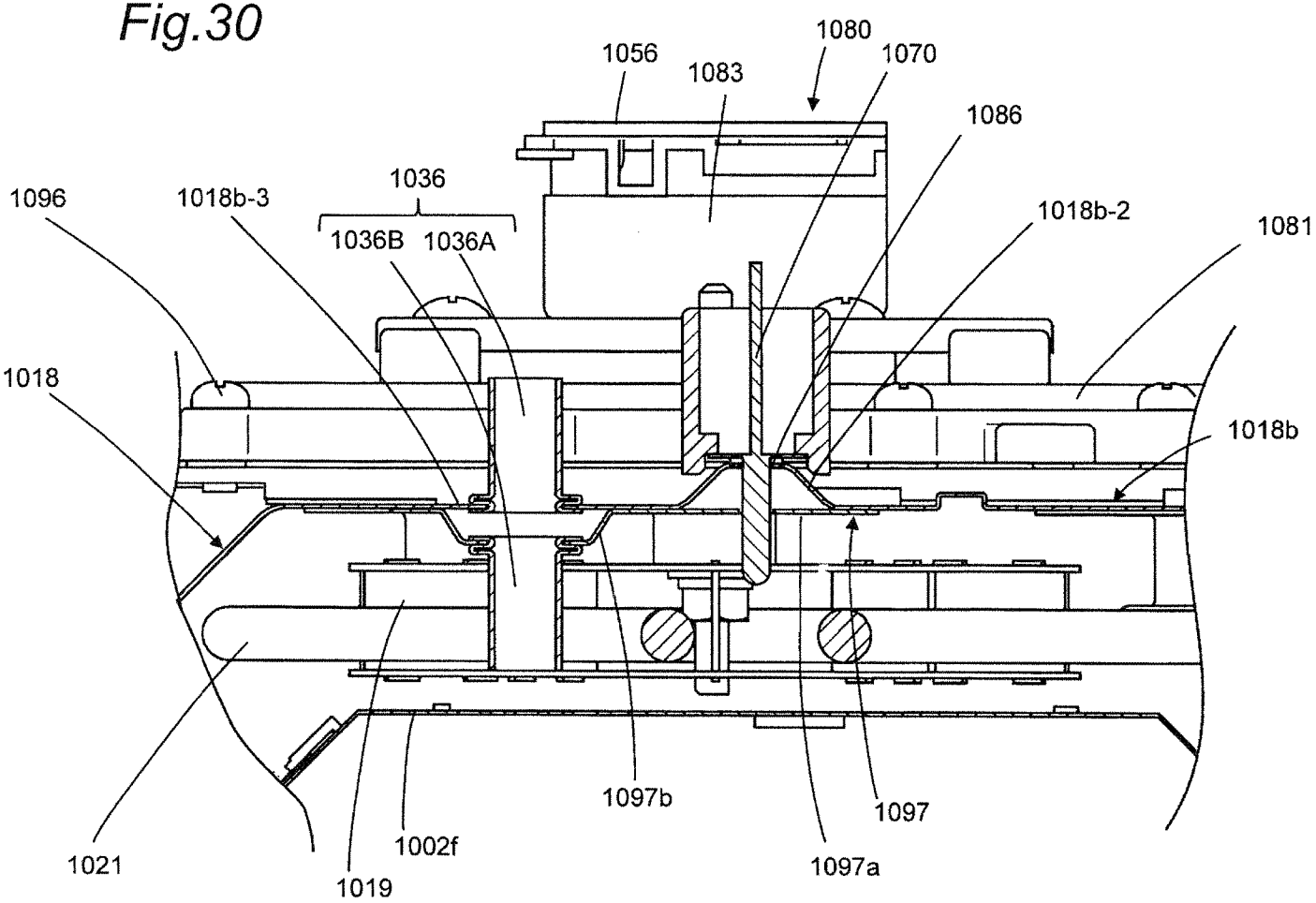
FIG. 30 is a schematic sectional view taken along the line IX-IX of FIG. 28.

FIG. 30 is a schematic sectional view taken along the line IX-IX of FIG. 28. FIG. 30 also shows a schematic cross section of the circulation fan unit 1080.

An attachment portion 1018*b*-2 at which the inside temperature sensor 1070 is to be attached is provided in the connecting portion 1018*b* of the circulation duct 1018. A gap between the connecting portion 1018*b* and the inside temperature sensor 1070 is sealed by the resin-made seal member 1086. In this case, the seal member 1086 is in contact with the attachment portion 1018*b*-2. A metallic heat shielding plate 1097 is welded at an inner surface of the connecting portion 1018*b*. The heat shielding plate 1097 has an opposed portion 1097*a* opposed to the attachment portion 1018*b*-2.

The attachment portion 1018*b*-2 and the opposed portion 1097*a* are formed in such fashion that a space is generated between the attachment portion 1018*b*-2 of the connecting portion 1018*b* and the opposed portion 1097*a* of the heat shielding plate 1097. More concretely, the attachment portion 1018*b*-2 is formed so as to project on one side opposite to the heating chamber 1002 side. As a result, a space is generated between the attachment portion 1018*b*-2 and the opposed portion 1097*a*.

The steam tube 1036 has a metallic first steam tube 1036A placed outside the circulation duct 1018, and a metallic second steam tube 1036B placed within the circulation duct 1018 and communicated with the first steam tube 1036A. The first steam tube 1036A is attached to the attachment portion 1018*b*-3 provided in the connecting portion 1018*b* of the circulation duct 1018. In this case, the attachment of the first steam tube 1036A is fulfilled, for example, by crimping a second steam tube 1036B-side end portion of the first steam tube 1036A. Meanwhile, the second steam tube 1036B is attached to an attachment portion 1097*b* provided in the heat shielding plate 1097. In this case, the attachment of the second steam tube 1036B is fulfilled, for example, by crimping a first steam tube 1036A-side end portion of the second steam tube 1036B. A gap is provided between the heating chamber 1002-side end of the second steam tube 1036B and the sloped portion 1002*f*. In addition, the attachment portion 1018*b*-3 is an example of the first attachment portion. The attachment portion 1097*b* is an example of the second attachment portion.

The attachment portions 1018*b*-3, 1097*b* are formed in such fashion that a space is generated between the second steam tube 1036B-side end of the first steam tube 1036A and the first steam tube 1036A-side end of the second steam tube 1036B. More concretely, the attachment portion 1097*b* is formed so as to project toward the heating chamber 1002 side. As a result of this, a space is generated between the second steam tube 1036B-side end of the first steam tube 1036A and the first steam tube 1036A-side end of the second steam tube 1036B.

According to the cooking device having the above constitution, the sloped portion 1002*f* of the heating chamber 1002, while being sloped relative to the horizontal direction, connects the upper portion 1002*e* of the heating chamber 1002 and the rear portion 1002*d* of the heating chamber 1002 to each other. The circulation fan 1019 is placed in the connecting portion 1018*b* of the circulation duct 1018 so as to be opposed to the sloped portion 1002*f* of the heating chamber 2. As a result of this, the distance between the rear portion 1002*d* of the heating chamber 1002 and the rear portion of the casing 1001 can be made shorter than when the circulation fan 1019 is placed in the rear portion 1018*c* of the circulation duct 1018 so as to be opposed to the rear portion 1002*d* of the heating chamber 1002. Thus, the casing 1001 can be downsized.

Since the circulation fan 1019 is placed in the connecting portion 1018*b* of the circulation duct 1018 so as to be opposed to the sloped portion 1002*f* of the heating chamber 2, increases in the height of the casing 1001 can be suppressed.

Since the sloped portion 1002*f* of the heating chamber 2, while being sloped relative to the horizontal direction, connects the upper portion 1002*e* of the heating chamber 1002 and the rear portion 1002*d* of the heating chamber 1002 to each other, the capacity of the heating chamber 1002 can be made smaller than when the sloped portion 1002*f* is not provided in the heating chamber 1002. Thus, the temperature inside the heating chamber 1002 can be raised in shorter time.

The upper space 1073A in the heating chamber 1002 is a narrow space, compared with the whole space inside the heating chamber 1002. The suction ports 1027, the upper blowoff ports 1028 and the first rear blowoff ports 1029 are each opened to the upper space 1073A. As a result of this, the circulation of air and the like can be concentrated to the upper space 1073A, so that the upper space 1073A can be warmed in shorter time. Thus, own the heating object 1015 is placed in the upper space 1073A, the time required for heating of the heating object 1015 can be reduced. That is, the heating object 1015 can be heated with higher efficiency.

The circulation damper 1023, when having opened the first rear blowoff ports 1029, closes the gap between the circulation fan 1019 and the second and third rear blowoff ports 1030, 1031. Therefore, air and the like heated by the middle heater 1021 can be kept from flowing to the second and third rear blowoff ports 1030, 1031, so that decreases in the heating efficiency of the upper space 1073A in the heating chamber 1002 can be prevented.

The circulation damper 1023, when having closed the first rear blowoff ports 1029, opens the gap between the circulation fan 1019 and the second and third rear blowoff ports 1030, 1031. Therefore, air and the like heated by the middle heater 1021 and the lower heater 1022 are allowed to flow to the second and third rear blowoff ports 1030, 1031. Thus, the heating object 1015 placed in the lower space 1073B in the heating chamber 1002 can be heated.

By controlling the opening and closing of the circulation damper 1023, the temperature of the lower space 1073B can be made different from the temperature of the upper space 1073A. Therefore, it becomes implementable, for example, to perform a cooking with relatively high-temperature heating in the upper space 1073A while performing a cooking with relatively low-temperature heating in the lower space 1073B.

For implementation of heating cookings in the upper space 1073A and the lower space 1073B with the temperature of the upper space 1073A and the temperature of the lower space 1073B different from each other, a temperature sensor for detecting the temperature of the lower space 1073B may be provided independent of the inside temperature sensor 1070.

Since the steam tube 1036 blows off saturated steam derived from the saturated steam generator 1024 toward the downstream side of the circulation fan 1019 in the connecting portion 1018*b* of the circulation duct 1018, the saturated steam derived from the saturated steam generator 1024 can be prevented from condensing due to contact with the circulation fan 1019. Thus, saturated steam can be supplied into the heating chamber 1002 with high efficiency.

The steam tube 1036 is provided in a portion of the circulation duct 1018 opposed to the sloped portion 1002*f*, and the circulation fan 1019 is a centrifugal fan rotatable forward and reverse. As a result of this, with the circulation fan 1019 rotated forward, the quantity of saturated steam flowing to the upper side of the circulation fan 1019 can be increased, compared with the quantity of saturated steam flowing to the lower side of the circulation fan 1019.

Meanwhile, with the circulation fan 1019 rotated reverse, the quantity of saturated steam flowing to the lower side of the circulation fan 1019 can be increased, compared with the quantity of saturated steam flowing to the upper side of the circulation fan 1019.

The steam supply ports 1037 opposed to the heating chamber 1002-side end of the steam tube 1036 are provided in the sloped portion 1002*f*. As a result of this, with the circulation fan 1019 at rest, saturated steam blown off from the steam tube 1036 can securely be let to flow into the heating chamber 1002 directly without passing via the upper heater 1020, the middle heater 1021 and the lower heater 1022.

A gap is provided between the heating chamber 1002-side end of the second steam tube 1036B and the sloped portion 1002*f*. Therefore, with the circulation fan 1019 rotating, saturated steam can be drawn out from within the gap as to be let to flow to the upper side of the circulation fan 1019 or to the lower side of the circulation fan 1019.

The circulation fan unit 1080 is removably attached to the connecting portion 1018*b* of the circulation duct 1018. Therefore, the circulation fan unit 1080 can be removed from the connecting portion 1018*b* of the circulation duct 1018, thus facilitating the maintenance of the unit.

The circulation fan unit 1080 includes the circulation fan 1019, and the circulation fan motor 1056 for driving the circulation fan 1019. The circulation fan unit 1080 is attached to the connecting portion 1018*b* of the circulation duct 1018 so as to be opposed to the sloped portion 1002*f* of the heating chamber 2. As a result of this, an effect of reducing the distance between the rear portion 1002*d* of the heating chamber 1002 and the rear portion of the casing 1001 as well as an effect of suppressing increase in the height of the casing 1001 can be enhanced.

The attachment member 1082 is so formed that a space is generated between the circulation duct 1018 and a portion of the attachment member 1082 in contact with the seal member 1085. As a result of this, when the temperature inside the connecting portion 1018*b* of the circulation duct 1018 comes to about 300° C., the temperature of the seal member 1085 can be made to be about 170° C. Therefore, the seal member 1085 may be provided by not using a high-priced seal member of relatively high thermal resistance but using a low-priced seal member of relatively low thermal resistance (e.g., silicone rubber packing).

Since the inside temperature sensor 1070 is placed near the circulation fan 1019 of the circulation fan unit 1080, temperatures equal or generally equal to temperatures of inside of the heating chamber 1002 can be detected.

The attachment portion 1018*b*-2 is formed so as to project on one side opposite to the heating chamber 1002 side, causing a space to be generated between the attachment portion 1018*b*-2 and the opposed portion 1097*a*. As a result of this, when the temperature inside the connecting portion 1018*b* of the circulation duct 1018 comes to about 300° C., the temperature of the seal member 1086 can be made to be about 180° C. Therefore, the seal member 1086 may be provided by not using a high-priced seal member of relatively high thermal resistance but using a low-priced seal member of relatively low thermal resistance (e.g., silicone rubber packing).

The attachment portion 1097*b* is formed so as to project toward the heating chamber 1002 side, so that a space is generated between the second steam tube 1036B-side end of the first steam tube 1036A and the first steam tube 1036A-side end of the second steam tube 1036B. As a result of this, when the temperature inside the connecting portion 1018*b* of the circulation duct 1018 comes to about 300° C., the temperature of an outer-side (a side opposite to the second steam tube 1036B side) end portion of the first steam tube 1036A can be made to be about 180° C. Therefore, the steam tube 1035 having one end portion connected to the outer-side end portion of the first steam tube 1036A may be provided by not using a high-priced steam tube of relatively high thermal resistance but using a low-priced steam tube of relatively low thermal resistance.

In the fifth embodiment, the circulation damper 1023 for opening and closing the first rear blowoff ports 1029 is provided in the circulation duct 1018. Instead, the circulation damper 1023 may be non-provided.

In the fifth embodiment, the circulation duct 1018 is provided so as to range from the upper side to the rear side of the heating chamber 1002. Instead, the circulation duct may be provided so as to range from the upper side to the right lateral side or the left lateral side of the heating chamber 1002.

In the fifth embodiment, the circulation fan 1019 may be provided, for example, as a multiblade fan or a turbofan. In such a case, the multiblade fan or the turbofan may have a plurality of blades provided along its peripheral edge portion, each of the blades being generally parallel (including complete parallel) to the radial direction.

In the fifth embodiment, the sloped portion 1002*f* is provided between the upper portion 1002*e* of the heating chamber 1002 and the rear portion 1002*d* of the heating chamber 1002. Alternatively, the sloped portion 1002*f* may be provided between the upper portion 1002*e* of the heating chamber 1002 and the left side portion 1002*b* or right side portion 1002*c* of the heating chamber 1002. That is, a corner portion for connecting the upper portion of the heating chamber and the left side portion or rear side portion of the heating chamber to each other may be sloped relative to the horizontal direction.

In the fifth embodiment, the attachment portion 1018*b*-2 of the connecting portion 1018*b* is formed so as to project on one side opposite to the heating chamber 1002 side. Alternatively, the attachment portion 1018*b*-2 of the connecting portion 1018*b* may be provided as a flat portion like the attachment portion 1018*b*-3 and moreover the opposed portion 1097*a* of the heat shielding plate 1097 may be formed so as to project toward the heating chamber 1002 side. Otherwise, the attachment portion 1018*b*-2 of the connecting portion 1018*b* may be formed so as to project toward one side opposite to the heating chamber 1002 side and moreover the opposed portion 1097*a* of the heat shielding plate 1097 may be formed so as to project toward the heating chamber 1002 side.

In the fifth embodiment, the attachment portion 1097*b* of the heat shielding plate 1097 is formed so as to project toward the heating chamber 1002 side. However, the attachment portion 1097*b* of the heat shielding plate 1097 may be provided as a flat portion like the opposed portion 1097*a*, and moreover the attachment portion 1018*b*-3 of the connecting portion 1018*b* may be provided so as to project toward one side opposite to the heating chamber 1002 side. Otherwise, the attachment portion 1097*b* of the heat shielding plate 1097 may be formed so as to project toward the heating chamber 1002 side, and moreover the attachment portion 1018*b*-3 of the connecting portion 1018*b* may be formed so as to project toward one side opposite to the heating chamber 1002 side.

In the fifth embodiment, a gap is provided between the heating chamber 1002-side end of the second steam tube 1036B and the sloped portion 1002*f*. Alternatively, a heating chamber 1002-side end portion of the second steam tube 1036B may be provided so as to extend through the sloped portion 1002*f*. In such a case, a singularity or plurality of openings that are opened into the connecting portion 1018*b* of the circulation duct 1018 may be provided halfway on the second steam tube 1036B. With those openings provided halfway on the second steam tube 1036B, saturated steam in the second steam tube 1036B can be drawn out into the connecting portion 1018*b* of the circulation duct 1018 via the openings by the rotation of the circulation fan 1019. Moreover, saturated steam can be supplied from the second steam tube 1036B into the heating chamber 1002.

In the cooking device disclosed in JP 2014-31948 A, a general DC (Direct Current) motor may be used as the circulation fan motor. In this case, when the DC motor is controlled with pulse waves, the duty ratio for obtaining a specified reference rotating speed may vary within a range of ±10% depending on solid bodies of the DC motor.

Accordingly, associating menus to the duty ratios in units of 10% may cause a problem that a desired cooking result of a particular menu cannot be obtained.

Under control of the DC motor with pulse waves, such a problem would be solved by detecting a rotating speed of the DC motor and performing feedback control based on the detected rotating speed. However, an increased control burden would be involved.

Accordingly, an object of the invention is to provide cooking devices capable of securely obtaining a desired cooking result of a menu and moreover preventing increases in control burden.

Hereinbelow, a cooking device for solving the above problem will be described.

(Sixth Embodiment)

Figure 31:
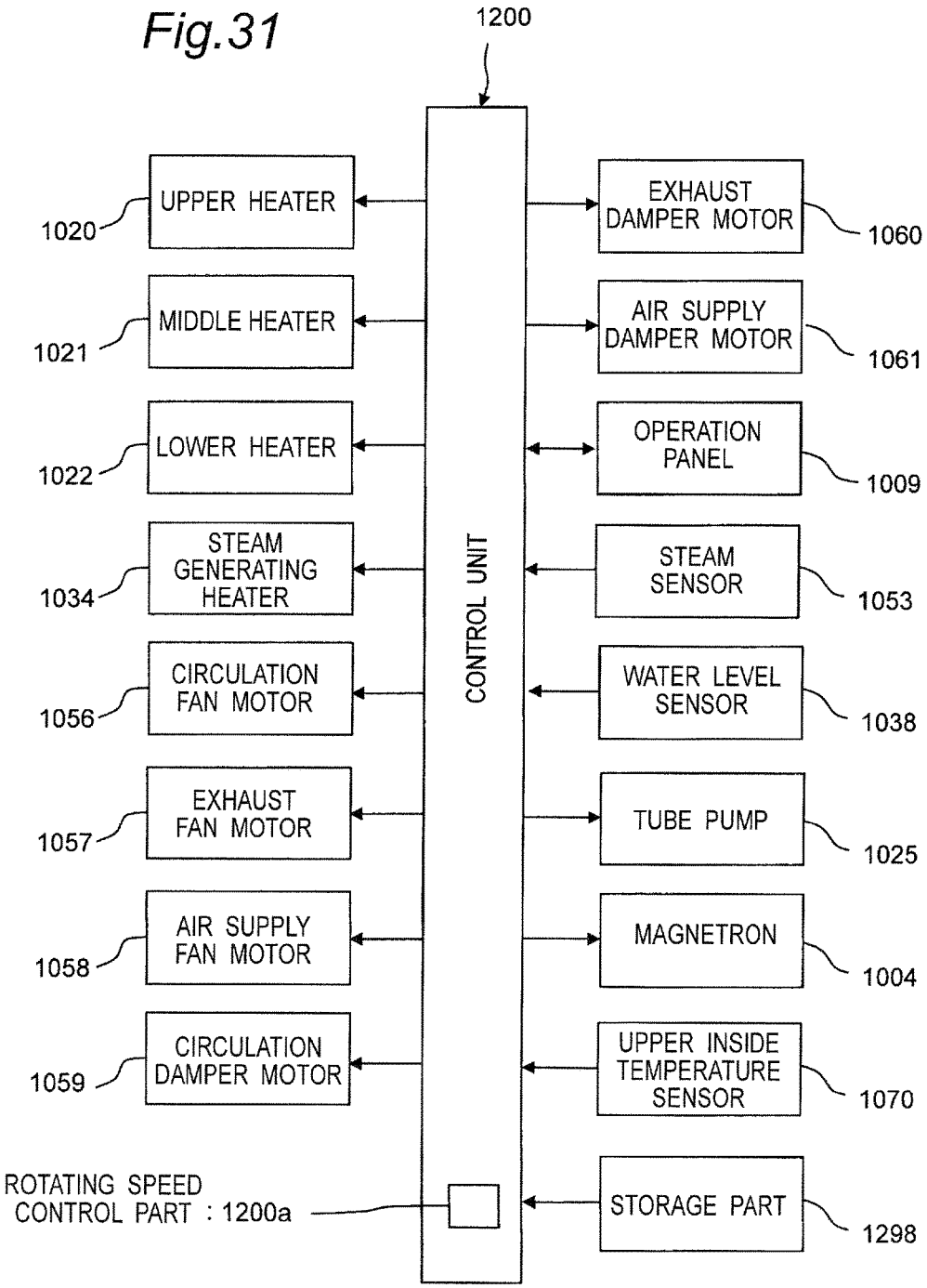
FIG. 31 is a control block diagram of a cooking device according to a sixth embodiment of the invention.

FIG. 31 is a control block diagram of a cooking device according to a sixth embodiment of the invention. In FIG. 31, the same component members as those of the cooking device of the fifth embodiment are designated by the same reference signs as those of the cooking device of the fifth embodiment. In the following description also, the same component members as those of the fifth embodiment are designated by the same reference signs as those of the fifth embodiment.

The cooking device differs from that of the fifth embodiment in that the cooking device includes a control unit 1200 and a storage part 1298 implemented by ROM (Read Only Memory). As with the control unit 1100 of the fifth embodiment, the control unit 1200 is composed of a microcomputer, input/output circuits, and the like. Connected to the control unit 1200 are an upper heater 1020, a middle heater 1021, a lower heater 1022, a steam-generating heater 1034, a circulation fan motor 1056, an exhaust fan motor 1057, an air supply fan motor 1058, a circulation damper motor 1059, an exhaust damper motor 1060, an air supply damper motor 1061, an operation panel 1009, a steam sensor 1053, a water level sensor 1038, a tube pump 1025, a magnetron 1004, an inside temperature sensor 1070, and the like. Based on signals derived from the operation panel 1009, the steam sensor 1053, the water level sensor 1038, the inside temperature sensor 1070, the storage part 1298 and the like, the control unit 1200 controls the upper heater 1020, the middle heater 1021, the lower heater 1022, the steam-generating heater 1034, the circulation fan motor 1056, the exhaust fan motor 1057, the air supply fan motor 1058, the circulation damper motor 1059, the exhaust damper motor 1060, the air supply damper motor 1061, the tube pump 1025, and the like.

Duty ratios of pulse waves at which the rotating speed of the circulation fan motor 1056 comes to a reference rotating speed (e.g., 5000 rpm), which were detected in production line of the cooking device, have been stored in the storage part 1298. It is noted that the term 'duty ratio' refers to a ratio of pulse width to pulse period. The setting may also be such that the rotating speed of the circulation fan motor 1056 becomes, e.g., 6000 rpm when the duty ratio is 100%.

The control unit 1200 has a rotating speed control part 1200*a* implemented by software. The rotating speed control part 1200*a* controls the rotating speed of the circulation fan motor 1056 based on the duty ratios stored in the storage part 1298.

According to the cooking device having the above-described constitution, since the rotating speed control part 1200*a* controls the rotating speed of the circulation fan motor 1056 based on the duty ratios stored in the storage part 1298, the circulation fan motor 1056 can be driven securely at a rotating speed corresponding to a desired menu. Thus, a desired cooking result of a menu can securely be obtained.

Since the rotating speed control part 1200*a* controls the rotating speed of the circulation fan motor 1056 based on the duty ratios stored in the storage part 1298, it is needless to perform feedback control of the rotating speed of the circulation fan motor 1056. Thus, increases in the control burden on the control unit 1200 can be prevented.

Since it is needless to perform feedback control of the rotating speed of the circulation fan motor 1056, it is also needless to add wire harness for the feedback control. Thus, increases in the manufacturing cost of the cooking device can also be prevented.

In the sixth embodiment, duty ratios of pulse waves at which the rotating speed of the circulation fan motor 1056 comes to a reference rotating speed (e.g., 5000 rpm), which were detected in production line of the cooking device, are used for the rotating-speed control of the circulation fan motor 1056. Alternatively, duty ratios of pulse waves at which the rotating speed of another motor comes to a reference rotating speed, which are detected in production line of the cooking device, may be used for the rotating-speed control of another motor.

In the sixth embodiment, the storage part 1298 implemented by software is used. Alternatively, RAM (Random Access Memory) may also be used.

In the sixth embodiment, duty ratios detected in production line of the cooking device are stored in the storage part 1298 outside the control unit 1200. Alternatively, the duty ratios may also be stored in a storage part inside the control unit 1200.

In the sixth embodiment, the rotating speed control part 1200*a* is implemented by software. Alternatively, the control unit 1200 may also be implemented by hardware.

(Seventh Embodiment)

Figure 32:
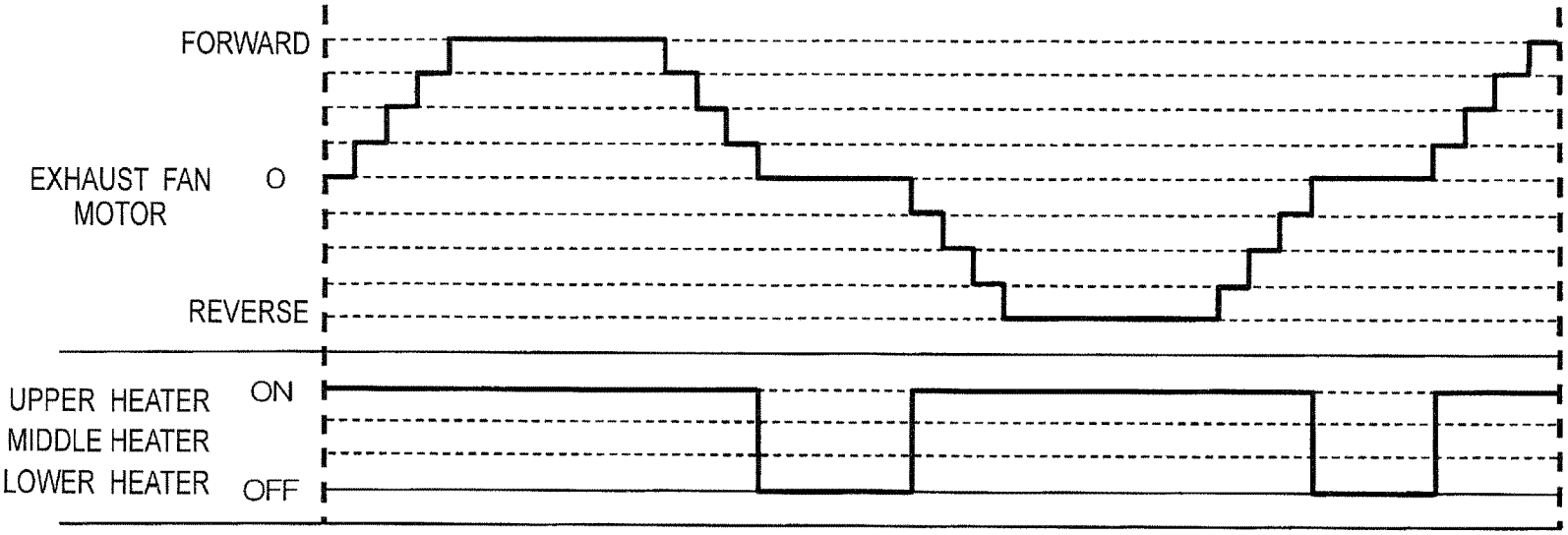
FIG. 32 is a time chart for explaining operations of a cooking device according to a seventh embodiment of the invention.

FIG. 32 is a time chart for explaining operations of a cooking device according to a seventh embodiment of the invention. In the following description, the same component members as those of the fifth embodiment are designated by the same reference signs as those of the fifth embodiment.

In the cooking device, when the upper heater 1020, the middle heater 1021 and the lower heater 1022 are turned ON, the circulation fan motor 1056 is rotated. In this case, the circulation fan motor 1056 repeats forward rotation and reverse rotation alternately. The rotating speed of the circulation fan motor 1056 is controlled by the duty ratio of pulse waves. More specifically, when the duty ratio is 100%, the rotating speed of the circulation fan motor 1056 comes to, e.g., 6000 rpm. The circulation fan motor 1056 has duty ratios incrementing in steps of 25% from 0% to 100% and decrementing in steps of 25% from 100% to 0%. The rotational direction of the circulation fan motor 1056 is changed over after a specified time has elapsed with its rotating speed held at 0. In addition, the term 'duty ratio' refers to a ratio of pulse width to pulse period.

With such control performed over the circulation fan motor 1056, even if an ordinary nut (nuts other than special nuts such as double nuts or the like) is used for fixation of the rotating shaft of the circulation fan motor 1056 and the circulation fan 1019, the nut is less likely to loosen.

That is, the present invention and its embodiments can be summarized as described below.

A cooking device according to an aspect of the invention comprises:

a casing 1001;

a heating chamber 1002 which is provided in the casing 1001 and in which a corner portion 1002*f* connecting an upper portion 1002*e* and a rear portion 1002*d* or a side portion 1002*b*, 1002*c* to each other is sloped relative to a horizontal direction;

a circulation duct 1018 provided so as to range from an upper side to a rear side or a lateral side of the heating chamber 1002;

a heater 1020, 1021, 1022 placed in the circulation duct 1018; and a circulation fan 1019 arranged to feed a heat medium to the heater 1020, 1021, 1022, wherein the circulation fan 1019 is placed in the circulation duct 1018 so as to be opposed to the corner portion 1002*f*.

With this constitution, the corner portion 1002*f* of the heating chamber 1002 connects the upper portion 1002*e* of the heating chamber 1002 and the rear portion 1002*d* or a side portion of the heating chamber 1002 to each other while being sloped relative to the horizontal direction. The circulation fan 1019 is placed in the circulation duct 1018 so as to be opposed to the corner portion 1002*f*. As a result of this, the distance between the rear portion 1002*d* of the heating chamber 1002 and the rear portion of the casing 1001 and/or the distance between the side portion 1002*b*, 1002*c* of the heating chamber 1002 and the side portion of the casing 1001 can be shortened. Thus, the casing 1001 can be downsized.

Since the circulation fan 1019 is placed in the circulation duct 1018 so as to be opposed to the corner portion 1002*f*, increases in the height of the casing 1001 can be suppressed.

Since the corner portion 1002*f* of the heating chamber 1002 connects the upper portion 1002*e* of the heating chamber 1002 and the rear portion 1002*d* or a side portion of the heating chamber 1002 to each other while being sloped relative to the horizontal direction, the capacity, or internal volume, of the heating chamber 1002 can be reduced, so that the temperature inside the heating chamber 1002 can be raised in short time.

The cooking device of one embodiment further comprises a cooking tray 1091 which is to be placed in the heating chamber 1002 to partition inside of the heating chamber 1002 into an upper space 1073A and a lower space 1073B, wherein the heating chamber 1002 has:

a suction port 1027 provided in the corner portion 1002*f* and communicated with inside of the circulation duct 1018;

a first blowoff port 1028 provided in the upper portion 1002*e* and communicated with the inside of the circulation duct 1018; and a second blowoff port 1029 provided in the rear portion 1002*d* or a side portion 1002*b*, 1002*c* and communicated with the inside of the circulation duct 1018, the suction port 1027 and the first and second blowoff ports 1029 being opened to the upper space 1073A, respectively.

According to this embodiment, the upper space 1073A in the heating chamber 1002 is a narrow space, compared with the whole space in the heating chamber 1002. Since the suction port 1027 and the first and second blowoff ports 1029 are each opened to the upper space 1073A, the circulation of the heat medium can be concentrated to the upper space 1073A, so that the upper space 1073A can be warmed in short time. Therefore, with the heating object 15 placed in the upper space 1073A, the time required for heating of the heating object 15 can be reduced. That is, the heating object 15 can be heated with high efficiency.

The cooking device of one embodiment further comprises a damper 1023 arranged to open and close the second blowoff port 1029, wherein the heating chamber 1002 has a third blowoff port 1030, 1031 provided in the rear portion 1002*d* or a side portion so as to be communicated with the inside of the circulation duct 1018 and opened to the lower space 1073B, and wherein the damper 1023, when having opened the second blowoff port 1029, closes a gap between the circulation fan 1019 and the third blowoff port 1030, 1031 and, when having closed the second blowoff port 1029, opens the gap between the circulation fan 1019 and the third blowoff port 1030, 1031.

According to this embodiment, since the damper 1023, when having opened the second blowoff port 1029, closes the gap between the circulation fan 1019 and the third blowoff port 1030, 1031, the heat medium heated by the heater 1021 can be kept from flowing to the third blowoff port 1030, 1031, so that decreases in the heating efficiency of the upper space 1073A in the heating chamber 1002 can be prevented.

Since the damper 1023, when having closed the second blowoff port 1029, opens the gap between the circulation fan 1019 and the third blowoff port 1030, 1031, the heat medium heated by the heater 1021 can be let to flow to the third blowoff port 1030, 1031. Thus, the heating object 1015 placed in the lower space 1073B inside the heating chamber 1002 can be heated.

The cooking device of one embodiment further comprises a steam tube 1036 provided in the circulation duct 1018; and a saturated steam generator 1024 arranged to generate saturated steam to be fed to the steam tube 1036, wherein the steam tube 1036 blows off saturated steam derived from the saturated steam generator 1024 toward a downstream side of the circulation fan 1019 in the circulation duct 1018.

According to this embodiment, since the steam tube 1036 blows off saturated steam derived from the saturated steam generator 1024 to the downstream side of the circulation fan 1019 in the circulation duct 1018, the saturated steam derived from the saturated steam generator 1024 can be prevented from condensing due to contact with the circulation fan 1019. Thus, saturated steam can be supplied into the heating chamber 1002 with high efficiency.

In the cooking device of one embodiment, the steam tube 1036 is provided in a portion of the circulation duct 1018 that is opposed to the corner portion 1002*f*, and the circulation fan 1019 is a forward-and-reverse rotatable centrifugal fan.

According to this embodiment, the steam tube 1036 is provided in a portion of the circulation duct 1018 opposed to the corner portion 1002*f*, and the circulation fan 1019 is a forward-and-reverse rotatable centrifugal fan. As a result of this, when the circulation fan 1019 is rotated forward, the quantity of saturated steam flowing to the upper side of the circulation fan 1019 can be increased, compared with the quantity of saturated steam flowing to the lower side of the circulation fan 1019.

Meanwhile, when the circulation fan 1019 is rotated reverse, the quantity of saturated steam flowing to the lower side of the circulation fan 1019 can be increased, compared with the quantity of saturated steam flowing to the upper side of the circulation fan 1019.

The cooking device of one embodiment further comprises a structure which, with the circulation fan 1019 at rest, allows saturated steam, which has been blown off from the steam tube 1036, to flow directly into the heating chamber 1002 without passing via the heater 1020, 1021, 1022.

According to this embodiment, the cooking device comprises the structure for, with the circulation fan 1019 at rest, allowing saturated steam, which has been blown off from the steam tube 1036, to flow directly into the heating chamber 1002 without passing via the heater 1020, 1021, 1022. Therefore, saturated steam can be supplied into the heating chamber 1002 with high efficiency.

In the cooking device of one embodiment, a gap is provided between a heating chamber 1002-side end of the steam tube 1036 and the corner portion 1002*f*, and a steam supply port 1037 opposed to the heating chamber 1002-side end of the steam tube 1036 is provided in the corner portion 1002*f*.

According to this embodiment, since the steam supply port 1037 opposed to the heating chamber 1002-side end of the steam tube 1036 is provided in the corner portion 1002*f*, saturated steam blown off from the steam tube 1036 can securely be let to flow directly into the heating chamber 1002 without passing via the heater 1020, 1021, 1022 while the circulation fan 1019 is at rest.

Since the gap is provided between the heating chamber 1002-side end of the steam tube 1036 and the corner portion 1002*f*, saturated steam can be drawn out through the gap so as to be let to flow to the upper side of the circulation fan 1019 or to the lower side of the circulation fan 1019, on condition that the circulation fan 1019 is under rotation.

The cooking device of one embodiment further comprises:

a circulation fan unit 1080 including the circulation fan 1019 and a motor 1056 for driving the circulation fan 1019, the circulation fan unit 1080 being attached to the circulation duct 1018 so as to be opposed to the corner portion 1002*f*;

an attachment member 1082 for attaching the circulation fan unit 1080 to the circulation duct 1018; and a seal member 1085 arranged to seal between the circulation fan unit 1080 and the attachment member 1082, wherein the attachment member 1082 is formed in such fashion that a space is generated between the circulation duct 1018 and a portion of the attachment member 1082 that is in contact with the seal member 1085.

According to this embodiment, since the circulation fan unit 1080 is attached to the circulation duct 1018 so as to be opposed to the corner portion 1002*f*, an effect of reducing the distance between the rear portion 1002*d* of the heating chamber 1002 and the rear portion of the casing 1001 is enhanced. Otherwise, an effect of reducing the distance between the side portion 1002*b*, 1002*c* of the heating chamber 1002 and the side portion of the casing 1001 is enhanced.

Since the circulation fan unit 1080 is attached to the circulation duct 1018 so as to be opposed to the corner portion 1002*f*, an effect of suppressing increase in the height of the casing 1001 is enhanced.

Since the attachment member 1082 is formed in such fashion that a space is generated between the circulation duct 1018 and a portion of the attachment member 1082 in contact with the seal member 1085, increases in the temperature of the seal member 1085 can be suppressed. Therefore, the seal member 1085 may be provided by not using a high-priced seal member of relatively high thermal resistance but using a low-priced seal member of relatively low thermal resistance.

In the cooking device of one embodiment, the circulation fan unit 1080 is removably attached to the circulation duct 1018.

According to this embodiment, since the circulation fan unit 1080 is removably attached to the circulation duct 1018, the circulation fan unit 1080 can be removed from the circulation duct 1018, thus facilitating the maintenance of the unit.

The cooking device of one embodiment further comprises:

a temperature sensor 1070 attached to the circulation duct 1018;

a seal member 1086 arranged to seal between the circulation duct 1018 and the temperature sensor 1070; and an opposed portion 1097*a* provided in the circulation duct 1018 and opposed to the seal member 1086, wherein a portion 1018*b*-2 of the circulation duct 1018 to be put in contact with the seal member 1086 as well as the opposed portion 1097*a* are formed in such fashion that a space is generated between the portion 1018*b*-2 and the opposed portion 1097*a*.

According to this embodiment, since the portion 1018*b*-2 of the circulation duct 1018 to be put into contact with the seal member 1086 as well as the opposed portion 1097*a* are formed in such fashion that a space is generated between the portion 1018*b*-2 and the opposed portion 1097*a*, increases in the temperature of the seal member 1086 can be suppressed. Therefore, the seal member 1086 may be provided by not using a high-priced seal member of relatively high thermal resistance but using a low-priced seal member of relatively low thermal resistance.

The cooking device of one embodiment further comprises:

a steam tube 1036 provided in the circulation duct 1018; and a saturated steam generator 1024 arranged to generate saturated steam to be fed to the steam tube 1036, wherein the steam tube 1036 has a first steam tube 1036A placed outside the circulation duct 1018, and a second steam tube 1036B placed within the circulation duct 1018 and communicated with the first steam tube 1036A, the circulation duct 1018 has a first attachment portion 1018*b*-3 to which the first steam tube 1036A is attached, and a second attachment portion 1097*b* to which the second steam tube 1036B is attached, and the first and second attachment portions 1018*b*-3, 1097*b* are formed in such fashion that a space is generated between a second steam tube 1036B-side end of the first steam tube 1036A and a first steam tube 1036A-side end of the second steam tube 1036B.

According to this embodiment, since the first and second attachment portions 1018*b*-3, 1097*b* are formed in such fashion that a space is generated between the second steam tube 1036B-side end of the first steam tube 1036A and the first steam tube 1036A-side end of the second steam tube 1036B, increases in the temperature of the first steam tube 1036A can be suppressed. Therefore, for connection of one end portion of the e.g. resin-made steam tube 1035 to the first steam tube 1036A, the steam tube 1035 may be provided by not using a high-priced steam tube of relatively high thermal resistance but using a low-priced steam tube of relatively low thermal resistance.

Although specific embodiments of the present invention have been described hereinabove, yet the invention is not limited to the above embodiments and may be carried out as they are changed and modified in various ways within the scope of the invention. For example, embodiments of the invention may be provided each in appropriate combinations from among contents of the above-described first to seventh embodiments.

REFERENCE SIGNS LIST

1, 1001 casing
2, 1002 heating chamber
2*a*, 1002*a* opening
2*b*, 1002*b* left side portion
2*c*, 1002*c* right side portion
2*d*, 1002*d* rear portion
3, 1003 door
4, 1004 magnetron
15, 315A, 315B, 415A, 415B, 1015 heating object
18, 1018 circulation duct
18*a*, 1018*a* front portion
18*b*, 1018*b* connecting portion
18*c*, 1018*c* rear portion
19, 1019 circulation fan
20, 1020 upper heater
21, 1021 middle heater
22, 1022 lower heater
23, 1023 damper
24, 1024 saturated steam generator
25, 1025 tube pump
26, 1026 water supply tank
27, 1027 suction port
28, 1028 upper blowoff port
29, 1029 first rear blowoff port
30, 1030 second rear blowoff port
31, 1031 third rear blowoff port
36, 1036 steam tube
37, 1037 steam supply port
62 flow regulation structure
63 first guide surface
64 second guide surface
70, 1070 inside temperature sensor
91, 92, 1091, 1092 cooking tray
93 cooking grid
220A first upper heater
220B second upper heater
271 upper partition
272 rear partition
300*a* first cooking control part
300*b* second cooking control part
370A, 470A inside temperature sensor
370B, 470B lower inside temperature sensor
400*a* cooking control part
1018*b*-2, 1018*b*-3 attachment portion
1036A first steam tube
1036B second steam tube
1085, 1086 seal member
1097 heat shielding plate
1097*a* opposed portion
1097*b* attachment portion

The invention claimed is:

1. A cooking device comprising:
a casing;
a heating chamber provided in the casing;
a microwave generator arranged to supply microwaves into the heating chamber;
a cooking tray which is to be placed in the heating chamber so as to have a gap against a rear portion of the heating chamber and on which a heating object to be heated is to be mounted directly or indirectly;
a duct which is provided on a rear side of the heating chamber and through which a heat medium flows from an upper side toward a lower side;
a rear blowoff port which is provided in the rear portion of the heating chamber so as to be positioned on an upper side of the gap and near a rear portion of the cooking tray and which is communicated with the duct so as to allow the heat medium to be blown off into the heating chamber; and
a flow regulation structure provided on a rear side of the rear blowoff port and arranged to regulate a flow of the heat medium, wherein
the flow regulation structure has, on a lower side thereof, a first guide surface extending in a direction generally parallel to a horizontal direction,
the duct includes an upper portion positioned on an upper side of the heating chamber, and a downward extending portion which extends downward from one end of the upper portion, and the cooking device further comprises:
a centrifugal fan which is rotatable forward and reverse to feed the heat medium into the upper portion of the duct;
a first heater placed on one side in the upper portion of the duct;
a second heater placed separately from the first heater on an opposite side in the upper portion of the duct;
a first upper blowoff port provided in the upper portion of the heating chamber and arranged to blow off the heat medium derived from the first heater into the heating chamber; and
a second upper blowoff port provided in the upper portion of the heating chamber and arranged to blow off the heat medium derived from the second heater into the heating chamber.

2. The cooking device according to claim 1, wherein the flow regulation structure has, on an upper side thereof, a second guide surface sloped with its front end lower than its rear end.

3. The cooking device according to claim 1, further comprising:
a damper provided in the duct to open and close the rear blowoff port, wherein
the damper is sloped with its front end lower than its rear end when the damper is in an opened state.

4. The cooking device according to claim 1, wherein a partition is provided between the first and second upper heaters.

5. The cooking device according to claim 1, wherein the centrifugal fan is configured and arranged such that when the centrifugal fan is rotated forward, more heat medium is fed to the first heater than to the second heater, and when the centrifugal fan is rotated backward, more heat medium is fed to the second heater than to the first heater.

6. A cooking device comprising:
a casing;
a heating chamber provided in the casing;
a microwave generator arranged to supply microwaves into the heating chamber;
a cooking tray which is to be placed in the heating chamber so as to have a gap against a rear portion of the heating chamber and on which a heating object to be heated is to be mounted directly or indirectly;
a duct which is provided on a rear side of the heating chamber and through which a heat medium flows from an upper side toward a lower side;
a rear blowoff port which is provided in the rear portion of the heating chamber so as to be positioned on an upper side of the gap and near a rear portion of the cooking tray and which is communicated with the duct so as to allow the heat medium to be blown off into the heating chamber; and a flow regulation structure provided on a rear side of the rear blowoff port and arranged to regulate a flow of the heat medium, wherein the flow regulation structure has, on a lower side thereof, a first guide surface extending in a direction generally parallel to a horizontal direction, wherein the cooking tray partitions the heating chamber into an upper space and a lower space, the rear blowoff port is a first rear blowoff port opened to the upper space, the heating chamber has a second rear blowoff port which is provided in the rear portion of the heating chamber so as to be positioned below the first rear blowoff port and which is opened to the lower space, and the duct is communicated with the upper space via the first rear blowoff port and with the lower space via the second rear blowoff port, and the cooking device further comprises:

a saturated steam generator arranged to generate saturated steam to be supplied into the duct;

a fan placed in the duct;

a heater at least part of which is placed between the fan and the first rear blowoff port;

a damper arranged to open and close a gap between the fan and the first rear blowoff port and a gap between the fan and the second rear blowoff port;

a first cooking control part configured to control the damper, the fan and the saturated steam generator in such fashion that with the gap between the fan and the first rear blowoff port closed and with the gap between the fan and the second rear blowoff port opened, the fan feeds saturated steam in the duct to the second rear blowoff port, to perform steam cooking in the lower space; and a second cooking control part configured to control the damper, the fan and the heater in such fashion that with the gap between the fan and the first blow-off port opened and with the gap between the fan and the second rear blowoff port closed, the fan feeds the heat medium in the duct to the heater and moreover the heater heats the heat medium, to perform grill cooking in the upper space, wherein the steam cooking in the lower space under control of the first cooking control part and the grill cooking in the upper space under control of the second cooking control part are performed automatically in succession.

7. The cooking device according to claim 6, wherein the flow regulation structure has, on an upper side thereof, a second guide surface sloped with its front end lower than its rear end.

8. The cooking device according to claim 6, further comprising:

a damper provided in the duct to open and close the first rear blowoff port, wherein the damper is sloped with its front end lower than its rear end when the damper is in an opened state.

9. A cooking device comprising:

a casing;

a heating chamber which is provided in the casing and in which a corner portion connecting an upper portion to a rear portion or a side portion is sloped relative to a horizontal direction;

a circulation duct provided so as to range from an upper side to a rear side or a lateral side of the heating chamber;

a heater placed in the circulation duct;

a circulation fan unit including a circulation fan arranged to feed a heat medium to the heater, and a motor for driving the circulation fan, the circulation fan unit being attached to the circulation duct so as to be opposed to the corner portion; an attachment member for attaching the circulation fan unit to the circulation duct; and a seal member arranged to seal between the circulation fan unit and the attachment member, wherein the circulation fan unit has a base member on which the motor is mounted, the base member being fixed to the attachment member, the seal member seals a gap between the base member and the attachment member, and the attachment member is formed in such fashion that a space is generated between the circulation duct and a portion of the attachment member that is in contact with the seal member.

10. The cooking device according to claim 9, further comprising a cooking tray which is to be placed in the heating chamber to partition inside of the heating chamber into an upper space and a lower space, wherein the heating chamber has:

a suction port provided in the corner portion and communicated with inside of the circulation duct;

a first blowoff port provided in the upper portion and communicated with the inside of the circulation duct; and a second blowoff port provided in the rear portion or a side portion and communicated with the inside of the circulation duct, the suction port and the first and second blowoff ports being opened to the upper space, respectively.

11. A cooking device comprising:

a casing;

a heating chamber which is provided in the casing and in which a corner portion connecting an upper portion to a rear portion or a side portion is sloped relative to a horizontal direction;

a circulation duct provided so as to range from an upper side to a rear side or a lateral side of the heating chamber;

a heater placed in the circulation duct;

a circulation fan arranged to feed a heat medium to the heater, the circulation fan being placed in the circulation duct so as to be opposed to the corner portion;

a temperature sensor attached to the circulation duct;

a seal member arranged to seal between the circulation duct and the temperature sensor; and an opposed portion provided in the circulation duct and opposed to the seal member, wherein a portion of the circulation duct to be put in contact with the seal member as well as the opposed portion are formed in such fashion that a space is generated between the portion and the opposed portion.

12. The cooking device according to claim 11, further comprising a cooking tray which is to be placed in the heating chamber to partition inside of the heating chamber into an upper space and a lower space, wherein the heating chamber has:

a suction port provided in the corner portion and communicated with inside of the circulation duct;

a first blowoff port provided in the upper portion and communicated with the inside of the circulation duct; and a second blowoff port provided in the rear portion or a side portion and communicated with the inside of the circulation duct, the suction port and the first and second blowoff ports being opened to the upper space, respectively.

13. A cooking device comprising:

a casing;

a heating chamber which is provided in the casing and in which a corner portion connecting an upper portion to a rear portion or a side portion is sloped relative to a horizontal direction;

a circulation duct provided so as to range from an upper side to a rear side or a lateral side of the heating chamber;

a heater placed in the circulation duct;

a circulation fan arranged to feed a heat medium to the heater, wherein the circulation fan is placed in the circulation duct so as to be opposed to the corner portion;

a steam tube provided in the circulation duct; and a saturated steam generator arranged to generate saturated steam to be fed to the steam tube, wherein the steam tube has a first steam tube placed outside the circulation duct, and a second steam tube placed within the circulation duct and communicated with the first steam tube, the circulation duct has a first attachment portion to which the first steam tube is attached, and a second attachment portion to which the second steam tube is attached, and the first and second attachment portions are formed in such fashion that a space is generated between a second steam tube-side end of the first steam tube and a first steam tube-side end of the second steam tube.

14. The cooking device according to claim 13, further comprising a cooking tray which is to be placed in the heating chamber to partition inside of the heating chamber into an upper space and a lower space, wherein the heating chamber has:

a suction port provided in the corner portion and communicated with inside of the circulation duct;

a first blowoff port provided in the upper portion and communicated with the inside of the circulation duct; and a second blowoff port provided in the rear portion or a side portion and communicated with the inside of the circulation duct, the suction port and the first and second blowoff ports being opened to the upper space, respectively.

15. A cooking device comprising:

a casing;

a heating chamber provided in the casing;

a microwave generator arranged to supply microwaves into the heating chamber;

a cooking tray which is to be placed in the heating chamber so as to have a gap against a rear portion of the heating chamber and on which a heating object to be heated is to be mounted directly or indirectly;

a duct which is provided on a rear side of the heating chamber and through which a heat medium flows from an upper side toward a lower side;

a rear blowoff port which is provided in the rear portion of the heating chamber so as to be positioned on an upper side of the gap and near a rear portion of the cooking tray and which is communicated with the duct so as to allow the heat medium to be blown off into the heating chamber; and a flow regulation structure provided on a rear side of the rear blowoff port and arranged to regulate a flow of the heat medium, wherein the flow regulation structure has, on a lower side thereof, a first guide surface extending in a direction generally parallel to a horizontal direction, and on an upper side thereof, a second guide surface sloped downward from its rear end up to its front end, so as to allow the heat medium to be blown from the rear blowoff port obliquely downward toward the cooking tray.

16. The cooking device according to claim 15, further comprising:

a damper provided in the duct to open and close the rear blowoff port, wherein the damper is sloped with its front end lower than its rear end when the damper is in an opened state.

17. The cooking device according to claim 15, wherein the duct includes an upper portion positioned on an upper side of the heating chamber, and a downward extending portion which extends downward from one end of the upper portion, and the cooking device further comprises:

a centrifugal fan which is rotatable forward and reverse to feed the heat medium into the upper portion of the duct;

a first heater placed on one side in the upper portion of the duct;

a second heater placed on an opposite side in the upper portion of the duct;

a first upper blowoff port provided in the upper portion of the heating chamber and arranged to blow off the heat medium derived from the first heater into the heating chamber; and a second upper blowoff port provided in the upper portion of the heating chamber and arranged to blow off the heat medium derived from the second heater into the heating chamber.

18. The cooking device according to claim 15, wherein the cooking tray partitions the heating chamber into an upper space and a lower space, the rear blowoff port is a first rear blowoff port opened to the upper space, the heating chamber has a second rear blowoff port which is provided in the rear portion of the heating chamber so as to be positioned below the first rear blowoff port and which is opened to the lower space, and the duct is communicated with the upper space via the first rear blowoff port and with the lower space via the second rear blowoff port, and the cooking device further comprises:

a saturated steam generator arranged to generate saturated steam to be supplied into the duct;

a fan placed in the duct;

a heater at least part of which is placed between the fan and the first rear blowoff port;

a damper arranged to open and close a gap between the fan and the second rear blowoff port;

a first cooking control part configured to control the damper, the fan and the saturated steam generator in such fashion that with the gap between the fan and the second rear blowoff port opened, the fan feeds saturated steam in the duct to the second rear blowoff port; and a second cooking control part configured to control the damper, the fan and the heater in such fashion that with the gap between the fan and the second rear blowoff port closed, the fan feeds the heat medium in the duct to the heater and moreover the heater heats the heat medium.

* * * * *